US005744741A

United States Patent [19]

Nakajima et al.

[11] Patent Number: 5,744,741

[45] Date of Patent: Apr. 28, 1998

[54] DIGITAL SIGNAL PROCESSING DEVICE FOR SOUND SIGNAL PROCESSING

[75] Inventors: Yasuyoshi Nakajima; Masahiro Koyama, both of Hamamatsu, Japan

[73] Assignee: Yamaha Corporation, Japan

[21] Appl. No.: 583,985

[22] Filed: Jan. 11, 1996

[30] Foreign Application Priority Data

| | | | |
|---|---|---|---|
| Jan. 13, 1995 | [JP] | Japan | 7-004121 |
| Feb. 28, 1995 | [JP] | Japan | 7-067110 |
| Apr. 20, 1995 | [JP] | Japan | 7-117672 |

[51] Int. Cl.[6] ..... G10H 1/02; G10H 1/057; G10H 1/06

[52] U.S. Cl. ..... 84/622; 84/626; 84/627; 84/659

[58] Field of Search ..... 84/622–633, 659–665, 84/DIG. 9

[56] References Cited

U.S. PATENT DOCUMENTS

| | | | |
|---|---|---|---|
| 4,292,873 | 10/1981 | Okumura et al. | 84/627 X |
| 4,373,416 | 2/1983 | Endo et al. . | |
| 4,841,828 | 6/1989 | Suzuki | 84/DIG. 9 |
| 5,020,410 | 6/1991 | Sasaki . | |
| 5,091,951 | 2/1992 | Ida et al. | 84/630 X |
| 5,121,667 | 6/1992 | Emery . | |
| 5,138,927 | 8/1992 | Nishimoto . | |
| 5,182,415 | 1/1993 | Kunimoto | 84/660 |
| 5,198,604 | 3/1993 | Higashi et al. | 84/626 |
| 5,202,528 | 4/1993 | Iwaooji | 84/661 X |
| 5,220,117 | 6/1993 | Yamada et al. | 84/600 |
| 5,252,849 | 10/1993 | Kobayashi | 84/659 |
| 5,376,752 | 12/1994 | Limberis . | |

FOREIGN PATENT DOCUMENTS

| | | |
|---|---|---|
| 0 126 975 | 12/1984 | European Pat. Off. . |
| 3318667 | 10/1984 | Germany . |
| 2-271397 | 11/1990 | Japan . |
| 3-200300 | 9/1991 | Japan . |
| 4-299394 | 10/1992 | Japan . |
| 4-346502 | 12/1992 | Japan . |

*Primary Examiner*—Stanley J. Witkowski
*Attorney, Agent, or Firm*—Graham & James LLP

[57] ABSTRACT

A plurality of digital signal processors are provided in parallel relation to each other, and a series of operations for desired sound signal synthesis or processing is divided into a plurality of operation groups to be allocated to the signal processors. First and second buses are connected to each of the signal processors so that parameters necessary for the operations are distributively supplied to the signal processors via the first bus and the operation result of each of the signal processors is transferred to another digital signal processor or an output port via the second bus. One digital signal processor receives the output data from another digital signal processor via the second bus so as to perform a predetermined operation using the received data. The desired sound signal processing is thus executed by combinations of the operations performed by such signal processors. Where sound signal processing is executed in a plurality of channels on a time-divisional basis, the time-divisional channel timing of each digital signal processor is set independently of that of other digital signal processors. By setting synchronized tone generation designating data for each channel, synchronized tone generation is controllably performed in selected channels.

21 Claims, 28 Drawing Sheets

FORMANT SOUND SYNTHESIS IN DSP1

| | STEP | S0 | S1 | S2 | S3 | S4 | S5 | S6 | S7 | S8 | S9 | S10 | S11 | S12 | S13 | S14 | S15 | S16 | S17 | S18 | S19 | S20 |
|---|---|---|---|---|---|---|---|---|---|---|---|---|---|---|---|---|---|---|---|---|---|---|
| (a) | A INPUT OF ALU1 | FNUM (n OR n-1) | | FORM | #1 | UFORM | #1 | #REG 1 | #1 | #REG 1 | #REG 1 | #REG 1 | TR2 | TR2 | #REG 1 | BW | BW | #REG 1 | #1 | #1 | TRu | TRu |
| (b) | B INPUT OF ALU1 | AG | | AG | 「0」 | AGu | 「0」 | #REG 1 | PGu | 「0」 | PGp1 | PGp2 | MIXL | MIXR | PGf1 | PGw1 | PGw2 | PGf2 | PGp1 | PGp2 | MIXL | MIXR |
| (c) | #1 | | | | S0 RES. | | S2 RES. | | S4 RES. | | | | | | | | | | S14 RES. | S15 RES. | | |
| (d) | INPUT TO REG1 | | | | | | | S3 RES. | | S5 RES. | S6 RES. | | S8 RES. | | | | | | | | | |
| (e) | INPUT DATA TO RAM1 | | | | S19 RES. TO MIXL | S20 RES. TO MIXR | | | | | | | S7 RES. TO PGu | | S9 RES. TO PGp1 | S10 RES. TO PGp2 | S11 RES. TO MIXL | S12 RES. TO MIXR | S13 RES. TO PGf1 | S17 RES. TO PGw1 | S18 RES. TO PGw2 | S16 RES. TO PGf2 |

1 CHANNEL TIME (RES. = RESULT)

F I G. 9

FUNCTIONS OF DSP1

OPERATIONS OF DSP3

| | STEP | S0 | S1 | S2 | S3 | S4 | S5 | S6 | S7 | S8 | S9 | S10 | S11 | S12 | S13 | S14 | S15 | S16 | S17 | S18 | S19 | S20 |
|---|---|---|---|---|---|---|---|---|---|---|---|---|---|---|---|---|---|---|---|---|---|---|
| (a) | A INPUT OF ALU3 | NRES | NBW | NBW | WN | #3 | #3 | — | — | #3 | #3 | #3 | #3 | #3 | #3 | #3 | #3 | #3 | #3 | #3 | | #3 |
| (b) | B INPUT OF ALU3 | LPF | BWR | BWR | LPF | #REG 3 | LPF | #REG 3 · SLPF | #REG 3 · SLPF | #REG 3 · SLPF | #REG 3 · SLPF | #REG 3 · SLPF | #REG 3 · SLPF | #REG 3 · SLPF | #REG 3 · SLPF | #REG 3 · SLPF | #REG 3 · SLPF | #REG 3 · SLPF | #REG 3 · SLPF | TmpM | | #REG 3 |
| (c) | #3 | | | | | S2 RES. | S3 RES. | | | S6 RES. | S7 RES. | S8 RES. | S9 RES. | S10 RES. | S11 RES. | S12 RES. | S13 RES. | S14 RES. | S15 RES. | S16 RES. | | S18 RES. |
| (d) | INPUT TO REG3 | | | | S1 RES. | | | S4 RES. | | | | | | | | | | | | | S17 RES. | |
| (e) | INPUT TO AREG | | | S0 RES. | | | | | | | | | | | | | | | | | | |
| (f) | INPUT DATA TO RAM3 | | | S20 RES. TO BWR | | S1 RES. TO TmpM | | | | S5 RES. TO LPF | | | | | | | | | | | | |

(RES. =RESULT)

FIG. 11

FUNCTIONS OF DSP3

FORMANT SYNTHESIS IN DSP4

| | STEP | S0 | S1 | S2 | S3 | S4 | S5 | S6 | S7 | S8 | S9 | S10 | S11 | S12 | S13 | S14 | S15 | S16 | S17 | S18 | S19 | S20 |
|---|---|---|---|---|---|---|---|---|---|---|---|---|---|---|---|---|---|---|---|---|---|---|
| (a) | A INPUT OF ALU4 | PGf1 | #4 | PGw1 | | | LVL1 | | #4 | | | PGf2 | | PGw2 | PGu | | LVL2 | LVLu | #4 | #4 | | — |
| (b) | B INPUT OF ALU4 | — | #REG 4 | — | | | #REG 4 | | #REG 4 | | | — | | — | — | | #REG 4 | BWR | #REG 4 | #REG 4 | | TR1 |
| (c) | # 4 | | S20 RES. | | | | | | S5 RES. | | | | | | | | | | S15 RES. | S16 RES. | | |
| (d) | INPUT TO REG4 | S17 RES. | | | | S0 RES. | | S2 RES. | | | | | | | | S10 RES. | | S12 RES. | S13 RES. | | | |
| (e) | INPUT DATA TO RAM4 | | | S18 RES. TO TRu | | S1 RES. TO TR2 | | | | | | | | S7 RES. TO TR1 | | | | | | | | |

1 CHANNEL TIME (RES. =RESULT)

FIG. 13

FUNCTIONS OF DSP4

FM SYNTHESIS IN DSP1

| | STEP | S0 | S1 | S2 | S3 | S4 | S5 | S6 | S7 | S8 | S9 | S10 | S11 | S12 | S13 | S14 | S15 | S16 | S17 | S18 | S19 | S20 |
|---|---|---|---|---|---|---|---|---|---|---|---|---|---|---|---|---|---|---|---|---|---|---|
| (a) | A INPUT OF ALU1 | FNUM (n OR n-1) | | FNUM (n OR n-1) | #1 | UFO RM | #1 | #REG 1 | #1 | #REG 1 | #REG 1 | #REG 1 | TR2 | TR2 | #REG 1 | BW | BW | #REG 1 | #1 | #1 | TRu | TRu |
| (b) | B INPUT OF ALU1 | AG | | AG | 「0」 | AGu | 「0」 | #REG 1 | PGu | #REG 1 | PGf1 | PGp2 | MIXL | MIXR | PGf1 | PGw1 | PGw2 | PGf2 | PGp1 | PGp2 | MIXL | MIXR |
| (c) | #1 | | | | S0 RES. | | S2 RES. | | S4 RES. | | | | | | | | | | S14 RES. | S15 RES. | | |
| (d) | INPUT TO REG1 | | | | | | | S3 RES. | | S5 RES. | S6 RES. | | S8 RES. | | | | | | | | | |
| (e) | INPUT DATA TO RAM1 | | | | S19 RES. TO MIXL | | | | | | | | S7 RES. TO PGu | | S9 RES. TO PGf1 | S10 RES. TO PGp2 | S11 RES. TO MIXL | S12 RES. TO MIXR | S13 RES. TO PGp1 | S17 RES. TO PGw1 | S18 RES. TO PGw2 | S16 RES. TO PGf2 |

1 CHANNEL TIME

FIG. 15

(RES. =RESULT)

FM SYNTHSIS IN DSP4

| | STEP | S0 | S1 | S2 | S3 | S4 | S5 | S6 | S7 | S8 | S9 | S10 | S11 | S12 | S13 | S14 | S15 | S16 | S17 | S18 | S19 | S20 |
|---|---|---|---|---|---|---|---|---|---|---|---|---|---|---|---|---|---|---|---|---|---|---|
| (a) | A INPUT TO ALU4 | PGf1 | #4 | PGw1 | | | LVL1 | | | | — | PGf2 | #4 | PGw2 | PGu | | LVL2 | LVLu | | #4 | | — |
| (b) | B INPUT TO ALU4 | FR OR "0" | #REG 4 | — | | | #REG 4 | | | | TR1 | TR1 OR "0" | #REG 4 | — | — | | #REG 4 | BWR | | #REG 4 | | TR1 OR "0" |
| (c) | #4 | | S20 RES. | | | | | | | | | | S9 RES. | | | | | | | S16 RES. | | |
| (d) | INPUT TO REG4 | | | | | S0 RES. | | S2 RES. | | | S5 RES. | | | | | S10 RES. | | S12 RES. | S13 RES. | | S15 RES. | |
| (e) | INPUT DATA TO RAM4 | | | S18 RES. TO TRu | | S1 RES. TO TR2 | | | | | | S5 RES. TO TR1 | | | | S11 RES. TO FR | | | | | | |

1 CHANNEL TIME (RES. =RESULT)

FIG. 16

FIG. 17(a) PGp1
FIG. 17(b) PGp2
FIG. 17(c) PGf1
FIG. 17(d) PGf2
TIME WIDTH
FIG. 17(e) PGw1
FIG. 17(f) PGw2
TIME

FIG. 18(a) FIRST-GROUP PERIODIC FUNCTION WAVEFORM

FIG. 18(b) SECOND-GROUP PERIODIC FUNCTION WAVEFORM

FIG. 18(c) FIRST-GROUP WINDOW FUNCTION WAVEFORM

FIG. 18(d) SECOND-GROUP WINDOW FUNCTION WAVEFORM

FIG. 18(e) FIRST-GROUP FORMANT SOUND WAVEFORM

FIG. 18(f) SECOND-GROUP FORMANT SOUND WAVEFORM

FIG. 18(g) FINAL FORMANT SOUND WAVEFORM

| PARAMETER DATA | FUNCTION OF PARAMETER |
|---|---|
| NBW | NOISE BANDWIDTH |
| NSKT | FLARING SHAPE OF NOISE SPECTRUM |
| NRES | SHARPNESS OF NOISE SPECTRUM |
| UDFM | DEPTH & RATE OF CENTER FRE. MODULATION OF UNVOICED FORMANT SOUND |
| UFOM | ON/OFF OF CENTER FRE. MODULATION OF UNVOICED FORMANT SOUND |
| UFORM | CENTER FREQUENCY OF UNVOICE FORMANT SOUND |
| DVB | DEPTH & RATE OF VIBRATO |
| VIB | ON/OFF OF VIBRATO |
| FNUM | PITCH FREQUENCY NO. |
| DFM | DEPTH & RATE OF CENTER FREQUENCY MODULATION OF FORMANT SOUND |
| FOM | ON/OFF OF CENTER FREQUENCY MODURATION OF FORMANT SOUND |
| FORM | FORMANT FREQUENCY NO. |
| MULT1 | FREQUENCY MULTIPLICATION FACTOR(OP1) |
| MULT2 | FREQUENCY MULTIPLICATION FACTOR(OP2) |
| BW | FORMANT BANDWIDTH (WINDOW FUNCTION TIME WIDTH) |
| RHY | ON/OFF OF RHYTHM SOUND GENERATION MODE |
| WF1 | FUNDMENTAL WAVEFORM (OP1 OR FORMANT PERIODIC FUNCTION WAVEFORM) |
| WF2 | FUNDAMENTAL WAVEFORM (OP2) |
| SKT | SKIRT CHAR. OF FORMANT SOUND |
| FBL | FEEDBACK FM LEVEL |
| PAN | PANNING OF FORMANT & FM SOUNDS |
| uPAN | PANNING OF UNVOICED FORMANT SOUND |
| URVF | FORMANT FOLLOWING CONTROL FLAG |
| UAGparameters | ATTACK GLIDE EG PARAMETERS OF UNVOICED FORMANT SOUND |
| AG1parameters | ATTACK GLIDE EG PARAMETERS |
| UEGparameters | EG PARAMETERS FOR UNVOICED FORMANT SOUND |
| EGparameters | EG PARAMETERS |
| TL1 | TOTAL LEVEL (OP1 OR FORMANT PERIODIC FUNCTION WAVEFORM) |
| TL2 | TOTAL LEVEL (OP2) |
| UTL | TOTAL LEVEL OF UNVOICED FORMANT SOUND |
| AM | ON/OFF OF TREMOLO |
| UAM | ON/OFF OF TREMOLO OF UNVOICED FORMANT SOUND |
| DAM | DEPTH & RATE OF TREMOLO |
| UAM | DEPTH & RATE OF TREMOLO OF UNVOICED FORMANT SOUND |
| KON | KEY-ON |
| ALG | TONE SYNTHE. ALGORITHM |
| RBP | CHANNEL SYNC. FLAG |

FIG. 19

DIGITAL SIGNAL PROCESSING DEVICE FOR SOUND SIGNAL PROCESSING

BACKGROUND OF THE INVENTION

The present invention relates to a digital signal processing device which is used for synthesis of a digital sound waveform signal corresponding to a musical tone or other audible acoustic sound, and/or for impartment of various tonal effects or acoustic effects to a digital sound waveform signal.

The present invention also relates to a voice and tone (namely, sound) synthesis device which synthesizes a voice or tone having formants by combining formant sounds.

Along with the recent advancement in digital signal processing technology and integrated circuit technology, various devices have been proposed which employ dedicated LSI (large-scale integrated circuit) and which, on the basis of stored microprograms, execute predetermined arithmetic operations of various signals to synthesize a digital sound waveform signal or to impart a desired tonal or acoustic effect to a digital sound waveform signal. These devices, which are commonly known as digital signal processor or DSP, are incorporated in tone or sound signal processing devices such as an electronic musical instrument or sound source device.

For example, where such a digital signal processor is applied to an electronic musical instrument to synthesize a digital tone waveform signal, it has been customary to construct a single digital signal processor having circuitry arranged to perform all sequential operations according to a specific waveform synthesis method (such as a formant sound synthesis method or FM (frequency modulation) synthesis method) and to also store, in the signal processor, microprograms describing the sequential operations. For example, U.S. Pat. No. 4,373,416 discloses such a tone synthesizing digital signal processor.

However, with the conventionally-known digital signal processor technique employed in an electronic musical instrument, the single digital signal processor has to be constructed to perform all the operations for tone waveform synthesis. To this end, a high processing speed is required as the total number of operation cycles increases to meet the tendency toward sophisticated and multifunctional operations and increased number of tone generation channels in today's electronic musical instruments. But, because there is naturally a limit to the processing speed increase, it is becoming difficult to meet such demands. Further, when constructing a tone synthesis system using a plurality of tone synthesis methods in combination (such as for simultaneously generating an FM-synthesized sound and a noise formant sound), the synthesis system must be designed to execute the sequential operations for each tone synthesis method independently of those for the other method, thus resulting in increased overall size of the system; so, it was difficult to construct an efficient tone synthesis system in the past. Further, even in a tone synthesis system using only one tone synthesis method, the entire digital signal processor must be redesigned in order to change part of the contents of the operations, which was also inefficient. Thus, the conventional digital signal processing system could not efficiently comply with a demand of changing the contents of operations for tone waveform synthesis or processing, nor could it provide a multifunctional tone synthesizing DSP system which permits optional switching of use between a plurality of tone synthesis methods and combined use of the tone synthesis methods.

As generally known, a voice is composed of a consonant part (unvoiced sound) and a vowel part (voiced sound). In the case of the vowel part, vibration is excited in the vocal cords by air streams from the lungs, and resultant air vibration waves are radiated out of the body through the trachea and oral cavity. As the vibrated air passes through the oral cavity, various resonant characteristics are imparted depending on the shape of the oral cavity, i.e., the structure of the tongue, lips, jaws etc., so that voices of various sound colors may be generated.

The voiced sound has a plurality of characteristic formants. By synthesizing such characteristic formants in an artificial manner, a desired voiced sound can be reproduced with some degree of fidelity. Voiced sound synthesizing devices are known which generate a periodic waveform (e.g., sine wave) having a given frequency and a window function of a given pitch and multiplies the periodic waveform and window function to form a formant sound. For example, U.S. Pat. No. 5,138,927 discloses such a voiced sound synthesizing device.

On the other hand, one form of unvoiced sound synthesizing devices is proposed in Japanese Patent Laid-open Publication No. HEI 2-271397, which is designed to generate a noise sound by band-controlling white noise via a low-pass filter and multiplies the noise sound and a periodic waveform having a given frequency to thereby generate a noise formant. Japanese Patent Laid-open Publication No. HEI 4-346502 also discloses such an unvoiced sound synthesizing device. A desired sound can be produced by combining a voiced formant and noise formant. For example, Japanese Patent Laid-open Publication No. HEI 4-299394 discloses a technique of synthesizing a formant sound by combining a voiced synthesized sound and unvoiced synthesized sound. Further, Japanese Patent Laid-open Publication No. HEI 3-200300 discloses a technique of synthesizing a voiced sound and an unvoiced sound by using a common pitch-envelope for the voiced and unvoiced sounds.

In order to produce a sound, it is sufficient to provide a plurality of tone generation channels each designed to generate a formant and combine respective formants generated by the channels. For this purpose, it is necessary that the formants generated by the individual tone generation channels have center frequencies peculiar to a sound to be produced, uniformized window function pitch and all the tone generation channels simultaneously start sound generation.

SUMMARY OF THE INVENTION

It is therefore an object of the present invention to provide an efficient digital signal processing device which can execute operations at increased speed and which achieves increased designing and fabricating facility, enhanced general-purpose utility and increased economical efficiency of the device.

It is another object of the present invention to provide an efficient sound signal synthesis device which permits sound synthesis full of varieties with simple structure and control.

It is still another object of the present invention to provide a sound signal synthesis device which has a synchronized tone generation instructing function that causes a plurality of tone generation channels to synchronously generate sound signals and combines the generated sound signals together to synthesize a single sound.

It is still another object of the present invention to provide a voice and tone synthesis device, i.e., sound synthesis device which generates formants of same formant pitch via a plurality of sound generation channels and combines the generated formants to produce a single sound, where the formant pitch is established, for example, by a window function pitch to be multiplied by a periodic waveform.

In order to accomplish the above-mentioned objects, a digital signal processing device according to a first aspect of the present invention comprises a parameter supply section for supplying a plurality of parameters necessary for desired sound signal processing, a plurality of independent digital signal processor sections, each of the processor sections receiving one or more of the parameters necessary for a predetermined operation so as to perform the predetermined operation on digital input data in accordance with the received parameters and a preset program and thereby outputting processed data, a parameter feeding section including a first bus connected to each of the digital signal processor section so as to distributively feed, via the first bus, the parameters to predetermined one or more of the digital signal processor section, and a data transfer section including a second bus connected to each of the digital signal processor section so as to transfer output data of each of the processor sections via the second bus, wherein at least predetermined one of the digital signal processor sections receives the output data of another of the processor sections via the second bus and performs the predetermined operation using the received data as the input data, so that the desired sound signal processing is executed on the basis of combination of the operations performed by the digital signal processor sections and a resultant processed sound signal is fed to the second bus as the output data of predetermined one of the digital signal processor sections.

In the digital signal processing device thus arranged, a plurality of independent digital signal processor sections are provided in parallel relation to each other, each of which receives parameters necessary for a predetermined operation so as to perform the predetermined operation on digital input data in accordance with the received parameters and a preset program and thereby outputs processed data. The digital signal processor sections are interconnected by means of the first and second bus, so that the necessary parameters are distributed to the processor sections and the operation result of each of the processors is transferred by means of the second bus to be used in one or more of the other digital signal processor sections. Thus, at least predetermined one of the digital signal processor sections receives the output data of another of the processor sections via the second bus and performs the predetermined operation using the received data as the input data. In this manner, the desired sound signal processing can be executed on the basis of combination of the operations performed by the digital signal processor sections and a resultant processed sound signal is fed to the second bus as the output data of predetermined one of the digital signal processor sections.

Because of the feature of the above-mentioned sound signal synthesis device that the desired sound signal processing is executed on the basis of combination of the operations performed by the digital signal processor sections (i.e., a series of operations for processing digital sound signal is divided into a plurality of operation groups corresponding to the digital signal processor sections and simultaneously performed in the processor sections in a parallel fashion), the necessary operations for the desired sound signal processing can be executed at substantially increased speed even where a relatively great number of processing steps are involved and multi-channel sound signal is to be processed.

Further, because it is sufficient for each of the digital signal processor sections to execute only the allocated operations, the operations to be executed in each of the processor sections can be substantially simplified. This allows each of the processor sections to be substantially simplified in circuit structure, and the processor sections can be made similar in circuit structure. As a result, each of the processor sections can be designed and fabricated with increased ease and at reduced cost, and in addition, the general-purpose utility of the synthesis device of the present invention can be greatly enhanced.

Moreover, because the digital signal processor sections are interconnected via the first and second common buses, it is sufficient that wires or connecting lines for carrying input parameters and output data be simply connected to the buses without a need for complicated, separate wiring Thus, the number of the digital signal processor sections employed can be optionally increased or decreased with extreme ease. This also can enhance the general-purpose utility of the synthesis device and achieve an efficient use of the synthesis device.

Furthermore, in the case where a tone synthesis system is to be constructed by employing different kinds of tone synthesis method in combination (for example, where FM-synthesized sound and noise formant sound are to be simultaneously generated, or normal formant sound and noise formant sound are to be simultaneously generated), operations processable by an operational algorithm common to the different methods can be performed by use of a same digital signal processor section. With this feature, an efficient system can be provided without a need to separately perform a series of operations for each of the tone synthesis methods as in the past. Although the operations for generating a sound waveform are performed in the present invention by use of a different digital signal processor section for each of the tone synthesis methods employed, the system can be efficiently constructed in such a manner that the operations for generating envelope signal data are performed by a common digital signal processor section.

Further, where part of the series of of operations for synthesizing or processing digital sound signal in accordance with a tone synthesis method is to be changed, it is sufficient that only any of the digital signal processor section corresponding to the part be changed in circuit structure. This feature advantageously permits an efficient designing change at low cost. Therefore, the present invention can efficiently comply with a demand for modifying the contents of the sound waveform synthesis or processing. Further, the present invention can efficiently provide a multifunction-type digital signal processing system for sound synthesis or processing which allows the tone synthesis method to be switched from one to another as desired and also allows different tone synthesis methods to be used in combination.

A sound signal synthesis device for synthesizing a sound signal in a plurality of channels according to a second aspect of the present invention comprises a plurality of operation processing sections, each of the operation processing sections performing operations corresponding to each one of signal processing segments that are divided from sequential signal processing operations for sound-synthesizing, the operation processing sections being provided in parallel relation to each other so as to simultaneously perform the operations, each of the operation processing sections performing the operations for a plurality of channels on a time-divisional basis at time-divisional channel processing timing unique to the processing section to thereby output an operation result of each of the channels, at least one of the operation processing sections performing the operations by use of the operation results of another operation processing section, a data transfer section including a bus connected to each of the operation processing sections so as to transfer, via the bus, the operation results of each operation processing section to another operation processing section or a sound signal output port, and a parameter supply section for supplying each operation processing section with one or more parameters necessary for sound signal synthesis in each of the channels.

Further, a digital signal processing device according to a third aspect of the present invention comprises a parameter supply section for supplying a plurality of parameters necessary for desired sound signal processing, a plurality of independent digital signal processor sections, each of the processor sections including an operation processing section for receiving one or more parameters necessary for a predetermined operation so as to perform the desired operation on digital input data in accordance with the received parameters and a preset program, and a dual-port memory having write and read ports for storing operation result data output from the operation processing section, a parameter feeding section including a first bus connected to each of the digital signal processor sections so as to distributively feed, via the first bus, the parameters to predetermined one or more of the digital signal processor sections, and a data transfer section including a second bus connected to each of the digital signal processor sections so as to transfer, via the second bus, output data read out from the read port of the dual-port memory of each of the processor sections, wherein at least predetermined one of the digital signal processor sections receives the output data from another digital signal processor section via the second bus and performs the predetermined operation using the received data as the input data, and each of the digital signal processor sections is capable of operating at timing independent of that of the other digital signal processor sections by supplying, via the dual-port memory, the operation result data for use in the other digital signal processor sections.

The thus-arranged sound signal synthesis device and digital signal processing device according to the second and third aspects are similar to the first-aspect synthesis device in structure, operation and result.

Namely, similarly to the first-aspect digital signal processing device, the second-aspect sound signal synthesis device is characterized in that a plurality of operation processing sections are provided and a series of operations for synthesizing a sound signal is divided into a plurality of operation groups corresponding to the operation processing sections and simultaneously performed in the processing sections in a parallel fashion. Particularly, each of the processing sections is allowed to execute the allocated operations at its own time-divisional processing timing independently of the other processing section. With this feature, the time-divisional processing timing of each of the processing sections can be adjusted to differ from that of the other processing section, for example, in the light of the respective roles of the operations allocated to the individual processing sections. As a result, by appropriately controlling the time-divisional processing timing of the individual processing sections to be or not to be different from each other, the operation result of one digital signal processor section can be transferred to another digital signal processor section properly at optimum timing, which allows the operation processing as a whole to be carried out rapidly in a smooth manner.

Further, in the digital signal processing device according to the third aspect, each of the digital signal processor sections includes the operation processing section for receiving parameters necessary for the predetermined operation and performing the predetermined operation on digital input data in accordance with the received parameters and preset program, and the dual-port memory having write and read ports for storing the operation result output from the operation section. Because of this, data write and data readout to and from the dual-port memory in each of the processor sections can be controlled at timing independent of that of the other digital signal processor section. Consequently, when one of the digital signal processor sections (first digital signal processor section) receives and utilizes data output from the dual-port memory of another digital signal processor section (second digital signal processor section), the data readout operation can be controlled at independent timing of the first digital signal processor section separate from the write timing of the second digital signal processor section. Such an arrangement allows each of the processor sections to operate independently from the other processor section, and hence the processor sections can execute respective operation algorithms without being excessively constrained by each other.

A sound signal synthesis device according to a fourth aspect of the present invention comprises a sound signal generation section for generating separate sound signals in a plurality of channels on the basis of parameters supplied individually to the channels, a parameter supply section for supplying the parameters to each of the channels, the parameters to be supplied to each of the channels including tone generation instruction information and synchronized tone generation designating data specifying whether or not the channel should generate a sound in synchronism with any of the other channels, and a control section for, on the basis of the synchronized tone generation designating data supplied to each of the channels, controlling the sound signal generation section in such a manner that any of the channels designated for synchronized tone generation generates a sound signal in synchronism with predetermined one or more of the other channels.

Because in the fourth-aspect sound signal synthesis device, synchronized tone generation designating data specifying whether or not to generate a tone in synchronism with any of the other channels is given to each channel independently of the other channels, synchronized tone generation control is achieved in various combinations of the channels as desired. At that time, parameters other than those for the synchronized sound generation, such as sound color setting and controlling parameters, can be set optionally for each of the channels, and hence a single complex tone signal can be synthesized by combining sounds of different formant structure or different harmonic components in the designated channels. Thus, by only setting synchronized tone generation designating data optionally for each channel, tone signals having various combinations of different formant structures or different harmonic components can be synthesized, easily and with simple channel structure, through various combinations of designated channels.

A voice and tone synthesis device, i.e., sound synthesis device according to a fifth aspect of the present invention comprises a plurality of waveform generation sections receiving a sound generation start signal instructing a start of sound generation and pitch information so as to form a sound waveform on the basis of the pitch information in response to the sound generation start signal, a control means for supplying the sound generation start signal and pitch information to specific one of the waveform generation sections, and a transfer section for transferring the sound generation start signal and pitch information from the specific waveform generation section to another waveform generation section.

In the fifth-aspect synthesis device, because of the arrangement that the sound generation start signal and pitch information are transferred automatically via the transfer section from the specific waveform generation section to another waveform generation section, it is sufficient that the sound generation start signal and pitch information be supplied to only one of the waveform generation sections. This eliminates the need to simultaneously supply the sound generation start signal and pitch information to all of the waveform generation sections, and hence effectively facilitates control of sound generation.

For better understanding of various features of the present invention, the preferred embodiments of the invention will be described in detail hereinbelow with reference to the accompanying drawings.

BRIEF DESCRIPTION OF THE DRAWINGS

In the drawings:

FIG. 9 is a time chart illustrating exemplary operations performed at microprogram steps of the first digital signal processor in accordance with the formant sound synthesis method;

FIG. 11 is a time chart illustrating exemplary operations at microprogram steps of the third digital signal processor;

FIG. 13 is a time chart illustrating exemplary operations performed at microprogram steps of the fourth digital signal processor in accordance with the formant sound synthesis method;

FIG. 15 is a time chart illustrating exemplary operations performed at microprogram steps of the first digital signal processor in accordance with the FM synthesis method;

FIG. 16 is a time chart illustrating exemplary operations performed at microprogram steps of the fourth digital signal processor in accordance with the FM synthesis method;

DETAILED DESCRIPTION OF THE PREFERRED EMBODIMENTS

Figure 1:
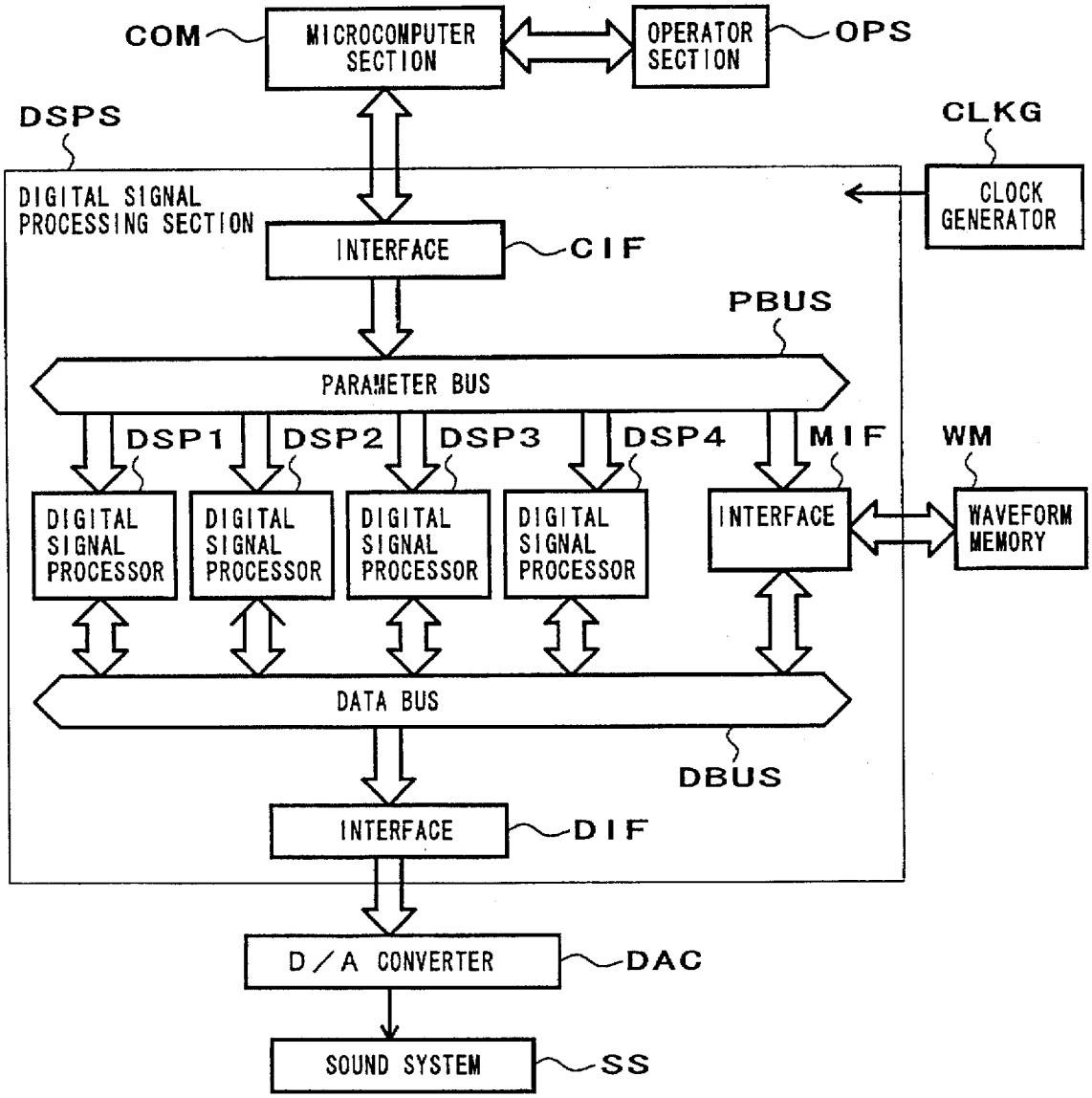
FIG. 1 is a block diagram illustrating the general hardware structure of an electronic musical instrument employing a digital signal processing device according to an embodiment of the present invention.

FIG. 1 is a block diagram illustrating the general hardware structure of an electronic musical instrument employing a digital signal processing device according to one embodiment of the present invention, in which a digital signal processing section DSPS includes four digital signal processors DSP1, DSP2, DSP3 and DSP4. These digital signal processors DSP1, DSP2, DSP3 and DSP4 are connected, via a parameter bus PBUS and a computer interface CIF, to a microcomputer section COM (comprising a CPU, a ROM and a RAM) of the electronic musical instrument in parallel relation to each other. On the basis of a player (or user)'s operation on an operator section OPS (comprising performance operators and panel operators), the microcomputer section COM provides the digital signal processors with various parameter data to be used in setting the pitch, color, volume etc. of each tone to be generated. These parameters are distributively fed to predetermined ones of digital signal processors DSP1–DSP4 via the computer interface CIF and parameter bus PBUS. Digital signal processors DSP1 to DSP4 are also interconnected via a data bus DBUS to exchange data therebetween. Further, digital signal processors DSP1 to DSP4 are connected to a data interface DIF serving as an output port and also connected to a digital-to-analog converter DAC via the data interface DIF. Synthesized tone waveform signal data is output from predetermined one of digital signal processors (first digital signal processor DSP1 in this embodiment) as an ultimate result of arithmetic operations. The synthesized tone waveform signal converted in analog form is audibly reproduced via a sound system SS.

Further, a waveform memory WM storing tone waveform data sampled from an external source by use of the PCM technique is connected to the individual digital signal processors DSP1 to DSP4 via interface MIF and data bus DBUS and is also connected to the microcomputer section COM via the interface MIF, parameter bus PBUS and interface CIF. A clock pulse generator CLKG generates and supplies system clock pulses to digital signal processors DSP1 to DSP4.

In the above-mentioned digital signal processing section DSPS, various arithmetic operations and other processing for synthesizing a digital tone waveform are divided or classified into a plurality of operation groups which are allocated to and performed by the digital signal processors DSP1 to DSP4. For instance, the first digital signal processor DSP1 is assigned to the operations for preparing progressive phase data for each of a plurality of (typically 18) tone generation channels (hereinafter referred to "phase operations") and also to operations for summing up tone waveform data generated in another digital signal processor (e.g., DSP4) for the individual channels (hereinafter referred to as "mixing operations"). The second digital signal processor DSP2 is assigned to the operations for preparing envelope data for each of the channels (hereinafter referred to as "envelope operations). The third digital signal processor DSP3 is assigned to the operations for making noise signals to be used in tone waveform generation in each of the channels (hereinafter referred to as "noise operations") and also the operations for reading out PCM waveform data (hereinafter referred to as "PCM operations"). The fourth digital signal processor DSP4 is assigned to the operations for generating a tone waveform signal for each of the channels by use of the phase data, envelope data and noise signal provided by the other digital signal processors DSP1, DSP2 and DSP3 (hereinafter referred to as "waveform generating operations").

Figure 2:
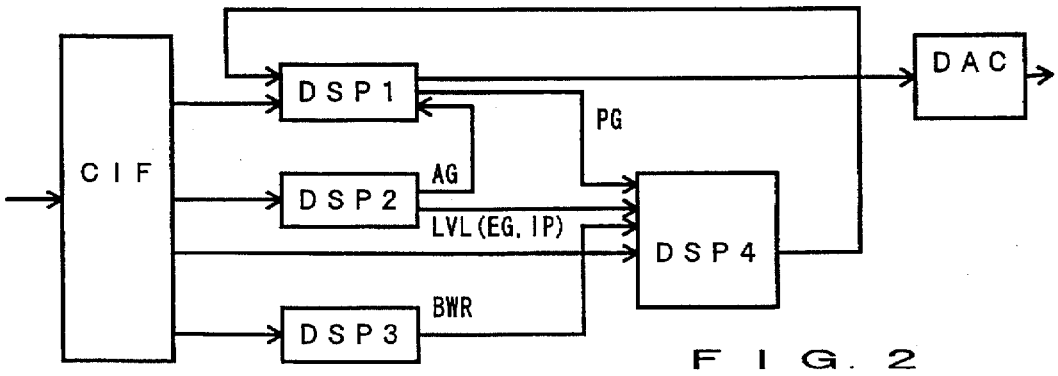
FIG. 2 is a functional block diagram illustrating flows of signals and information among a plurality of digital signal processors (DSPs) in the musical instrument of FIG. 1.
Figure 19:
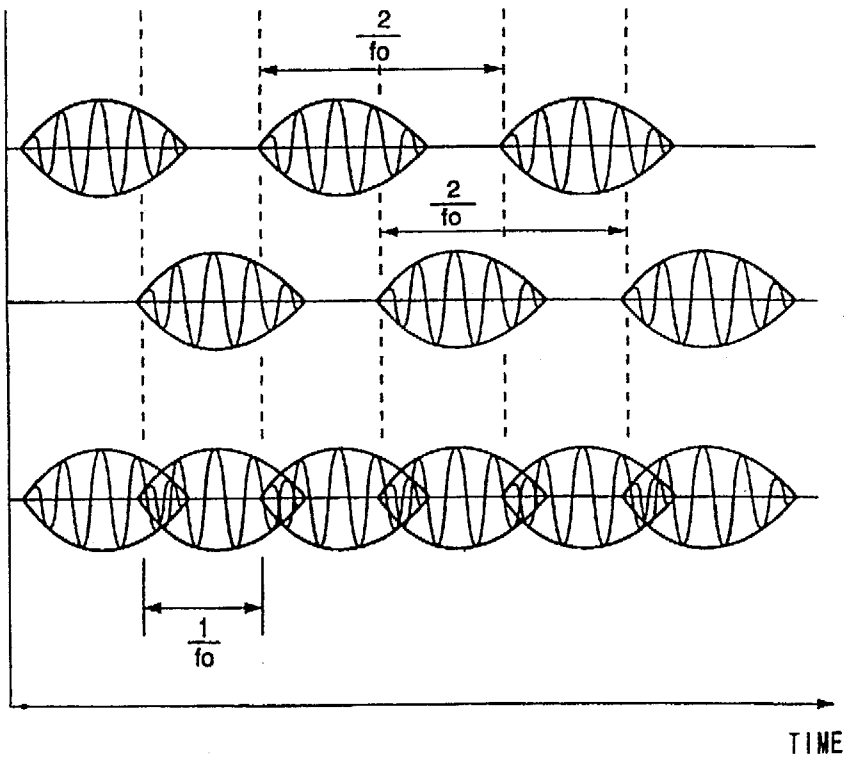
FIG. 19 is a list of various parameter data that are given from a microcomputer section of the electronic musical instrument to the individual digital signal processors.

FIG. 2 is a functional block diagram illustrating flows of information and signals among the digital signal processors DSP1 to DSP4 in the digital signal processing section DSPS of FIG. 1. The microcomputer section COM supplies the digital signal processors DSP1 to DSP4 with predetermined parameter data depending on the allocated operations, as enumerated in FIG. 19. An explanation will be made later as to which parameter data is supplied to which digital signal processor DSP1–DSP4.

More specifically, for each of the channels, the second digital signal processor DSP2 prepares envelope data on the basis of various envelope setting data supplied from the microcomputer section COM and sends the thus-prepared envelope data to the first and fourth digital signal processors DSP1 and DSP4 via the data bus DBUS. These envelope data includes amplitude-controlling envelope data EG and also pitch-controlling envelope data (e.g., attack glide data AG), waveform-interpolating coefficient data IP etc. whose values will progressively vary with time.

For each of the channels, the first digital signal processor DSP1 prepares progressive phase data PG corresponding to the pitch of tone to be generated, on the basis of pitch-setting and tone-color-setting parameter data supplied from the microcomputer section COM. The first digital signal processor DSP1 sends the thus-prepared progressive phase data PG to the fourth digital signal processor DSP4 via the data bus DBUS.

For each of the channels, the third digital signal processor DSP3 prepares a correlative noise signal BWR on the basis of the tone-color-setting parameter data supplied from the microcomputer section COM. This signal processor DSP3 sends the thus-prepared correlative noise signal to the fourth digital signal processor DSP4 via the data bus DBUS.

Further, for each of the channels, the fourth digital signal processor DSP4 generates tone waveform data having a predetermined pitch, color and volume by use of the tone-color- and volume-setting parameter data from the microcomputer section COM and the phase data PG, envelope data (tone volume level data LVL taking into account both the amplitude-controlling envelope data EG and the interpolating coefficient data IP) and correlative noise signal BWR. the fourth digital signal processor DSP4 sends the thus-prepared tone waveform data to the first digital signal processor DSP1 via the data bus DBUS. The first digital signal processor DSP1 sums up tone waveform data of all the channels supplied from the fourth digital signal processor DSP4 and sends the resultant summed tone waveform data to the digital-to-analog converter DAC via the data bus DBUS and interface DIF.

[Fundamental Structure of Digital Signal Processors]

Next, the fundamental hardware structure of each digital signal processor DSP1, DSP2, DSP3 and DSP4 will be described with reference to FIG. 3, where DSPn represents any one of the digital signal processors DSP1 to DSP4. A microprogram supply section 5 in the digital signal processor DSPn comprises a storage device which prestores microprograms describing the ones of the digital waveform synthesizing operations which are allocated to the digital signal processor DSPn. For example, in the microprogram supply section 5 of the first digital signal processor DSP1 are prestored microprograms for the above-mentioned phase and mixing operations; in the microprogram supply section 5 of the second digital signal processor DSP2 is prestored a microprogram for the above-mentioned envelope operations; in the microprogram supply section 5 of the third digital signal processor DSP3 are prestored microprograms for the above-mentioned noise and PCM operations, and in the microprogram supply section 5 of the fourth digital signal processor DSP4 is prestored a microprogram for the above-mentioned waveform generating operations.

It is to be noted that the present embodiment is capable of employing the formant sound synthesis and FM synthesis methods for tone waveform generating processing that do not use the external waveform memory WM. To this end, the microprogram supply section 5 of the first digital signal processor DSP1 contains two different sets of microprograms, one set for the formant sound synthesis and the other set for the FM synthesis. Similarly, the microprogram supply section 5 of the fourth digital signal processor DSP4 contains two different microprograms, one for the formant sound synthesis and the other for the FM synthesis. In contrast, the second digital signal processor DSP2 performing the envelope operations and third digital signal processor DSP3 performing the noise operations execute respective same microprograms irrespective of which of the two methods is used for the tone waveform synthesis, because the operational contents are common to the two methods.

A control signal generating section 6 fetches and decodes an instruction from the microprogram contained in the microprogram supply section 5 and generates a control signal based on the fetched instruction. The control signal generating section 6 in each of the digital signal processors DSP1 to DSP4 starts fetching and decoding the microprogram instruction, in response to a key-on signal contained in various parameters given via the bus PBUS. The key-on signal instructs a start of tone generation. The control signal generating section 6 in each of the digital signal processors DSP1 and DSP4 selects either the microprogram for the formant sound synthesis or the microprogram for the FM synthesis methods in response to a tone synthesizing algorithm designating parameter ALG contained in various parameters given via the bus PBUS, and modifies the selected microprogram in accordance with the designated tone synthesizing algorithm. Various control signals generated on the basis of the microprogram supplied from the supply section 5 are given to an arithmetic operation/storage section 7.

The arithmetic operation/storage section 7 performs various operations, such as arithmetic operations, data storage, selection, delay and data conversion, in accordance with various signals given from the control signal generating section 6. The arithmetic operation/storage section 7 includes an arithmetic unit (ALU) 8 for performing the four arithmetic operations and logical operations, and a dual-port random access memory RAMn. As mentioned earlier in relation to FIG. 2, various parameter data are supplied from the microcomputer section COM to the digital signal processors DSP1 to DSP4 via the parameter bus PBUS, and also each of the digital signal processors DSP1 and DSP4 may receive data from any of the other digital signal processors via the data bus DBUS. Such external data are input to the arithmetic unit 8 via data interface IF. Further, as shown in FIG. 3, the resultant operation output of the arithmetic unit 8 is fed back to the unit 8 itself via the data interface IF after being delayed or stored in the memory RAMn. In accordance with the control signal from the control signal generating section 6, the arithmetic unit 8 of each of the digital signal processors DSP1 to DSP4 executes the predetermined allocated operations using these data.

The dual-port random access memory RAMn has separate input and output data ports and thus is a random access memory capable of simultaneous performing read and write operations. In the figure, RAMn denotes any one of the dual-port random access memories RAM1, RAM2, RAM3, RAM 4 in the digital signal processors DSP1 to DSP4. Stored data in the dual-port random access memory RAMn (i.e., data indicative of the operation result output by the arithmetic unit 8 of the digital signal processor DSP concerned) is read out to be utilized in that digital signal processor DSP, sent to another digital signal processor DSP via the data bus DBUD or sent to the converter DAC. As previously mentioned, each of the digital signal processors DSP1 and DSP4 may be supplied with data from any of the other digital signal processors via the data bus DBUS. Line LX is therefore provided in each of the digital signal processors DSP1 and DSP 4 for receiving the data transferred from any of the other processors via the data bus DBUS.

FIGS. 4A to 4D show data storage maps of the dual-port random access memories in the individual digital signal processors DSP1 to DSP4.

Figure 4A:
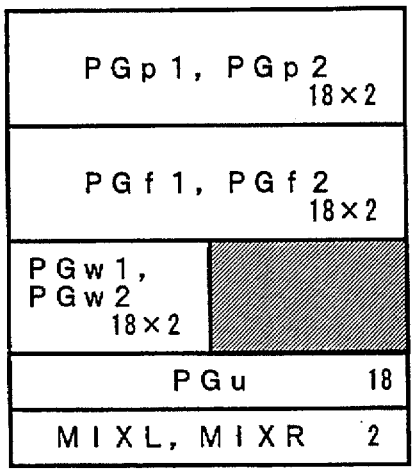
FIGS. 4A to 4D are diagrams illustrating exemplary memory maps of dual-port memories (RAM) contained in the individual digital signal processors of FIG. 1.

FIG. 4A shows the data storage map of the dual-port random access memory RAM1 in the first digital signal processor DSP1. This memory RAM1 contains two groups of 18-channel storage areas for storing two groups (first and second groups) of pitch phase data PGp1 and PGp2, respectively, which are to be used for formant sound synthesis, and also contains two groups of 18-channel storage areas for storing two groups (first and second groups) of center frequency phase data PGf1 and PGf2, respectively, which are to be used for formant sound synthesis. The pitch phase data PGp1 and PGp2 and center frequency phase data PGf1 and PGf2 each indicate a momentary phase (progressive phase) of a given waveform signal. Where the FM synthesis method is selected, the storage areas for the center frequency phase data PGf1 and PGf2 are also used as storage area for storing phase data generated from two (first and second) FM operators OP1 and OP2 as will be described later. In addition, the random access memory RAM1 includes two groups of 18-channel storage areas for storing two (first and second groups) of window function phase data PGw1 and PGw2, respectively, which are to be used for the formant sound synthesis, 18-channel storage areas for storing phase data PGu for noise signal, and storage areas for storing left- and right-channel tone waveform mix data MIXL and MIXR to be used for panning control. The tone waveform mix data MIXL and MIXR are obtained by mixing tone waveform data of the individual channels in correspondence with the left and right speakers.

Figure 4B:
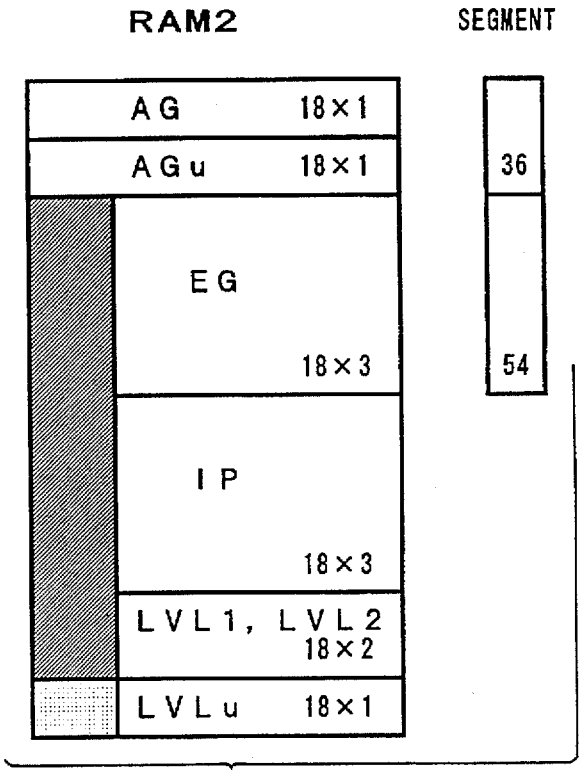

FIG. 4B shows the data storage map of the dual-port random access memory RAM2 in the second digital signal processor DSP2. This memory RAM2 contains 18-channel storage areas for storing attack glide data AG for normal tone waveform signal (i.e., data to control time-variation of pitch at the rise of a tone) and other 18-channel storage areas for storing attack glide data AGu to be used for noise formant tone synthesis. The attack glide data AG and AGu are pitch controlling envelope data. The memory RAM2 also includes three groups of 18-channel storage areas for storing three groups of envelope data EG, respectively, which are to be used for controlling time-variation of amplitude and other three groups of 18-channel storage areas for storing three groups of interpolation data IP, respectively, which are to be used as time-varying interpolation coefficients. In addition, the memory RAM2 includes two groups of 18-channel storage areas for storing two groups of tone volume level data LVL1 and LVL2, respectively, which are to be used for formant sound synthesis or FM synthesis, and 18-channel storage areas for storing tone volume level data LVLu to be used for noise formant sound synthesis, as well as storage areas for storing envelope waveform segments. Of the three groups of envelope data EG and interpolation data IP, one group is data for PCM operations and two groups are data for formant sound synthesis and FM synthesis. The tone volume level data LVL1, LVL2, LVLu are each a product of the envelope data EG and interpolation data IP. Whereas the tone volume level data LVL1, LVL2, LVLu are output from the second digital signal processor DSP2 to the processor DSP4, the envelope data EG and interpolation data IP are processed within the second digital signal processor DSP2 without being output to another digital signal processor DSP1, DSP3, DSP4.

Figure 4C:
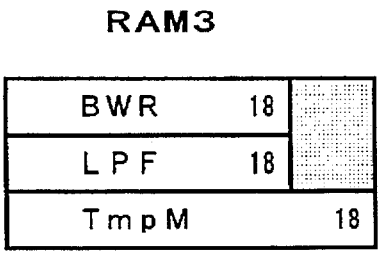

FIG. 4C shows the data storage map of the dual-port random access memory RAM3 in the third digital signal processor DSP3. This memory RAM3 includes 18-channel storage areas for storing data BWR each of which is obtained by adding a D.C. current component to a low-pass noise signal and limiting its bandwidth, (which data BWR is also called a correlative noise signal). The memory RAM3 includes 18-channel storage areas for storing data LPF (low-pass noise signal) and other 18-channel storage areas to be used as a working RAM during the operations.

Figure 4D:
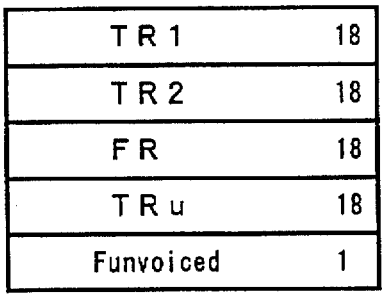

FIG. 4D shows the data storage map of the dual-port random access memory RAM4 in the fourth digital signal processor DSP4. This memory RAM4 includes 18-channel storage areas for storing first waveform data TR1, other 18-channel storage areas for storing second waveform data TR2, other 18-channel storage areas for storing feedback waveform data FR, and a storage area "Funvoiced" to be used as a working RAM in the course of the operations to acquire a noise waveform. In the formant sound synthesis, the storage areas for the first waveform data TR1 serve as storage areas for storing tone waveform data, but in the FM synthesis, they serve as storage areas for storing tone waveform data of the first FM operator OP1. In the formant sound synthesis, the storage areas for the second waveform data TR2 serve as storage areas for storing the sum of the first- and second-group tone waveform data or the second-group tone waveform data alone, but in the FM synthesis, they serve as storage areas for storing the sum of tone waveform data of the first and second FM operators OP1 and OP2 or tone waveform data of the second FM operator OP2 alone. The storage areas for the feedback waveform data FR store feedback waveform data to be used for self-feedback FM operations in the first FM operator OP1 in the FM synthesis mode.

[Detailed Hardware Structure of Individual Digital Signal Processors]

Now, the hardware structure of the respective arithmetic operation/storage sections 7 in the four digital signal processors DSP1 to DSP4 will be described in detail. Prior to the description, an explanation will be given about the fundamental structural features common to the respective arithmetic operation/storage sections 7 in the digital signal processors DSP1 to DSP4. As explained earlier in relation to FIGS. 2 and 3, each of the arithmetic operation/storage sections 7 is supplied with various parameter data from the microcomputer section COM, data from another digital signal processor, and data indicative of the operational result in the same digital signal processor. Each of the arithmetic operation/storage sections 7 is provided with a selector to selectively introduce data to be processed in the associated arithmetic unit 8. To the select control input of the selector is applied a control signal that is generated by the control signal generating section 6 on the basis of a microprogram contained in the microprogram supply section 5. Data thus selected by the selector in accordance with the control signal is applied to the associated arithmetic unit 8. Thus, in each of the digital signal processors DSP1 to DSP4, data stored in accordance with the processing sequence of the allocated processes are selected sequentially by the selector, and necessary operations are executed by the associated arithmetic unit 8.

First, the detailed hardware structure of the arithmetic operation/storage section 7 in the first digital signal processor DSP1 will be described with reference to FIG. 5. As previously mentioned, the first digital signal processor DSP1 performs the phase and mixing operations for digital waveform synthesis. The arithmetic operation/storage section 7 in the digital signal processor DSP1 is supplied with predetermined parameter data via the data bus PBUS, attack glide data AG, AGu for each channel read out from the dual-port random access memory RAM2 of the second digital signal processor 2, and also later-described tone waveform data for each channel read out from the dual-port random access memory RAM4 of the fourth digital signal processor DSP4. The parameter data to be supplied from the microcomputer section COM to the first digital signal processor DSP1 are as follows (see FIG. 19):

FNUM: Parameter designating a pitch frequency number;

RBP: Flag to simultaneously place selected adjoining channels in a key-on state at a same pitch;

RORM: Parameter designating a center frequency of a formant sound;

UFORM: Parameter designating a center frequency of an unvoiced formant sound (which may sometimes be called a noise formant sound);

VIB: Parameter designating ON/OFF of vibrato;

DVB: Parameter designating a depth and rate of vibrato;

FOM: Parameter designating ON/OFF of modulation of a center frequency of a formant sound;

DFM: Parameter designating a depth and rate of modulation of a center frequency of a formant sound;

UFOM: Parameter designating ON/OFF of modulation of a center frequency of an unvoiced formant sound;

UDFM: Parameter designating a depth and rate of modulation of a center frequency of an unvoiced formant sound;

URVF: Formant following control flag;

PAN: Parameter designating panning of a formant sound or FM sound:

BW: Parameter designating a bandwidth (window function time width) of a formant sound;

MULT1: Parameter designating a frequency multiplication factor in the formant sound synthesis or a frequency multiplication factor of the first FM operator OP1 in the FM synthesis, and MULT2: Parameter designating a frequency multiplication factor of the second FM operator OP2 in the FM synthesis.

The frequency setting parameters FNUM, FORM, UFORM are modulated by a modulating section 12 in accordance with modulating parameters VIB, DVB, FOM, DFM, UFOM, UDFM, converted into logarithmic form and then input to a selector 10. The selectors 10 and 11 select data to be processed in an arithmetic unit ALU1.

To the selector 10 are also input data #RAM4 read out from the random access memory RAM4 of the fourth digital signal processor DSP4 (among others, tone waveform data for each channel), data #REG1 from register REG1 contained in the first digital signal processor DSP1, and data #1 sent from the arithmetic unit ALU1 via delay circuits 18, 19 and output controller 20. In turn, the selector 10 selects one of the input data in accordance with the control signal that is generated by the control signal generating section 6 on the basis of a microprogram instruction contained in the microprogram supply section 5 corresponding to the processor DSP1. The thus-selected data is applied to the A input of the arithmetic unit ALU1 by way of a log/linear converter and shifter 14 and delay circuit 15.

To the selector 11 are input data #RAM2 read out from the memory RAM2 of the second digital signal processor DSP2 (among others, attack glide data AG, AGu), data #REG1 from the register REG1, data #RAM1 read out from any of the storage areas of the memory RAM1 in the first digital signal processor DSP1 and data "0". In turn, the selector 11 selects one of the input data in accordance with the control signal generated by the control signal generating section 6. The thus-selected data is applied to the B input of the arithmetic unit ALU1 by way of a log/linear converter and shifter 16 and delay circuit 17.

Under the control of a controller 23, the log/linear converter and shifter 14 performs log/linear conversion or shifting on the selected data, and the log/linear converter and shifter 16 performs either one of log/linear conversion, shifting and positive/negative sign inversion or all of log/linear conversion, shifting and positive/negative sign inversion. The panning control parameter PAN is input to a pan table 21, which in turn outputs left- and right-channel tone volume level control data for controlling the respective levels of tone volume output through the left and right speakers of the sound system SS. The left- and right-channel tone volume level control data and the formant bandwidth designating parameter BW or frequency multiplication designating parameter MULT1 or MULT2 are selected by a selector 22 to be sent to the controller 23. In accordance with the selected data and the control signal from the control signal generating section 6 of the processor DSP1, the controller 23 controls the operation of the log/linear converter and shifters 14 and 16.

Essentially, the arithmetic unit ALU1 adds together data applied to the A and B inputs thereof. As previously mentioned, the added result of the arithmetic unit ALU1 is sent as data #1 to the selector 10 by way of the delay circuits 18, 19 and output controller 20. The added result is also stored into the register REG1 and written into the memory RAM1 via a delay circuit 24 in accordance with the control signal from the generating section 6.

In accordance with the control signal from the generating section 6 of the first digital signal processor DSP1, the output controller 20 controls the overflow of a calculated output of the arithmetic unit ALU1 and also supplies initial setting values to initialize corresponding phase data values in the memory RAM1 in starting tone generation. Further, as will be described later, when the pitch frequency phase data PGp1, PGp2 overflow, the output controller 20 sets the formant center frequency phase data PGf1, PGf2 and window function phase data PGw1, PGw2 of the corresponding group to predetermined reset values.

The stored data in the register REG1 is sent to the selectors 10 and 11. The data written in the memory RAM1 is read out in accordance with the control signal from the generating section 6 of the first digital signal processor DSP1 and then again fed to the selector 11 by way of a delay circuit 25, as mentioned earlier. The phase data for each channel written in the memory RAM1 is read out, as necessary, in accordance with the control signal from the generating section 6 of the fourth digital signal processor DSP4 and then fed to the arithmetic operation/storage section 7 of the fourth digital signal processor DSP4 by way of the delay circuit 25. Further, the sum of the tone waveform data of each channel stored in the memory RAM1 is sent to the converter DAC (FIG. 1) by way of the delay circuit 25 and an overflow controller (not shown). The overflow controller controls the overflow of the sum of the tone waveform data of each channel read out from the memory RAM1. The delay circuits 15, 17, 18, 19, 24, 25 function to delay the respective data by a time D corresponding to one clock pulse.

The second digital signal processor DSP2, which is assigned to the operations for preparing envelope data, operates in a manner similar to a conventional envelope generator to thereby prepare attack glide data AG, AGu, level data LVL1, LVL2, LVLu, etc. and send the data to the data bus DBUS at necessary timing. Therefore, the hardware structure of the arithmetic operation/storage section 7 of digital signal processor DSP2 will not be described in detail here in this specification.

Next, the detailed hardware structure of the arithmetic operation/storage section 7 in the third digital signal processor DSP3 will be described with reference to FIG. 6. This digital signal processor DSP3 is supplied, via the parameter bus PBUS, with parameter NBW designating a noise bandwidth, parameter NRES designating a sharpness of noise spectrum and parameter NSKT designating a flaring shape of the skirt portion of noise spectrum, as parameter data for forming a noise signal.

To a selector 30 of the arithmetic operation/storage section 7 are supplied the above-mentioned parameters NBW and NRES, calculated output data #3 sent from an arithmetic unit ALU3 by way of a delay circuit 37, overflow/underflow controller (OF/UF) 38 and shifter 39, and a white noise signal generated from a white noise generating circuit 32. Any one of these supplied data is selected by the selector 30 in accordance with the control signal from the control signal generating section 6 of the digital signal processor 3. The thus-selected data is fed to the A input of the arithmetic unit ALU3 by way of a delay circuit 33.

To a selector 31 of the arithmetic operation/storage section 7 are supplied data #RAM3 output from the memory RAM3 and data #REG3 output from register REG3, so that the selector 31 selects predetermined one of the supplied data in accordance with a control signal based on a microprogram instruction. Data "±" indicating a positive or negative sign is added to the uppermost bit of the thus-selected data, and then the selected data is fed to the B input of the arithmetic unit ALU3 by way of a gate circuit 34 and delay circuit 35. A parallel/serial converter 36 converts data #AREG output from register AREG into serial form. The gate circuit 34 and parallel/serial converter 36 are provided to calculate a partial product for serial multiplication.

The arithmetic unit ALU3 adds together the data fed to the A and B inputs. The added result is supplied to the selector 30 as the data #3 passed through the delay circuit 37, overflow/underflow controller 38 and shifter 39. The added result is also stored into the registers REG3, AREG and written into the memory RAM3 via a delay circuit 40 in accordance with the control signal from the generating section 6.

The overflow/underflow controller 38 controls an overflow or underflow in the calculated result of the arithmetic unit ALU3 to thereby control the effective bits of the calculation. The shifter 39 performs data shifting in the serial multiplication, or data shifting in accordance with a predetermined coefficient parameter such as the noise spectrum skirt parameter NSKT or interpolation coefficient parameter IP.

The registers REG3 and AREG are capable of either latching the supplied data or passing the data therethrough unlatched, in accordance with a control signal. It is assumed that the register AREG presents no time difference between its data write and read timing to and from the register AREG.

The data written in the memory RAM3 is read out therefrom in accordance with the control signal generating section 6 of the third digital signal processor DSP3, and is then supplied as the data #RAM3 to the selector 31 via a delay circuit 41. The data written in the memory RAM3 can also be read out therefrom in accordance with the control signal generating section 6 of the fourth digital signal processor DSP4, in which case the data is sent via the delay circuit 41 to a linear/log converter 42 to be converted into a logarithmic value and then sent as data #RAM3L to the digital signal processor DSP4 by way of a delay circuit 43.

The delay circuits 33, 35, 37, 40, 41 function to delay the respective input data by a time D corresponding to one clock pulse, and the delay circuit 43 functions to delay the input data by a time 3D corresponding to three clock pulses.

Next, the detailed hardware structure of the arithmetic operation/storage section 7 in the fourth digital signal processor DSP4 will be described with reference to FIG. 7. This digital signal processor DSP4 is supplied, via the parameter bus PBUS, with parameter RHY designating ON or OFF of a rhythm sound generating mode, parameter WF1 designating a fundamental waveform of a periodic function in the formant sound synthesis or a fundamental waveform of the first FM operator OP1 in the FM synthesis, parameter WF2 designating a fundamental waveform of the second FM operator OP2 in the FM synthesis, parameter FBL setting a self-feedback level in the FM synthesis, and parameter SKT setting a skirt portion characteristic of a formant sound (see FIG. 19).

To a selector 50 of the arithmetic operation/storage section 7 are supplied the calculated output data #4 sent from an arithmetic unit ALU4 by way of a delay circuit 55 and overflow/underflow controller (OF/UF) 56, data #RAM2 read from the memory RAM2 of the second digital signal processor DSP2 (level data LVL1, LVL2, LVLu of each channel), and data #RAM1 read from the memory RAM1 of the first digital signal processor DSP1 (phase data PGp1, PGp2, PGf1, PGf2, PGw1, PGw2, PGu of each channel) passed through a rhythm sound generator 52. The rhythm sound generator 52 disturbs these input data to create phase data of a rhythm sound, in accordance with parameter RHY supplied via the parameter bus PBUS. Any one of these data is selected by the selector 50 in accordance with the control signal from the control signal generating section 6 of the digital signal processor DSP4. The thus-selected data is fed to the A input of the arithmetic unit ALU4 by way of a delay circuit 53.

To a selector 51 of the arithmetic operation/storage section 7 are supplied data #RAM4 output from the memory RAM4, data #REG4 output from register REG4 and the above-mentioned data #RAM3 read out from the third digital signal processor DSP3, so that the selector 51 selects predetermined one of the supplied data in accordance with the control signal from the control signal generating section 6 of the fourth digital signal processor DSP4. The thus-selected data is fed to the B input of the arithmetic unit ALU4 by way of a delay circuit 54.

The arithmetic unit ALU4 adds together the data fed to the A and B inputs. The added result is supplied to the selector 50 as the data #4 through the delay circuit 55 and overflow/underflow controller 56, and is also fed to a selector 64 by way of the following paths. Namely, in one of the paths, the data #4 is sent via a delay circuit 57 to a log/linear converter 58 to be converted into an antilogarithm, and is then applied to input $\alpha$ of a selector 64. In another path, the data #4 is sent via a delay circuit 61 to a log/sine table 62 to be converted into sine waveform data of the logarithm and is then applied to input $\beta$ of the selector 64 via a delay circuit 63. In the other path, the data #4 is applied directly to input $\gamma$ of the selector 64.

The overflow/underflow controller 56 controls an overflow or underflow (i.e., effective bits) in the calculated result of the arithmetic unit ALU4 to thereby control the effective bits of the calculation. A waveform shifter 60, in accordance with fundamental waveform designating parameters WF1 and WF2, performs a changing process to shift the phase value of input phase data or set the phase value to zero for a specific portion. Such a changing process may essentially be conducted, for example, by use of a method disclosed by the same assignee in Japanese Patent Publication No. HEI 6-44193. When a formant sound window function is to be generated, this waveform shifter 60 down (right)-shifts the phase value of the input phase data by one bit (i.e., reduces the phase value by half). Thus, with the down-shifted phase data, a first-half cycle of the sine waveform is read out from the log/sine table 62 with respect to one pitch cycle of the input phase data.

The output of the selector 64 is input to a shifter and log/linear converter 65, which shifts or log/linear converts the input data in response to a control signal. Via the parameter bus PBUS, FM feedback level parameter FBL or formant sound skirt characteristic designating parameter SKT is supplied to a controller 66. The controller 66 gives the shifter and log/linear converter 65 shift amount designating data in accordance with the supplied parameter. The parameter SKT is supplied to the controller 66 after being up (left)-shifted (i.e., after the parameter value being doubled) so that when generating a formant sound window function waveform, the shifter and log/linear converter 65 outputs a waveform of sine wave raised to the power of "2×SKT". For instance, where SKT=1, the sine waveform data in logarithmic form comprised of the first-half sine wave is multiplied by "2" by up-shifting the input data by one bit, so as to generate waveform data which will provide a waveform corresponding to a function value of the second power of sine when converted into an antilogarithm. The waveform corresponding to a function value of the second power of sine will provide an extended skirt of the half wave portion of the sine wave and will be suitable as a window function.

The output data of the shifter and log/linear converter 65 is temporarily stored into register REG4 or written into the memory RAM4 by way of a delay circuit 67, in response to the control signal from the control signal generating section 6. The register REG4 is a shift register whose output data #REG4 is fed to the selector 51.

In response to the control signal from the control signal generating section 6 of the fourth digital signal processor DSP4, the written data in the memory RAM4 is read out therefrom and then sent as data #RAM4 to the selector 51 by way of a delay circuit 68. Also, the written data in the memory RAM4 is read out therefrom and then sent to the first digital signal processor DSP1 by way of the delay circuit 68, in response to the control signal from the control signal generating section 6 of the digital signal processor DSP1.

[Tone Synthesis by Cooperation of Digital Signal Processors]

Next, a description will be made about a manner in which a tone waveform is synthesized by the above-mentioned digital signal processors DSP1 to DSP4 in the digital signal processing section DSP performing the respective operations in a parallel fashion.

Figure 8:
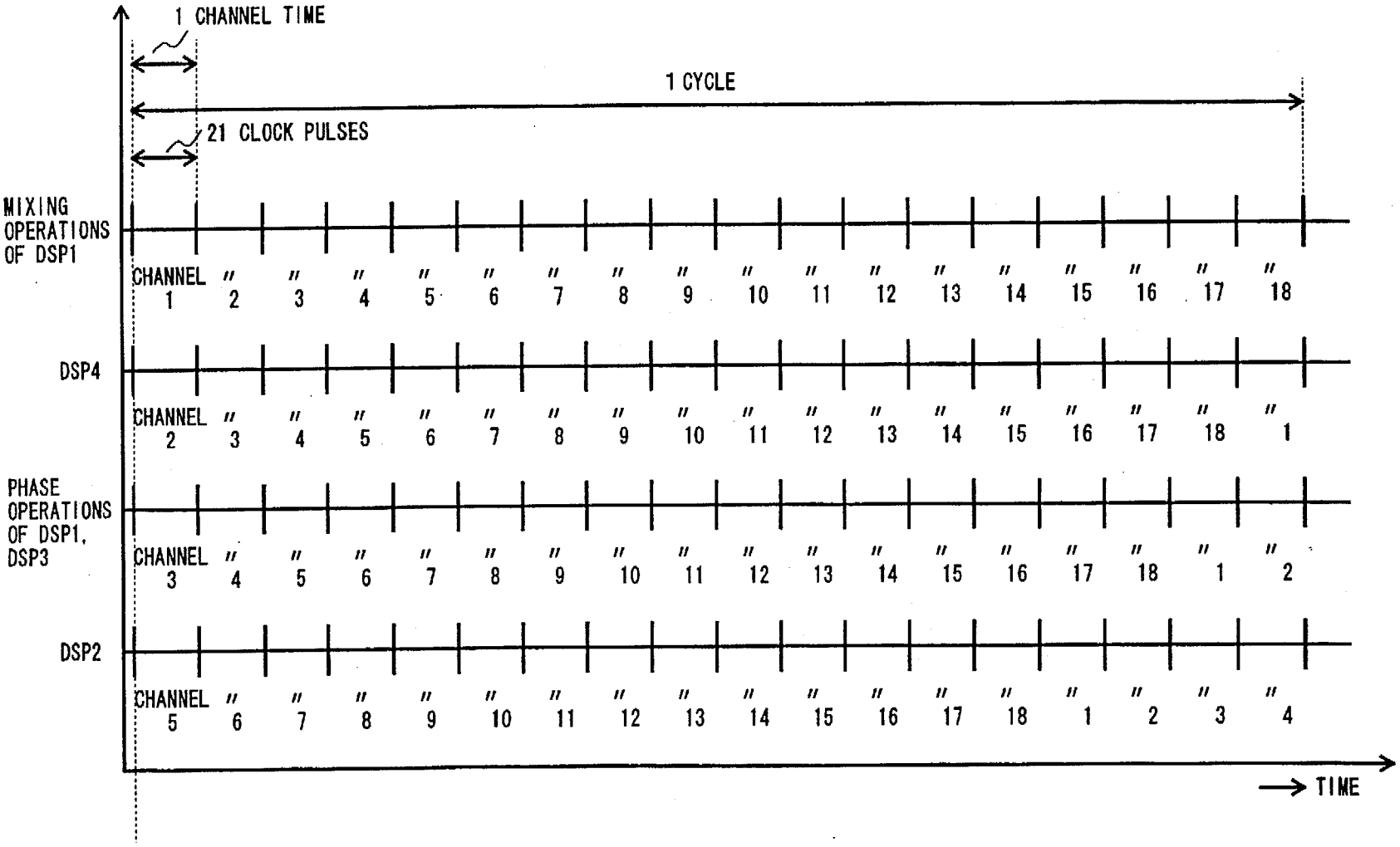
FIG. 8 is a time chart illustrating the operational relationships among time-divisional channel processing in the individual digital signal processors.

FIG. 8 is a time chart illustrating the respective time-divisional channel timing of the individual digital signal processors DSP1 to DSP DSP4. In the figure, numerical values "1" to "18" denote time-divisional timing of channels 1 to 18. As shown, each of the digital signal processors DSP1 to DSP4 executes the operations of the individual channels, while sequentially switching one channel to another every time 21 system clock pulses are given. Namely, one cycle of the time-divisional 18-channel operations in each of the digital signal processors is equivalent to a time over which 378 (21×18) clock pulses are given.

The digital signal processors DSP1 to DSP4 execute each channel operations at different timing. Namely, as shown in the figure, when the second digital signal processor DSP2 performs the envelope operations of a specific channel (e.g., channel 1), the first and third digital signal processors DSP1 and DSP3 perform the phase operations and noise operations, respectively, of channel 1 at timing a two-channel time (i.e., 42 clock pulses) after the envelope operations timing, the fourth digital signal processor DSP4 performs the waveform generation operations of channel 1 at timing a one-channel time (21 clock pulses) after the phase and noise operations timing, and then the first digital signal processor DSP1 performs the mixing operations of channel 1 at timing a one-channel time (21 clock pulses) after the waveform generation operation timing.

Thus, when envelope data of a specific channel is prepared in the second digital signal processor DSP2, phase data and noise signal of that channel are prepared in the first and third digital signal processors DSP1 and DSP3 by use of the envelope data at timing that is later than the envelope data preparation timing by a two-channel time. Further, at timing later than the phase data and noise signal preparation timing by a one-channel time, the fourth digital signal processor DSP4 prepares tone waveform data of that channel by use of the envelope data, phase data and noise signal. Then, at timing later than the tone waveform data preparation timing by a one-channel time, the first digital signal processor DSP1 adds together the tone waveform data of the specific channel and those of the other channels.

By thus causing the digital signal processors to perform the respective operations in a parallel fashion and at different channel timing in accordance with the respective programmed procedures, the tone waveform data can be prepared at an even faster speed.

Figure 10:
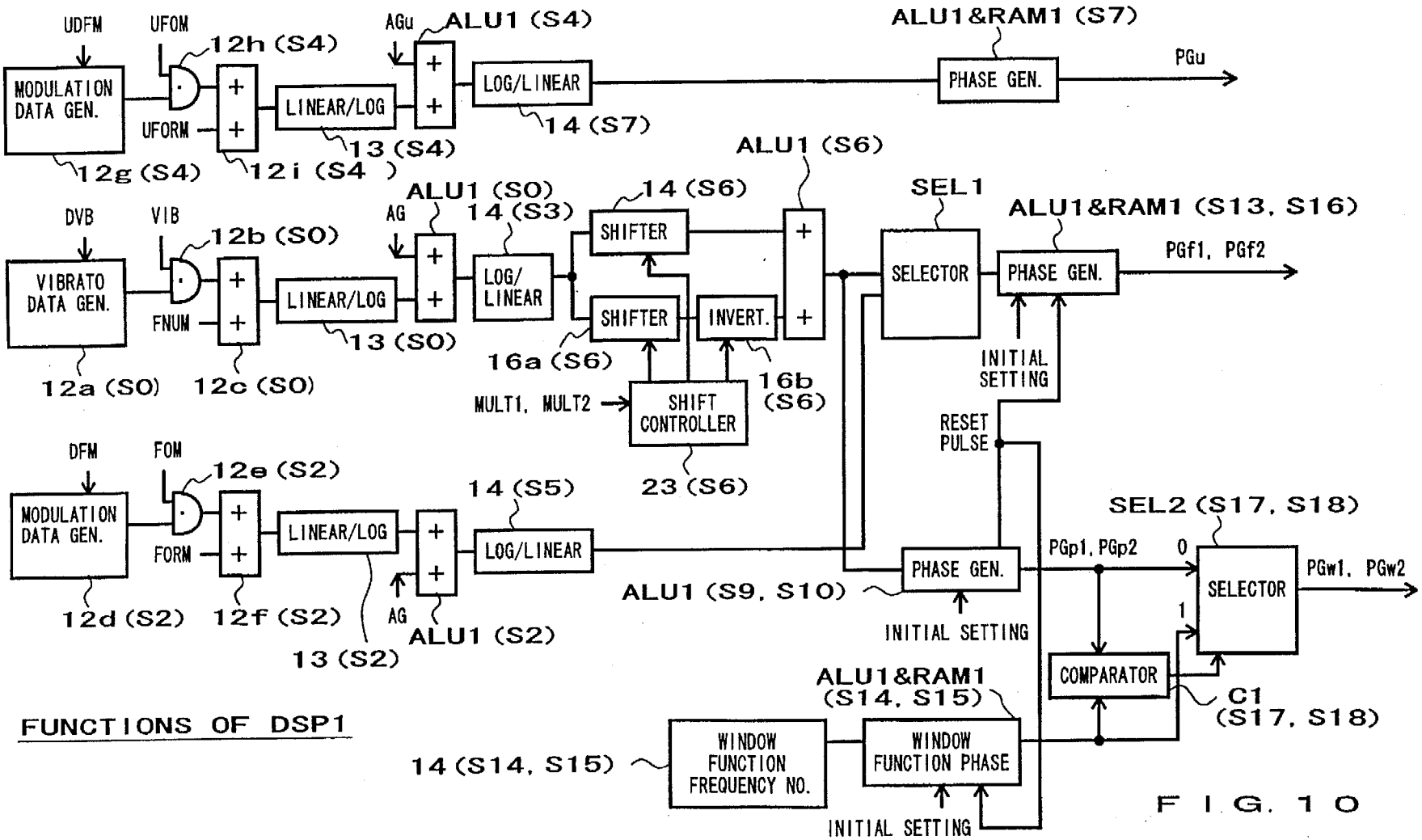
FIG. 10 is a combined functional block diagram illustrating the detail of arithmetic operations performed by the first digital signal processor.
Figure 12:
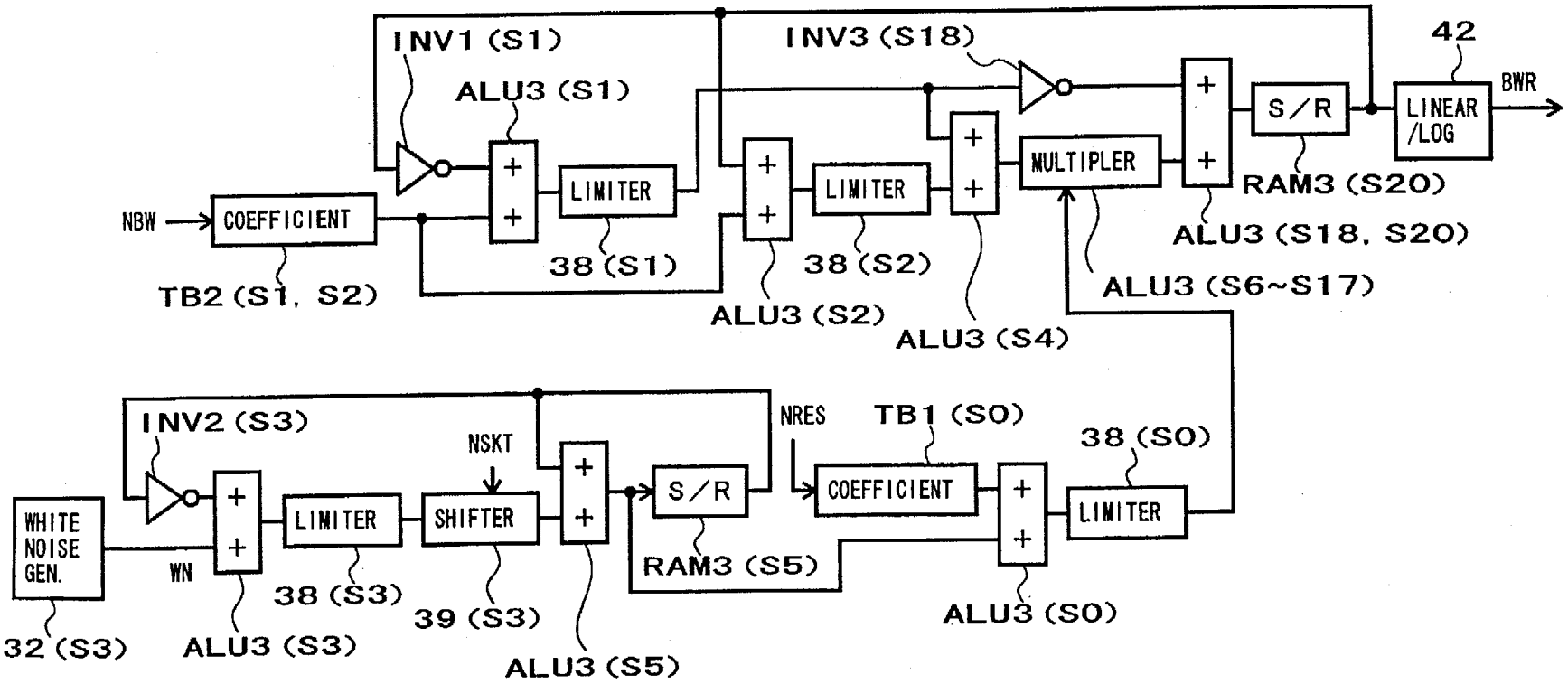
FIG. 12 is a combined functional block diagram illustrating the detail of arithmetic operations performed by the third digital signal processor.
Figure 14:
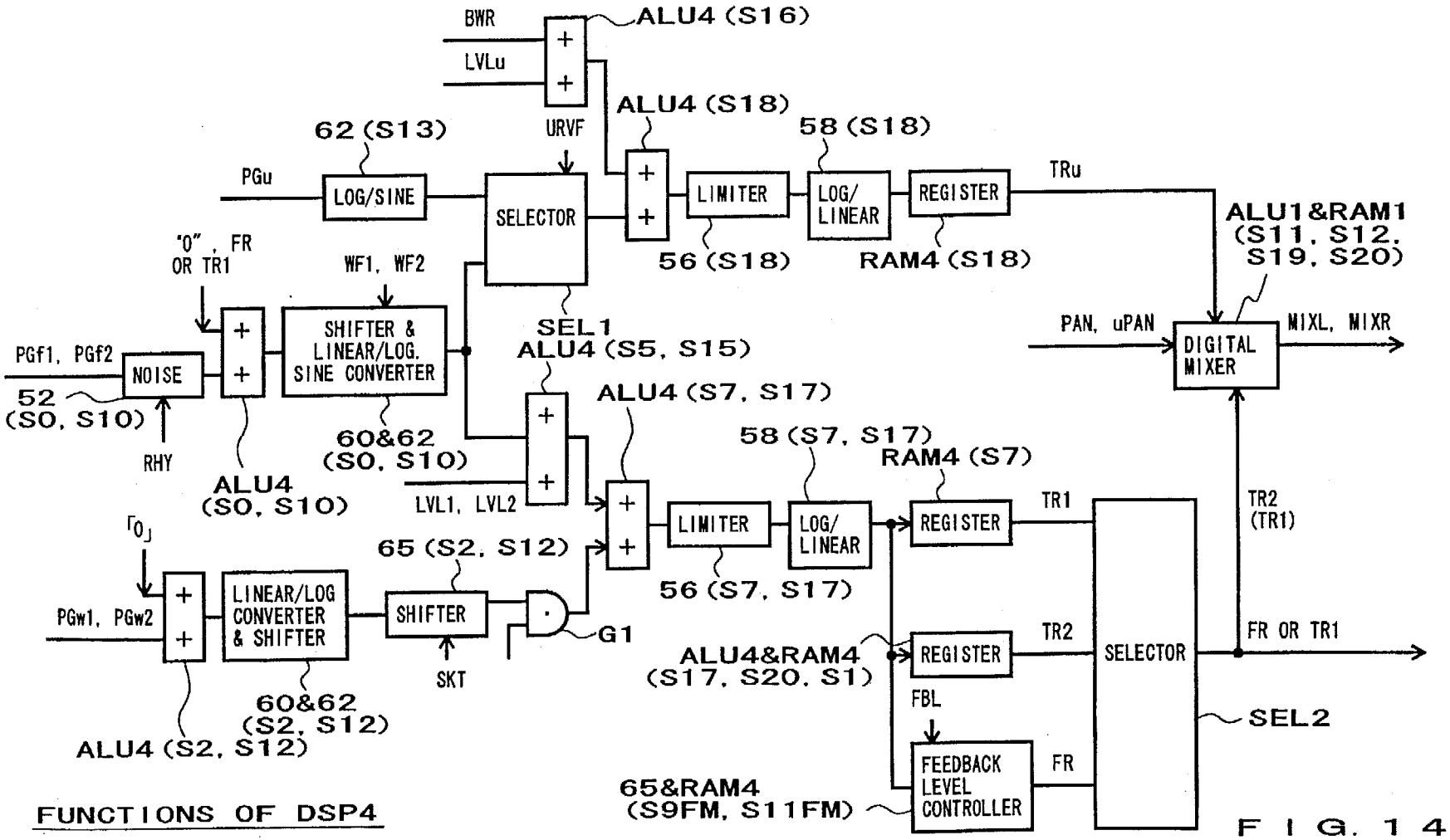
FIG. 14 is a combined functional block diagram illustrating the detail of arithmetic operations performed by the formant sound synthesis method.

Next, a description will be made about a manner in which a tone waveform is synthesized by the cooperation of the digital signal processors DSP1 to DSP4 on the assumption that the processors DSP1 to DSP4 operate at the time-divisional channel timing as shown in FIG. 8. FIGS. 10, 12 and 14 are combined functional block diagrams showing various circuit elements of the digital signal processors DSP1 to DSP4 as combined in accordance with the programmed processing flows and illustrating how the processors DSP1 to DSP4 are functionally related to each other for necessary cooperative operations. For convenience of description, the circuit elements of the second digital signal processor DSP2 are not shown in FIGS. 10, 12 and 14.

First, a description will be made about a manner in which a tone waveform is synthesized in accordance with the formant sound synthesis method on the basis of the cooperation of the digital signal processors DSP1 to DSP4, in relation to a case where two formant sound waveforms are obtained on the basis of two groups of the pitch frequency phase data and formant center frequency phase data and these formant sound waveforms are then added together to form a final formant sound waveform. In order to synthesize two (or more) formant sound waveforms on the basis of two (or more) groups of the pitch frequency phase data and formant center frequency phase data and add these formant sound waveforms to form a final formant sound waveform as mentioned above, there may be employed a known technique as disclosed by the same assignee in Japanese Patent Laid-open Publication No. HEI 2-254497.

That the digital signal processors DSP1 to DSP4 should perform the necessary operations in the formant sound synthesis mode is instructed by a value of tone synthesizing algorithm parameter ALG which is given in response to the user's sound color selection or the like via the operator section OPS (FIG. 1) or any other suitable means. For example, when the algorithm parameter ALG is of value "0", it indicates that the necessary operations should be performed in the formant sound synthesis mode.

Exemplary Operations of Digital Signal Processor DSP1 for Formant Sound Synthesis FIG. 9 is a time chart illustrating exemplary operations at various steps of the phase and mixing operations performed by the first digital signal processor DSP1 in accordance with the formant sound synthesis. One cycle of the microprogram comprises 21 steps, i.e., steps S0 to S20, and one step corresponds to one cycle of the system clock. One cycle of the microprogram corresponds to one channel timing of FIG. 8, and the program is executed for the 18 channels time-divisionally as shown in FIG. 8. Steps S0 to S10 and S13 to S18 are directed to the phase operations, and steps S11, S12, S19 and S20 are directed to the phase operations. In FIG. 9, item (a) indicates data set to be fed to the A input of the arithmetic unit ALU1, item (b) indicates data set to be fed to the B input of the arithmetic unit ALU1, item (c) indicates the contents of the data #1, item (d) indicates the contents of data to be written into the register REG1, and item (e) indicates the contents of data to written into the memory RAM1. FIG. 10 is a combined functional block diagram illustrating a manner in which the first digital signal processor DSP1 prepares phase data, rather than the actual hardware circuit structure.

(1) Operations of Digital Signal Processor DSP1 at Step S0

Figure 5:
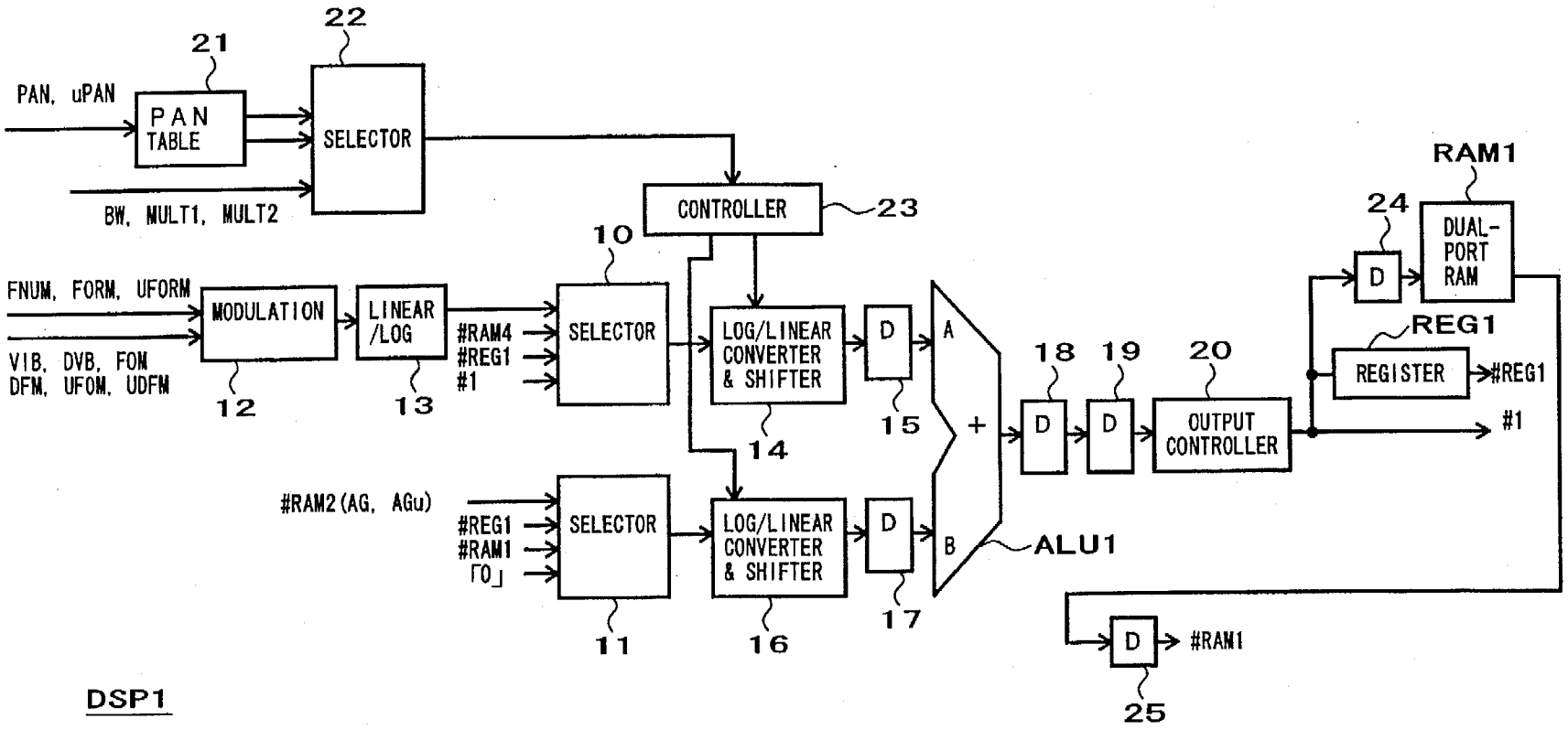
FIG. 5 is a block diagram illustrating the general hardware structure of the first digital signal processor (DSP1) shown in FIG. 1.

At step S0, operations are performed, by means of the arithmetic unit ALU1 of FIG. 5, to modulate the value of the pitch frequency number FNUM for use in preparing two groups of the pitch frequency phase data PGp1 and PGp2.

Items (a) and (b) of FIG. 9 indicate, in a simplified form, data to be fed to the A input and B input of the arithmetic unit ALU1; at step S0, phase increment value data corresponding to the pitch frequency number FNUM is set to be fed to the A input of the arithmetic unit ALU1, and attack glide data AG is set to be fed to the B input of the arithmetic unit ALU1. Reference characters "n or n−1" parenthesized below "FNUM" in item (a) will be explained later.

More specifically, in the example of FIG. 5, pitch frequency number FNUM and vibrato parameters VIB and DVB are given to the modulating section 12, and the selector 10 is caused to select the output data of the linear/log converter 13. The linear/log converter 13 outputs data which is a logarithmic value converted from the pitch frequency number FNUM having undergone vibrato modulation control. This output data is selected by the selector 10 and then fed to the A input of the arithmetic unit ALU1 by way of the log/linear converter and shifter 14 and delay circuit 15. At this step S0, the controller 23 controls the log/linear converter and shifters 14 and 16 not to perform any conversion or shifting, so that the input data is allowed to pass therethrough unprocessed.

Meanwhile, at predetermined timing, attack glide data AG of the current channel in logarithmic form is read out from the memory RAM2. The read-out data AG is sent as data #RAM2 to the first digital signal processor DSP1 by way of the data bus DBUS and fed to the selector 11. The selector 11 selects the data #RAM2, i.e., attack glide data AG, which is then fed to the B input of the arithmetic unit ALU1 by way of the log/linear converter and shifter 16 and delay circuit 17.

Thus, the vibrato-controlled pitch frequency number FNUM in logarithmic form and attack glide data AG are added together by the arithmetic unit ALU1. Because addition of logarithmic values corresponds to multiplication of the antilogarithms (i.e., linear values) of the logarithmic values as well known in the art, the above-mentioned operation is equivalent, from the antilogarithmic viewpoint, to an arithmetic operation for performing attack glide modulation by multiplying the vibrato-controlled pitch frequency number FNUM by the attack glide data AG.

In this manner, step S0 executes an operation to modulate the value of the pitch frequency number FNUM and provides the resultant modulated pitch frequency number FNUM as a logarithmic value. The thus-modulated pitch frequency number FNUM is delayed through the delay circuits 15, 17, 18 and 19 by a total delay time corresponding to three clock pulses and then output through the output controller 20 as data #1 at the timing of subsequent step S3 which will be described in detail later.

The above-mentioned operations are summarized with reference to the combined functional block diagram of FIG. 10, where the circuit elements with the same initial letters as those of FIG. 5 denote the same or corresponding circuit elements of FIG. 5. Further, a step number parenthesized at the end of each circuit element in FIG. 10 indicates that the circuit element becomes operative at that step. For instance, "ALU1(S0)" signifies the arithmetic unit ALU1 which becomes operative at step S0. Thus, for understanding the operations at step S0, attention should be paid the circuit route noted with "S0" in FIG. 10. Similar notation is applied to FIGS. 12 and 14 which will be described later.

In FIG. 10, a vibrato data generator 12*a*(S0), AND gate 12*b*(S0) and adder 12*c*(S0) together correspond to the modulating section 12 of FIG. 5. Periodic vibrato data having a depth and rate corresponding to the vibrato depth and rate designating parameter DVB is generated by the vibrato data generator 12*a*(S0) and sent to the AND gate 12*b*(S0). The AND gate 12*b*(S0) is enabled when the vibrato on/off parameter VIB instructs vibrato ON (start of vibrato performance), to output the periodic vibrato data. The vibrato data output from the AND gate 12*b*(S0) is added to the pitch frequency number FNUM by the adder 12*c*(S0) so as to output data having been derived from the vibrato control of the pitch frequency number FNUM. The output data of the adder 12*c*(S0) is converted into a logarithmic value by the linear/log converter 13(S0), which is then added to the attack glide data AG by the arithmetic unit ALU1(S0).

Description about Channel Synchronization

In connection with the modulation of the pitch frequency number FNUM executed at step S0 as mentioned above, a description will be made about channel synchronization operation.

The channel synchronization operation is directed to automatic, simultaneous control of generation of same-pitch tones in two or more adjoining tone generating channels. For this purpose, a channel synchronization flag RBP is provided for each of the channels. For example, where the flag RBP for channel 1 is at a value of "0" and the flags for adjoining channel 2 and channel 3 are at "1", channel 2 and channel 3 are controlled to automatically generate tones of same pitch as allocated to channel 1 at same key-on timing (tone generation timing) as in channel 1. Data to be set to the channel synchronization flags RBP are given from the microcomputer section COM to the individual channels, e. g., in response to the user's sound color setting operation or the like on the operator section OPS.

Thus, at step S0, if the channel synchronization flag RBP of a tone generating channel being currently processed (referred to as "current channel n") is at "0", pitch frequency number FNUMn indicative of the pitch of the tone allocated to the current channel n is given as the pitch frequency number FNUM to be fed to the modulating section 12. In such a case, various operation related to key-on/key-off, including envelope generation in the second digital signal processor DSP2, are performed on the basis of a key-on signal KON (i.e., KONn) of the tone allocated to the current channel n.

Conversely, if the channel synchronization flag RBP of the current channel n is at "1", pitch frequency number FNUMn-1 indicative of the pitch of the tone allocated to a channel n-1 immediately preceding the channel e.g., if n=2, - equals 1) n is given as the pitch frequency number FNUM to be fed to the modulating section 12. In such a case, various key-on/key-off related processes including envelope generation in DSP2 are performed on the basis of a key-on signal of the tone allocated to the channel n-1.

It is assumed here that the smallest channel number is 1, and if n=1, pitch frequency number FNUMn and key-on signal KON (i.e., KONn) for that channel are used irrespective of the channel synchronization flag RBP for that channel.

Therefore, if the flag RBP is at "1", adjoining channels n and n-1 are synchronized to generate tone at same pitch and timing (if the flag RBP for the channel n-1, every adjoining channels from the channel n to a smallest-channel-number channel having the flag RBP at "0" are synchronized). For example, where the flags RBP for channel 1 to channel 18 are at "0", "1", "1", "1", "0", "1", "1", "1", "0", "1", "1", "1", "1", "0", "0", "1", "0" and "0", respectively, channel 1 to channel 4 all perform tone waveform synthesis at a same pitch and same key-on timing as allocated to channel 1; channel 5 to channel 8 all perform tone waveform synthesis at a same pitch and same key-on timing as allocated channel 5; channel 9 to channel 13 all perform tone waveform synthesis at a same pitch and same key-on timing as allocated to channel 9; channel 14 independently performs tone waveform synthesis at a pitch and key-on timing allocated to the channel; channel 15 and channel 16 perform tone waveform synthesis at a same pitch and same key-on timing as allocated to channel 15, and channel 17 and channel 18 independently perform tone waveform synthesis at respective pitches and key-on timings allocated to the channels.

By performing tone waveform synthesis in a plurality of adjoining channels at the same pitch and key-on timing as mentioned above, separate formant sounds are synthesized with different formant center frequencies according to channel-specific formant frequency number FORM and the formant sounds are completely synchronized in generation timing, although their pitches are the same. Thus, tones (formant sound) in synchronized channels can be heard as a single tone signal, and eventually, it is possible to obtain a tone of a multi-peak formant characteristic having a plurality of different formant components.

(2) Operations of Digital Signal Processor DSP1 at Step S2

At step S2, operations are performed, by means of the arithmetic unit ALU1 of FIG. 5, to modulate the value of the formant frequency number FORM for use in preparing two groups of the center frequency phase data PGf1 and PGf2 for formant sound.

As shown in items (a) and (b) of FIG. 9, at step S2, phase increment value data corresponding to the formant frequency number FORM is set to be fed to the A input of the arithmetic unit ALU1, and attack glide data AG is set to be fed to the B input of the arithmetic unit ALU1.

More specifically, in the example of FIG. 5, the formant frequency number FORM and parameters DFM and FOM for modulating a formant sound center frequency are given as input parameters to the modulating section 12, and the selector 10 is caused to select the output data of the linear/log converter 13. The linear/log converter 13 outputs data which is a logarithmic value converted from the formant frequency number FORM having undergone frequency modulation control. This output data is selected by the selector 10 and then fed to the A input of the arithmetic unit ALU1 by way of the log/linear converter and shifter 14 and delay circuit 15. At this step S2, the controller 23 controls the log/linear converter and shifters 14 and 16 not to perform any conversion or shifting, so that the input data is allowed to pass therethrough unprocessed.

Meanwhile, attack glide data AG of the current channel in logarithmic form is read out from the memory RAM2. The read-out data AG is fed as the data #RAM2 to the selector 11. The selector 11 selects the data #RAM2, which is then fed to the B input of the arithmetic unit ALU1 by way of the log/linear converter and shifter 16 and delay circuit 17.

Thus, the frequency-modulation-controlled formant frequency number FORM in logarithmic form and attack glide data AG are added together by the arithmetic unit ALU1. Because addition of logarithmic values corresponds to multiplication of the antilogarithms (i.e., linear values) of the logarithmic values, the above-mentioned operation is equivalent, from the antilogarithmic viewpoint, to an arithmetic process for performing attack glide modulation by multiplying the frequency-modulation-controlled formant frequency number FORM by the attack glide data AG.

In this manner, step S2 executes an operation to modulate the value of the formant frequency number FORM and provides the modulated formant frequency number FORM as a logarithmic value. The thus-modulated formant frequency number FORM is delayed through the delay circuits 15, 17, 18 and 19 by a total delay time corresponding to three clock pulses and then output through the output controller 20 as the data #1 at the timing of subsequent step S5 which will be described in detail later.

In the combined functional block diagram of FIG. 10, a modulation data generator 12*d*(S2), AND gate 12*e*(S2) and adder 12*f*(S2) together correspond to the modulating section 12 of FIG. 5. Periodic frequency modulation data having a depth and rate corresponding to the frequency-modulation depth and rate parameter DFM is generated by the modulation data generator 12*d*(S2) and sent to the AND gate 12*e*(S2). The AND gate 12*e*(S2) is enabled when the frequency-modulation on/off parameter FOM instructs frequency modulation ON (start of frequency modulation), to output the periodic frequency modulation data. The frequency modulation data output from the AND gate 12*e*(S2) is added to the formant frequency number FORM by the adder 12*f*(S2), so as to output data having been obtained from the frequency modulation of the formant frequency number FORM. This output data of the adder 12*f*(S2) is converted into a logarithmic value via the linear/log converter 13(S2), which is then added to the attack glide data AG by the arithmetic unit ALU1(S2).

(3) Operations of Digital Signal Processor DSP1 at Step S3

As shown in items (a) and (b) of FIG. 9, at step S3, the data #1 is set to be fed to the A input of the arithmetic unit ALU1, and data indicative of "0" is set to be fed to the B input of the arithmetic unit ALU1.

More specifically, in the example of FIG. 5, the selector 10 is caused to select the data #1, and the selector 11 is caused to select the data indicative of "0". As the data #1, the pitch frequency number FNUM (logarithmic value) modulated at step S0 is given at this step S3, three clock pulses after step 0 (item (c) of FIG. 9). Further, at this step S3, the controller 23 controls the log/linear converter and shifter 14 to convert the logarithmic value of the the modulated pitch frequency number FNUM output from the selector 10, but the log/linear converter and shifter 16 does not perform conversion or shifting so that the data "0" output from the selector 11 is allowed to pass therethrough unprocessed. Thus, the modulated pitch frequency number FNUM converted into an antilogarithm and the value "0" are added together by the arithmetic unit ALU1, and this means that the pitch frequency number FNUM in an antilogarithmic value is just passed unprocessed.

In this manner, step S3 executes an operation to convert the modulated pitch frequency number FNUM into an antilogarithm. The antilogarithm of the pitch frequency number FNUM is delayed through the delay circuits 15, 17, 18 and 19 by a total delay time corresponding to three clock pulses and then written via the output controller 20 into the register REG1 at the timing of subsequent step S6 which will be described in detail later.

In the combined functional block diagram of FIG. 10, a log/linear converter 14(S3) corresponds to the operational function performed by the log/linear converter 14 of FIG. 5 at step S3, and the result of the operation performed by the arithmetic unit ALU1(S0) at step S0, i.e., the modulated pitch frequency number FNUM is fed to the log/linear converter 14(S3) to be converted into an antilogarithm.

(4) Operations of Digital Signal Processor DSP1 at Step S4

At step S4, operations are performed, by means of the arithmetic unit ALU1 of FIG. 5, to modulate the value of unvoiced formant frequency number UFORM for use in preparing center frequency phase data PGu for unvoiced formant sound.

As shown in items (a) and (b) of FIG. 9, at step S4, phase increment value data corresponding to the unvoiced formant frequency number UFORM is set to be fed to the A input of the arithmetic unit ALU1, and attack glide data AGu is set to be fed to the B input of the arithmetic unit ALU1.

More specifically, in the example of FIG. 5, the unvoiced formant frequency number UFORM and parameters UDFM and UFOM for modulating an unvoiced formant sound center frequency are given to the modulating section 12, and the selector 10 is caused to select the output data of the linear/log converter 13. The linear/log converter 13 outputs data which is a logarithmic value converted from the unvoiced formant frequency number UFORM having undergone frequency modulation control. This output data is selected by the selector 10 and then fed to the A input of the arithmetic unit ALU1 by way of the log/linear converter and shifter 14 and delay circuit 15. At this step S4, the controller 23 controls the log/linear converter and shifters 14 and 16 not to perform any conversion or shifting, so that the input data is allowed to pass therethrough unprocessed.

Meanwhile, attack glide data AGu of the current channel in logarithmic form is read out from the memory RAM2. The read-out data AGu is fed as the data #RAM2 to the selector 11. The selector 11 selects the data #RAM2, which is then fed to the B input of the arithmetic unit ALU1 by way of the log/linear converter and shifter 16 and delay circuit 17.

Thus, the frequency-modulation-controlled frequency number UFORM in logarithmic form and attack glide data AGu are added together by the arithmetic unit ALU1. The above-mentioned operation is equivalent, in terms of antilogarithm, to an arithmetic process for performing attack glide modulation by multiplying the frequency-modulation-controlled frequency number UFORM by the attack glide data AGu.

In this manner, step S4 executes an operation to modulate the value of the unvoiced formant frequency number UFORM and provides the modulated frequency number UFORM as a logarithmic value. The thus-modulated frequency number UFORM is delayed through the delay circuits 15, 17, 18 and 19 by a total delay time corresponding to three clock pulses and then output through the output controller 20 as the data #1 at the timing of subsequent step S7 which will be described later.

In the combined functional block diagram of FIG. 10, a modulation data generator 12*g*(S4), AND gate 12*h*(S4) and adder 12*i*(S4) together correspond to the modulating section 12 of FIG. 5. Periodic frequency modulation data having a depth and rate corresponding to the frequency-modulation depth and rate parameter UDFM is generated by the modulation data generator 12*g*(S4) and sent to the AND gate 12*h*(S4). The AND gate 12*h*(S4) is enabled when the frequency-modulation on/off parameter UFOM instructs frequency modulation ON (start of frequency modulation), to output the periodic frequency modulation data. The frequency modulation data output from the AND gate 12*h*(S4) is added to the unvoiced formant frequency number UFORM by the adder 12*i*(S4), so as to output data having been obtained from the frequency modulation of the formant frequency number UFORM. This output data of the adder 12*i*(S4) is converted into a logarithmic value via the linear/log converter 13(S4), which is then added to the attack glide data AGu by the arithmetic unit ALU1(S4).

(5) Operations of Digital Signal Processor DSP1 at Step S5

As shown in items (a) and (b) of FIG. 9, at step S5, the data #1 is set to be fed to the A input of the arithmetic unit ALU1, and data indicative of "0" is set to be fed to the B input of the arithmetic unit ALU1.

More specifically, in the example of FIG. 5, the formant frequency number FORM (logarithmic value) modulated at step S2 is given as data #1, and the selector 10 is caused to select the data #1. At this step S5, controls the log/linear converter and shifter 14 to convert the logarithmic value of the the modulated frequency number FORM into an antilogarithm under the control of the controller 23, but the log/linear converter and shifter 16 does not perform any conversion or shifting so that the input data is allowed to pass therethrough unprocessed.

Meanwhile, data indicative of "0" is fed to and selected by the selector 11, and the selected data is then sent to the B input of the arithmetic unit ALU1 by way of the log/linear converter and shifter 16 and delay circuit 17. Thus, the modulated frequency number FORM converted into an antilogarithm and the value "0" are added together by the arithmetic unit ALU1.

In this manner, step S5 executes an operation to convert the modulated formant frequency number FORM into an antilogarithm. The antilogarithm of the frequency number FNUM is delayed through the delay circuits 15, 17, 18 and 19 by a total delay time corresponding to three clock pulses and then written via the output controller 20 into the register REG1 at the timing of subsequent step S8 which will be described in detail later.

In the combined functional block diagram of FIG. 10, there is shown that a log/linear converter 14(S5) corresponds to the log/linear converter 14 of FIG. 5 at step S3, and that the modulated formant frequency number FORM is fed to the log/linear converter 14(S5) to be converted into an antilogarithm.

(6) Operations of Digital Signal Processor DSP1 at Step S6

At step S6, operations are performed, by means of the arithmetic unit ALU1 of FIG. 5, to increase, by a predetermined number of times, the value of the frequency number FNUM, for use in preparing two groups of pitch frequency phase data PGp1 and PGp2.

At this step S6, the pitch frequency number FNUM converted into an antilogarithmic value at step S3 is given to the register REG1 three clock pulses after step S3 and stored into the register REG1 as shown in item (d) of FIG. 9. In this example, the stored pitch frequency number FNUM in an antilogarithm is immediately output from the register REG1 as data #REG1.

Further, as shown in items (a) and (b) of FIG. 9, data processed from the data #REG1 are set to be fed to the A and B inputs of the arithmetic unit ALU1. That is, the pitch frequency number FNUM converted into an antilogarithmic value at step S3 is given as the data #REG1 to the selectors 10 and 11, and the selectors 10 and 11 are caused to select this data #REG1.

Meanwhile, at this step S6, frequency multiplication parameter MULT1 is applied to the controller 23 via the selector 22. Thus, under the control of the controller 23, the log/linear converter and shifter 14 performs shifting by a predetermined number of places, and the log/linear converter and shifter 16 performs shifting by a predetermined number of places and positive/negative sign inversion (normally, positive sign of the frequency number is inverted to negative sign). The positive/negative sign inversion is an operation for causing the arithmetic unit ALU1 to function as a subtracter.

Thus, one pitch frequency number FNUM shifted by the predetermined number of places is subtracted, via the arithmetic unit ALU1, from another pitch frequency number FNUM shifted by the predetermined number of places. In this example, these predetermined number of places are determined so that the subtraction result becomes greater than the original pitch frequency number FNUM by a value corresponding to the multiplication factor designated by the parameter MULT1. For example, if the multiplication factor designated by the parameter MULT1 is "3", the predetermined number of places to be shifted in the log/linear converter and shifter 14 is set to be "2" and the predetermined number of places to be shifted in the log/linear converter and shifter 16 is set to be "0". Because of this, the pitch frequency number FNUM unshifted but inverted to negative sign is added to the pitch frequency number FNUM up-shifted by two bits to assume a value increased by four times, and hence a subtraction of "4×FNUM−FNUM=3×FNUM" is conducted. As a result, there is obtained pitch frequency number data increased to a value three times greater than that of the original pitch frequency number FNUM. By conducting shifting (arithmetic operation of $2^n$) by respective predetermined numbers of places in the two channels and a subsequent subtraction as mentioned above, it is possible to perform an arithmetic operation of any optional multiplication factor, except for two, such as three, five, six or seven.

The pitch frequency number FNUM increased to a value corresponding to a desired multiplication factor is delayed through the delay circuits 15, 17, 18 and 19 by a total delay time corresponding to three clock pulses and then written via the output controller 20 into the register REG1 at the timing of subsequent step S9 which will be described in detail later.

In FIG. 10, the functional blocks corresponding to this step S6 are shown along the routes following the log/linear converter 14(S3), where shifter 14(S6) corresponds to the log/linear converter and shifter 14 of FIG. 5, shifter 16*a*(S6) and inverter 16*a*(S6) together correspond to the log/linear converter and shifter 16 of FIG. 5, and shift controller 23(S6) corresponds to the controller 23 of FIG. 5. That is, at this step S6, the pitch frequency number FNUM converted into an antilogarithm by the log/linear converter 14(S3) at step S3 is fed to the shifters 14(S6) and 16*a*(S6), which, under the control of the controller 23 based on the parameter MULT1, shift the pitch frequency number FNUM by respective predetermined numbers of places in the above-mentioned manner. The output of the shifter 16*a*(S6) is inverted to a negative value via the inverter 16*b*(S6), under the control of the controller 23. Then, the respective outputs of the shifter 14(S6) and inverter 16*b*(S6) are added together by the arithmetic unit ALU1(S6).

(7) Operations of Digital Signal Processor DSP1 at Step S7

At step S7, operations are performed, by means of the arithmetic unit ALU1 of FIG. 5, to accumulate the modulated unvoiced formant frequency number UFORM to thereby create phase data PGu progressively changing with time.

As shown in items (a) and (b) of FIG. 9, at this step S7, the data #1 is set to be fed to the A input of the arithmetic unit ALU1, and the phase data PGu obtained in the preceding cycle is set to be fed to the B input of the arithmetic unit ALU1.

More specifically, in the example of FIG. 5, the unvoiced formant frequency number UFORM (logarithmic value) processed at step S4 is output as the data #1 at this step S7 three clock pulses after step S4. Further, at this step S7, the log/linear converter and shifter 14 converts the logarithmic value of the frequency number UFORM into an antilogarithm under the control of the controller 23, but the log/linear converter and shifter 16 does not perform conversion or shifting so that the input data is allowed to pass therethrough unprocessed.

Meanwhile, at this step S7, phase data PGu of the current channel is read out from the memory RAM1 and then sent as data #RAM1 to the selector 11. The selector 11 is set to select the data #RAM1, i.e., progressive phase data PGu for noise signal, which is then fed to the B input of the arithmetic unit ALU1 by way of the log/linear converter and shifter 16 and delay circuit 17. The arithmetic unit ALU1 adds the unvoiced formant frequency number UFORM (logarithmic value) to the progressive phase data PGu read out from the memory RAM1. The addition result of the unit ALU1 is delayed through the delay circuits 15, 17, 18, 19 and 24 by a total delay time corresponding to four clock pulses and then stored via the output, controller 20 into the storage area, for phase data PGu, of the memory RAM1 at the timing of subsequent step S11 which will be described in detail later. In this way, the unvoiced formant frequency number UFORM is accumulated every cycle, as the result of which phase data PGu is generated and stored into the memory RAM1.

In FIG. 10, the functional blocks corresponding to this step S7 are shown along the routes following the arithmetic unit ALU1(S4), where log/linear converter 14(S7) corresponds to the log/linear converter and shifter 14 of FIG. 5 and phase generator ALU1 and RAM1(S7) corresponds to the arithmetic unit ALU1 and memory RAM1 of FIG. 5. The unvoiced formant frequency number UFORM (logarithmic value) obtained by the arithmetic unit ALU1(S4) at step 4 is fed to the log/linear converter 14(S7) to be converted into an antilogarithm, which is then accumulated by the phase generator ALU1 and RAM1(S7) to provide the phase data PGu.

(8) Operations of Digital Signal Processor DSP1 at Step S8

As shown in items (a) and (b) of FIG. 9, at step S8, the data #REG1 is set to be fed to the A input of the arithmetic unit ALU1, and data indicative of "0" is set to be fed to the B input of the arithmetic unit ALU1.

More specifically, in the example of FIG. 5, the modulated formant frequency number FORM converted into an antilogarithm at step S5 is stored into the register REG1 at this step S8, three clock pulses after step S5, (see item (d) of FIG. 9), and then output as the data REG1 from the register REG1. The selector 10 is caused to select the data #REG1, and the selector 11 selects "0". The controller 23 controls the log/linear converter and shifters 14 and 16 not to perform any conversion or shifting, so that the input data is allowed to pass therethrough unprocessed. Consequently, the formant frequency number FORM in an antilogarithmic value is allowed to pass through the arithmetic unit ALU1 unprocessed.

The formant frequency number FORM output from the arithmetic unit ALU1 is delayed through the delay circuits 15, 17, 18 and 19 by a total delay time corresponding to three clock pulses and then written via the output controller 20 into the register REG1 at the timing of subsequent step S11 which will be described in detail later.

This step S8 just performs a process for converting the contents of the data #REG1 into modulated formant frequency number FORM (antilogarithmic value) for timing at and after step S11, and thus it is not specifically shown in FIG. 10.

(9) Operations of Digital Signal Processor DSP1 at Step S9

At step S9, operations are performed, by means of the arithmetic unit ALU1 of FIG. 5, to prepare first-group pitch frequency phase data PGp1 using the pitch frequency number FNUM increased in value by predetermined times.

As shown in items (a) and (b) of FIG. 9, at this step S9, the data #REG1 is set to be fed to the A input of the arithmetic unit ALU1, and the first-group pitch frequency phase data PGp1 is set to be fed to the B input of the arithmetic unit ALU1.

More specifically, in the example of FIG. 5, the pitch frequency number FNUM processed at step S6 is stored into the register REG1 at this step S9, three clock pulses after step S6 (see item (d) of FIG. 9), and is then output from the register REG1 as the data #REG1. The selector 10 is caused to select the data #REG1. Further, at this step S9, the log/linear converter and shifter 14 down-shifts the pitch frequency number data by one bit under the control of the controller 23 for the reason mentioned below, but the log/linear converter and shifter 16 does not perform conversion or shifting so as to allow the input data to pass therethrough unprocessed.

Meanwhile, at this step S9, phase data PGp1 of the current channel is read out from the memory RAM1 and then sent as data #RAM1 to the selector 11. The selector 11 is caused to select the read-out data #RAM1, i.e., progressive phase data PGp1, which is then fed to the B input of the arithmetic unit ALU1 by way of the log/linear converter and shifter 16 and delay circuit 17.

Thus, the pitch frequency number data down-shifted by one bit and the phase data PGp1 read out from the RAM1 are added together by the unit ALU1. The reason why the log/linear converter and shifter 14 down-shifted the pitch frequency number data by one bit is to reduce the values of the two-group pitch frequency phase data to half of the respective original values, because, as already described in relation to the waveform synthesis based on the formant sound synthesis method, the embodiment is designed to obtain a final formant sound waveform by adding two series formant sound waveforms.

Then, the arithmetic unit ALU1 adds the halved-value of the pitch frequency number to the progressive phase data PGp1 read out from the memory RAM1. The addition result of the unit ALU1 is delayed through the delay circuits 15, 17, 18, 19 and 24 by a total delay time corresponding to four clock pulses and then stored via the output controller 20 into the storage area, for phase data PGp1, of the memory RAM1 at the timing of subsequent step S13 which will be described in detail later.

Figure 17:
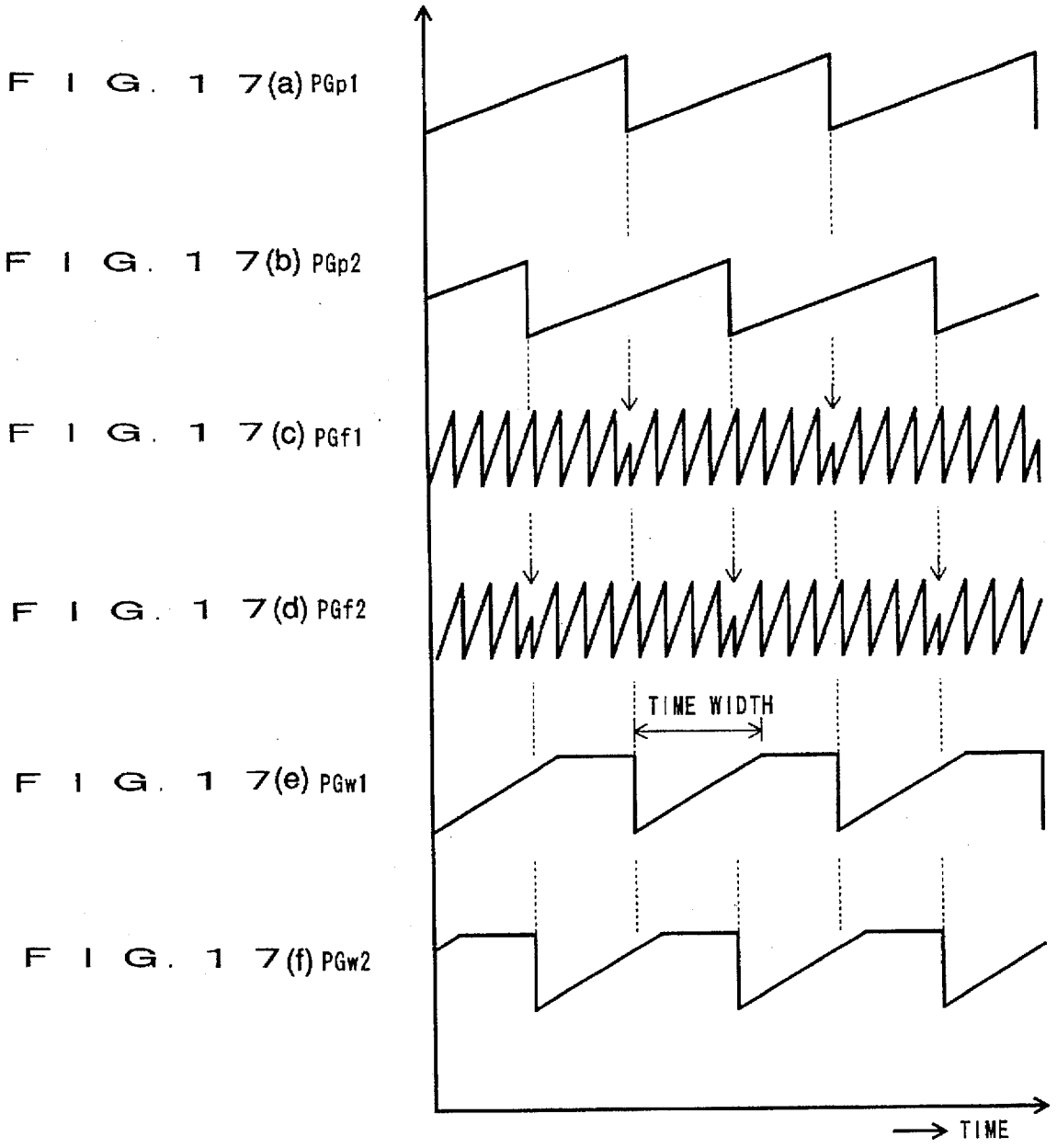
FIG. 17 is a waveform diagram illustrating various phase data formed by the first digital signal processor in the formant sound synthesis.

In this way, at step S9, the halved value of the pitch frequency number data obtained by increasing the modulated pitch frequency number FNUM by the predetermined number of times is accumulated every cycle, as the result of which first-group pitch frequency phase data PGp1 is obtained. Upon key-on of a performance operator of the electronic musical instrument (i.e., at the outset of generation of a tone), the phase data PGp1 is initialized to a predetermined value (e.g., "0") by the output controller 20. Item (a) of FIG. 17 shows an example of time-varying values of the first-group pitch frequency phase data PGp1 prepared in the above-mentioned manner.

In FIG. 10, the functional blocks corresponding to this step S9 are shown along the routes following the arithmetic unit ALU1(S6), where phase generator ALU1 and RAM1 (S9, S10) corresponds to the arithmetic unit ALU1 and memory RAM1 of FIG. 5. The pitch frequency number data obtained by the arithmetic unit ALU1(S6) at step 6 is accumulated by the phase generator ALU1 and RAM1(S9) to provide the pitch frequency phase data PGp1.

(10) Operations of Digital Signal Processor DSP1 at Step S10

At step S10, operations are performed, by means of the arithmetic unit ALU1 of FIG. 5, to prepare second-group pitch frequency phase data PGp2 using the pitch frequency number FNUM increased in value by the predetermined number of times.

As shown in items (a) and (b) of FIG. 9, at this step S10, the data #REG1 is set to be fed to the A input of the arithmetic unit ALU1, and the second-group phase data PGp2 is set to be fed to the B input of the arithmetic unit ALU1.

More specifically, in the example of FIG. 5, the same pitch frequency number data as at step S9 is given as the data #REG1 and the selector 10 is caused to select the data #REG1. At this step S10 as well, the log/linear converter and shifter 14 down-shifts the pitch frequency number data by one bit under the control of the controller 23 for the same reason as mentioned above in relation to step S9, but the log/linear converter and shifter 16 does not perform conversion or shifting so as to allow the input data to pass therethrough unprocessed.

Meanwhile, at this step S10, phase data PGp2 of the current channel is read out from the memory RAM1 and then sent as data #RAM1 to the selector 11. The selector 11 selects the read-out data #RAM1, i.e., progressive phase data PGp2, which is then fed to the B input of the arithmetic unit ALU1 by way of the log/linear converter and shifter 16 and delay circuit 17.

Then, the arithmetic unit ALU1 adds the pitch frequency number data down-shifted by one bit and the progressive phase data PGp2 read out from the memory RAM1. The addition result of the unit ALU1 is delayed through the delay circuits 15, 17, 18, 19 and 24 by a total delay time corresponding to four clock pulses and then stored via the output controller 20 into the storage area, for phase data PGp2, of the memory RAM1 at the timing of subsequent step S14 which will be described in detail later.

In this way, at step S10, the halved value of the pitch frequency number data obtained by increasing the modulated pitch frequency number FNUM by the predetermined number of times is accumulated every cycle, as the result of which second-group pitch frequency phase data PGp2 is obtained. Upon key-on of a performance operator of the electronic musical instrument, the phase data PGp2 is initialized, by the output controller 20, to a value phase-shifted by 180° from the initial value of the first-group phase data PGp1 (e.g., if the first-group phase data PGp1 is of lowest value "0", the phase data PGp2 is initialized to a value half the maximum phase value). Item (b) of FIG. 17 shows an example of time-varying values of the second-group pitch frequency phase data PGp2 prepared in the above-mentioned manner. As shown, the first-group pitch frequency phase data PGp1 and second-group pitch frequency phase data PGp2 are generated with a time difference of a half cycle because the respective initial settings are displaced by ½ of the maximum phase value.

As with step S9, the functional blocks corresponding to this step S0 are shown in FIG. 10 along the routes following the arithmetic unit ALU1(S6), where phase generator ALU1 and RAM1(S9, S10) corresponds to the arithmetic unit ALU1 and memory RAM1 of FIG. 5. The pitch frequency number data obtained by the arithmetic unit ALU1(S6) at step 6 is accumulated by the phase generator ALU1 and RAM1(S10) to provide the pitch frequency phase data PGp2.

(11) Operations of Digital Signal Processor DSP1 at Step S13

Steps S11 and S12 are directed to the mixing operations and hence will be described in detail later in connection with the operation of the fourth digital signal processor DSP4. A description will be made about step S13 here.

The modulated formant frequency number FORM in an antilogarithmic value processed at step S8 is stored into the register REG1 at step S11, three clock pulses after step S8 (see item (d) of FIG. 9).

At step S13, operations are performed, by means of the arithmetic unit ALU1 of FIG. 5, to prepare first-group center frequency phase data PGf1 by accumulating the formant frequency number FORM output from the register REG1.

As shown in items (a) and (b) of FIG. 9, at this step S13, the data #REG1 is set to be fed to the A input of the arithmetic unit ALU1, and the first-group center frequency phase data PGf1 is set to be fed to the B input of the arithmetic unit ALU1.

More specifically, in the example of FIG. 5, the selector 10 selects the formant frequency number FORM output from the register REG1. Further, the controller 23 controls the log/linear converter and shifters 14 and 16 not to perform conversion or shifting so as to allow the input data to pass therethrough unprocessed.

Meanwhile, at this step S13, the first-group center frequency phase data PGf1 of the current channel is read out from the memory RAM1 and then sent as data #RAM1 to the selector 11. The selector 11 selects the read-out data #RAM1, i.e., phase data PGf1, which is then fed to the B input of the arithmetic unit ALU1 by way of the log/linear converter and shifter 16 and delay circuit 17. The addition result of the unit ALU1 is delayed through the delay circuits 15, 17, 18, 19 and 24 by a total delay time corresponding to four clock pulses and then stored via the output controller 20 into the storage area, for phase data PGf1, of the memory RAM1 at the timing of subsequent step S17 which will be described in detail later.

In this way, at step S13, the formant frequency number FORM is accumulated every cycle to thereby prepare the first-group center frequency phase data PGf1. Upon key-on of a performance operator of the electronic musical instrument, the phase data PGf1 is initialized to a predetermined initial value (e.g., "0") by the output controller 20. Also, upon occurrence of overflow in the first-group pitch frequency phase data PGp1, the phase data PGf1 is reset to a predetermined value (e.g., "0") by the output controller 20. Item (c) of FIG. 17 shows an example of time-varying values of the first-group pitch frequency phase data PGf1 prepared in the above-mentioned manner.

Figure 3:
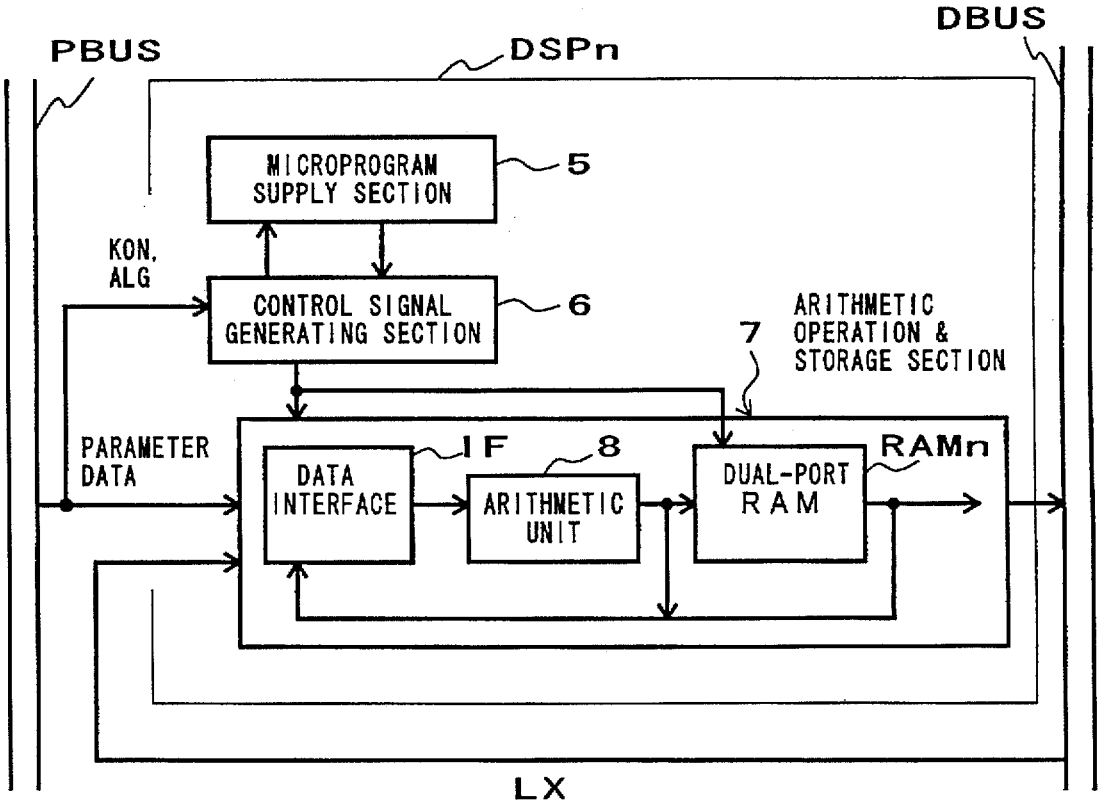
FIG. 3 is a block diagram illustrating the basic structure of the first digital signal processor (DSP1) shown in FIG. 1.

In FIG. 10, the functional blocks corresponding to this step S13 are shown along the route of selector SEL1 following the log/linear converter 14(S5), where the selector SEL1 corresponds to the function of the control signal generating section 6 of the first digital signal processor DSP1 of FIG. 3 and phase generator ALU1&RAM1(S13, S16) corresponds to the arithmetic unit ALU1 and memory RAM1 of FIG. 5. In the formant sound synthesis mode, the formant frequency number FORM converted into an anti-logarithmic value by the log/linear converter 14(S5) at step S5 is selected by the selector SEL1 for use in phase operation, and accumulated by the phase generator ALU1 and RAM1(S13, S16) to provide the first-group center frequency phase data PGf1.

(12) Operations of Digital Signal Processor DSP1 at Step S14

At step S14, an accumulative operation is performed, by means of the arithmetic unit ALU1 of FIG. 5, to prepare first-group window function phase data PGw1 on the basis of formant bandwidth (=window function time width) designating parameter BW.

As shown in items (a) and (b) of FIG. 9, at this step S14, a window function frequency number (denoted by "BW" just for convenience) based on the formant bandwidth designating parameter BW is set to be fed to the A input of the arithmetic unit ALU1, and the first-group window function phase data PGw1 is set to be fed to the B input of the arithmetic unit ALU1.

More specifically, in the example of FIG. 5, the selector 10 is caused not to select any of the data. The formant bandwidth designating parameter BW is fed via the selector 22 to the controller 23, and under the control of the controller 23 according to the parameter BW, the log/linear converter and shifter 14 outputs a window function frequency number based on the parameter BW. Meanwhile, window function phase data PGw1 of the current channel is read out from the memory RAM1 and then sent as data #RAM1 to the selector 11. The selector 11 selects the read-out data #RAM1, i.e., phase data PGw1, which is then passed through the log/linear converter and shifter 16 unprocessed and fed to the B input of the arithmetic and logical by way of and delay circuit 17. Thus, the unit ALU1 adds together the window function frequency number and phase data PGw1 read out from the memory RAM1.

The addition result of the unit ALU1 is delayed through the delay circuits 15, 17, 18 and 19 by a total delay time corresponding to three clock pulses and then output through the output controller 20 as the data #1 at the timing of subsequent step S17 which will be described later. Upon key-on of a performance operator of the electronic musical instrument, the window function phase data PGw1 is initialized to a predetermined value (e.g., "0") by the output controller 20. Also, upon occurrence of overflow in the first-group pitch frequency phase data PGp1, the window function phase data PGw1 is reset to a predetermined value (e.g., "0") by the output controller 20.

In FIG. 10, the functional blocks corresponding to this step S14 are shown along the route of window function frequency number generator 14(S14, S15), where the window function frequency number generator 14(S14, S15) corresponds to the log/linear converter and shifter 14 of FIG. 5 and window function phase generator ALU1 and RAM1 (S14, S15) corresponds to the the arithmetic unit ALU1 and memory RAM1 of FIG. 5.

(13) Operations of Digital Signal Processor DSP1 at Step S15

At step S15, operations are performed, by means of the arithmetic unit ALU1 of FIG. 5, to prepare second-group window function phase data PGw2 on the basis of formant bandwidth (=window function time width) designating parameter BW.

The operations of step S15 are different from those of step S14 in that second-group window function phase data PGw2 of the current channel is read out from the memory RAM1 and then sent as data #RAM1 to the selector 11 to be selected thereby. Thus, the unit ALU1 adds the window function frequency number BW to the phase data PGw2 read out from the memory RAM1. The addition result of the unit ALU1 is delayed through the delay circuits 15, 17, 18 and 19 by a total delay time corresponding to three clock pulses and then output through the output controller 20 as the data #1 at the timing of subsequent step S18 which will be described later. Upon key-on of a performance operator of the electronic musical instrument, the window function phase data PGw2 is initialized, by the output controller 20, to a value phase-shifted by 180° from the initial value of the phase data PGw1 (e.g., if the initial value of the phase data PGw1 is "0", the phase data PGp2 is initialized to a half value of the maximum phase value). Also, upon occurrence of overflow in the second-group pitch frequency phase data PGp2, the window function phase data PGw2 is reset to a predetermined value by the output controller 20.

In FIG. 10, the functional blocks corresponding to this step S15 are shown along the route of the window function frequency number generator 14(S14, S15), where the window function frequency number generator 14(S14, S15) corresponds to the log/linear converter and shifter 14 of FIG. 5 and window function phase generator ALU1 and RAM1 (S14, S15) corresponds to the the arithmetic unit ALU1 and memory RAM1 of FIG. 5.

(14) Operations of Digital Signal Processor DSP1 at Step S16

At step S16, operations are performed, by means of the arithmetic unit ALU1 of FIG. 5, to prepare second-group center frequency phase data PGf2 by accumulating the formant frequency number FORM output from the register REG1, in a similar manner to step S13.

The operations of step S16 are different from those of step S13 in that second-group center frequency phase data PGf2 of the current channel is read out from the memory RAM1 and then sent as data #RAM1 to the selector 11 to be selected thereby. Thus, the unit ALU1 adds the formant frequency number FORM to the second-group center frequency phase data PGf2 read out from the memory RAM1. The addition result of the unit ALU1 is delayed through the delay circuits 15, 17, 18, 19 and 24 by a total delay time corresponding to four clock pulses and then stored into the storage area, for phase data PGf2, of the memory RAM1 through the output controller 20 at subsequent step S20 which will be described in detail later.

In this way, at step S16, the formant frequency number FORM is accumulated every cycle to thereby prepare the second-group center frequency phase data PGf2. Upon key-on of a performance operator of the electronic musical instrument, the phase data PGf2 is initialized to a predetermined initial value (e.g., "0") by the output controller 20. Also, upon occurrence of overflow in the second-group pitch frequency phase data PGp2, the phase data PGf2 is reset to a predetermined value (e.g., "0") by the output controller 20. Item (d) of FIG. 17 shows an example of time-varying values of the second-group center frequency phase data PGf2 prepared in the above-mentioned manner.

In FIG. 10, the functional blocks corresponding to this step S16 are shown along the route of selector SEL1(S13, S16) following the log/linear converter 14(S5), where the selector SEL1(S13, S16 corresponds to the function of the control signal generating section 6 of the first digital signal processor DSP1 of FIG. 3 and phase generator ALU1 and RAM1(S13, S16) corresponds to the arithmetic unit ALU1 and memory RAM1 of FIG. 5. In the formant sound synthesis mode, the formant frequency number FORM converted into an antilogarithmic value by the log/linear converter 14(S5) at step S5 is selected by the selector SEL1 for use in phase operation, and accumulated by the phase generator ALU1 and RAM1(S13, S16) to provide the second-group center frequency phase data PGf2.

(15) Operations of Digital Signal Processor DSP1 at Step S17

At step S17, operations are performed to select, as first-group window function phase data PGw1 to be actually used, either the window function phase data PGw1 prepared at step S14 or pitch frequency phase data PGp1.

As shown in items (a) and (b) of FIG. 9, at this step S17, the data #REG1 is set to be fed to the A input of the arithmetic unit ALU1, and the first-group pitch frequency phase data PGp1 is set to be fed to the B input of the arithmetic unit ALU1.

More specifically, in the example of FIG. 5, the window function phase data PGw1 obtained at step S14 is given as data #1 three clock pulses after step S14, and the selector 10 is caused to select the data #1. Further, first-group pitch frequency phase data PGp1 of the current channel is read out from the memory RAM1 and then sent as data #RAM1 to the selector 11 to be selected thereby. Then, under the control of the controller 23, the log/linear converter and shifter 16 converts the input data into a negative value, although the log/linear converter and shifter 14 does not perform conversion or shifting so as to allow the input data to pass therethrough unprocessed.

Thus, the arithmetic unit ALU1 subtracts the first-group pitch frequency phase data PGp1 (fed to the B input of the unit ALU1) from the window function phase data PGw1 (fed to the A input of the unit ALU1) obtained at step S14 by accumulating the window function frequency number BW. If the subtraction result is positive (i.e., the window function phase data PGw1 obtained by accumulating the window function frequency number BW is greater in value than the pitch frequency phase data PGp1), the window function phase data PGw1 is delayed through the delay circuits 15, 17, 18, 19 and 24 by a total delay time corresponding to four clock pulses and then stored into the storage area, for phase data PGW1, of the memory RAM1 through the output controller 20 at next step S18. If, on the other hand, the subtraction result is negative (i.e., the window function phase data PGw1 obtained by accumulating the window function frequency number BW is equal to or smaller than the pitch frequency phase data PGp1), the pitch frequency phase data PGp1 is stored into the storage area, for phase data PGw1, of the memory RAM1. In practice, when storing the pitch frequency phase data PGp1 into the storage area, for phase data PGp1, of the memory RAM1 at step S13, the phase data PGp1 is also stored into the storage area for phase data PGw1 so that the phase data PGp1 will be retained as phase data PGw1 in the memory RAM1.

An example of the window function phase data PGw1 stored in the memory RAM1 through the output controller 20 is shown in item (e) of FIG. 17, where the window function phase data PGw1 obtained at step S14 is greater in value than the pitch frequency phase data PGp1. In such a case, the window function phase data PGw1 reaches a predetermined maximum value ahead of the pitch frequency phase data PGp1. Once the window function phase data PGw1 reaches the predetermined maximum value, the output controller 20 of FIG. 5 performs output control to retain (or slice) the window function phase data PGw1 at the maximum value. Therefore, the varying waveform of the window function phase data PGw1 will have slant and flat portions as shown in (e) of FIG. 17.

On the other hand, if the window function phase data PGw1 obtained at step S14 is equal to or smaller than the pitch frequency phase data PGp1, the phase data PGw1 will present the same variation as the pitch frequency phase data PGp1 shown in (a) of FIG. 17.

(16) Operations of Digital Signal Processor DSP1 at Step S18

At step S18, operations are performed to select, as second-group window function phase data PGw2 to be actually used, either the window function phase data PGw2 prepared at step S15 or pitch frequency phase data PGp2.

The operations of step S18 are different from those of step S17 in that the window function phase data PGw2 obtained at step S15 is sent as data #1 to the selector 10 three clock pulses after step S15 so as to be selected thereby and in that pitch frequency phase data PGp2 of the current channel is read out from the memory RAM1 and is sent as data #RAM1 to the selector 11 so as to be selected thereby.

Thus, as at step S17, the window function phase data PGw2 obtained at step S15 and the pitch frequency phase data PGp2 are compared with each other by use of the subtraction function of the arithmetic unit ALU1. If the window function phase data PGw2 obtained by the accumulating operation is greater in value than the pitch frequency phase data PGp2, the window function phase data PGw2 is stored into the storage area, for phase data PGW2, of the memory RAM1 at next step S19 (see (e) of FIG. 9); otherwise, the pitch frequency phase data PGp2 is stored into the storage area, for phase data PGw2, of the memory RAM1.

An example of the window function phase data PGw2 stored in the memory RAM1 through the output controller 20 is shown in item (f) of FIG. 17, where the window function phase data PGw2 obtained at step S15 is greater in value than the pitch frequency phase data PGp2. In such a case, the window function phase data PGw2 reaches a predetermined maximum value ahead of the pitch frequency phase data PGp2. Once the window function phase data PGw2 reaches the predetermined maximum value, the output controller 20 of FIG. 5 performs output control to retain (or slice) the window function phase data PGw2 at the maximum value in a similar manner to step S17. Therefore, the varying waveform of the window function phase data PGw2 will have slant and flat portions as shown in (f) of FIG. 17.

On the other hand, if the window function phase data PGw2 obtained at step S15 is equal to or smaller than the pitch frequency phase data PGp2, the phase data PGw2 will present the same variation as the pitch frequency phase data PGp2 shown in (b) of FIG. 17.

In FIG. 10, the combined functional blocks corresponding to steps S17 and S18 are shown along the routes of a comparator C1(S17, S18) and selector SEL2(S17, S18), where the comparator C1(S17, S18) corresponds to the subtraction function of the unit ALU1 and the selector SEL2(S17, S18) corresponding to the function of write-controlling the memory RAM1 in accordance with the subtraction result in the unit ALU1. Where the data output from window function phase generator ALU1 and RAM1 (S14, S15) is greater in value than phase data PGp1 or PGp2 from a phase generator ALU1 and RAM1(S9, S10), the selector SEL2(S17, S18) selects the output from the window function phase generator ALU1 and RAM1(S14, S15) as the window function phase data PGw1 or PGw2 in response to the output of the comparator C1; otherwise, the selector SEL2(S17, S18) selects the output PGp1 or PGp2 from the phase generator ALU1 and RAM1(S9, S10) as the window function phase data PGw1 or PGw2.

Because of the above-mentioned process, the repeated cycles of the window function waveform prepared in a later-described manner on the basis of the window function phase data PGw1 and PGw2 will always be synchronized with the sound pitch, and the time width of the window will be controlled by the parameter BW (i.e., slope of the window function phase data PGw1 and PGw2). Specifically, the preparation of the window function phase data may be controlled by, for example, a method proposed by the same assignee in Japanese Patent Laid-open Publication No. HEI 3-84596.

Steps 19 and 20 will be described after description of the operation of the fourth digital signal processor DSP4, since these steps are directed to the mixing operations.

In the combined functional block diagram of FIG. 10 are shown, as internal processing functions of the modulating section 12, several circuit elements denoted by reference characters beginning with numeral "12", where adders 12*c* (S0), 12*f*(S2) and 12*i*(S4) are employed as operator means for changing/modulating the pitch frequency number FNUM with modulation data such as for vibrato generated from modulation data generators 12*a*(S0), 12*d*(S2) and 12*g*(S4). Because the pitch frequency number FNUM is an antilogarithmic value at this stage, it is preferred that a multiplier be used for conducting frequency change control proportional to cent value. However, even a greatest frequency change in the modulating section 12 is in very slight amount, the use of the adders as shown in FIG. 10 will result in reduced costs rather than bringing about substantial adverse effects. If the construction of the first digital signal processor DSP1 and microprogram are altered to supply the modulation data in logarithmic values so that they are added to the sum of the attack glide data AG and the pitch frequency number FNUM (multiplied from the antilogarithmic viewpoint), frequency change control proportional to cent value can of course be implemented by antilogarithmic multiplication.

Exemplary Operations of Digital Signal Processor DSP3 Related to Noise Signal

Exemplary operations at various steps of the noise formant sound synthesis process performed by the third digital signal processor DSP3 of FIG. 6 will be described with reference to FIG. 11. Similarly to the example of FIG. 9 relating to the first digital signal processor DSP1, one cycle of the microprogram comprises 21 steps, i.e., steps S0 to S20, and one step corresponds to one cycle of the system clock. One cycle of the microprogram corresponds to one channel timing of FIG. 8, and the program is executed for 18 channels time-divisionally as shown in FIG. 8. In FIG. 11, item (a) indicates data set to be fed to the A input of the arithmetic unit ALU3 of FIG. 6, item (b) indicates data set to be fed to the B input of the arithmetic unit ALU3, item (c) indicates the contents of data #1 to be output from the shifter 39 of FIG. 6, item (d) indicates the contents of data to be written into the register REG3 of FIG. 6, item (e) indicates the contents of data to written into the register AREG of FIG. 6, (f) indicates the contents of data to be written into the RAM3 of FIG. 6. FIG. 12 is a combined functional block diagram illustrating a manner in which the third digital signal processor DSP3 of hardware structure as shown in FIG. 6 prepares noise signal, rather than the actual hardware circuit structure.

(1) Operations of Digital Signal Processor DSP3 at Step S0

Figure 6:
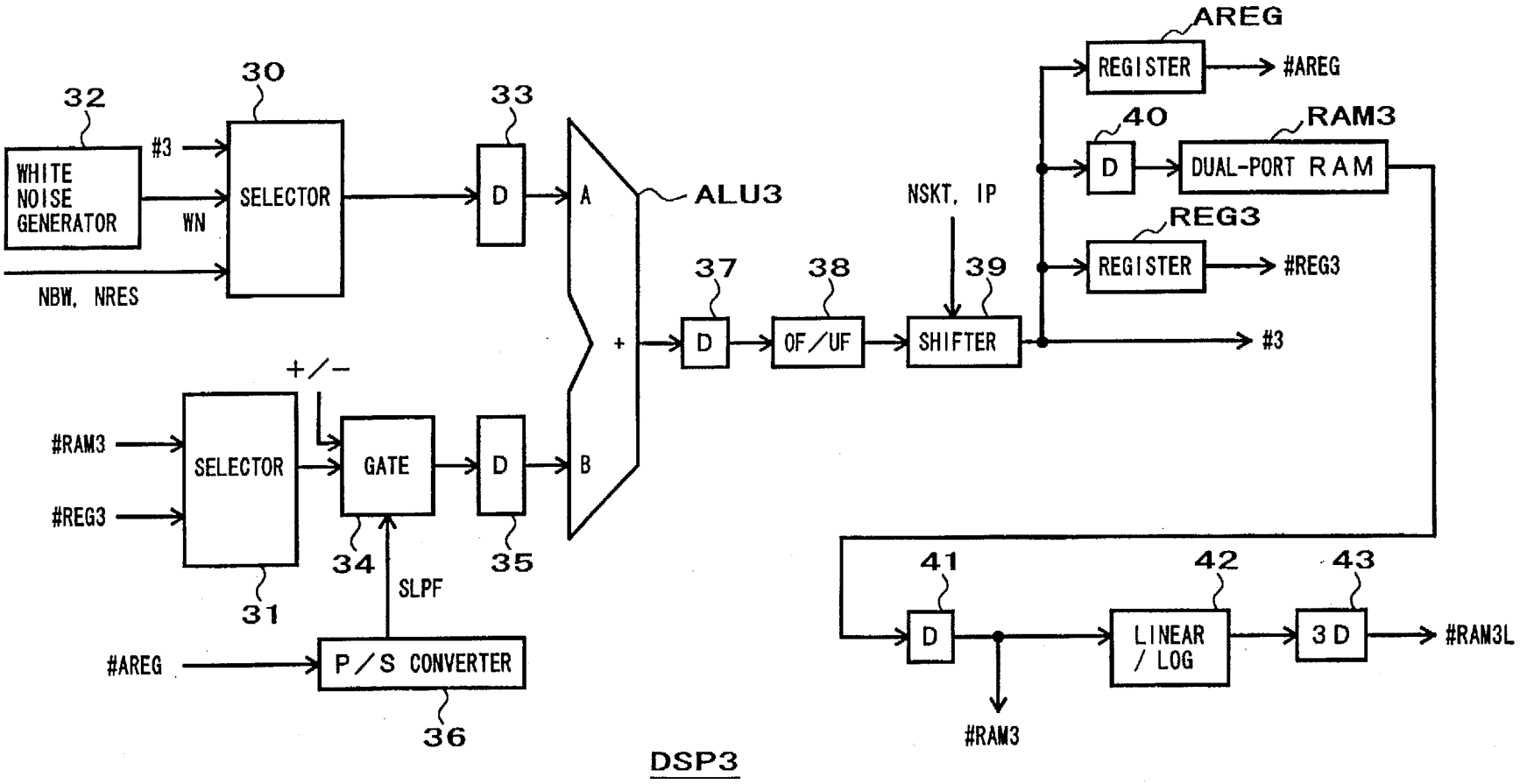
FIG. 6 is a block diagram illustrating the general hardware structure of the third digital signal processor (DSP3) shown in FIG. 1.

At step S0, operations are performed, by means of the arithmetic unit ALU3 of FIG. 6, to control the spectral structure of a low-pass noise signal for use in preparing a correlative noise signal to be used as a modulation signal for noise formant sound synthesis. Namely, the operation of step S0 is performed for enhancing the spectral level of a low-pass noise signal, to thereby control the formant peak sharpness in a noise formant sound that is prepared by a modulation operation process using a correlative noise signal based on the low-pass noise signal.

Items (a) and (b) of FIG. 11 indicate, in a simplified form, data to be fed to the A input and B input of the arithmetic unit ALU3; at this step S0, data based on parameter NRES designating noise formant sharpness is set to be fed to the A input of the arithmetic unit ALU3, and a low-pass noise signal LPF is set to be fed to the B input of the arithmetic unit ALU3.

More specifically, in the example of FIG. 6, the selector 30 selects the data based on parameter NRES, which is then fed via the delay circuit 33 to the A input of the arithmetic unit ALU3. A low-pass noise signal LPF is read out from a storage area, of the current channel, of the memory RAM3 and sent as data #RAM3 to the selector 31 to be selected thereby. At that time, data to add positive sign "+" is given to the gate circuit 34, so that the low-pass noise signal LPF with the positive sign added thereto is passed via the delay circuits 35 to the B input of the arithmetic unit ALU3. The gate circuit 34 is normally enabled to allow input data to pass therethrough, except when it is controlled to open or close at the time of a serial multiplication which will be described later.

Consequently, the arithmetic unit ALU3 adds the data based on parameter NRES to the low-pass noise signal LPF. As will be described, the low-pass noise signal LPF is a signal obtained by applying a low-pass process to a white noise signal. The addition of the data based on parameter NRES to such a low-pass noise signal LPF means that a D.C. component corresponding to the parameter NRES is added to the low-pass noise signal LPF, and hence the low spectral level region (D.C. region of zero frequency) of the signal LPF is enhanced, so that the sharpness in formant envelope of a resultant synthesized noise formant sound can be controlled.

In this way, step S0 performs operations to control the low region spectrum of the low-pass noise signal LPF. The operation result is delayed through the delay circuits 33, 35, 37, overflow/underflow controller (OF/UF) 38 and shifter 39 by a total delay time corresponding to two clock pulses and then written into the register AREG at the timing of step S2 to be later described (see item (e) of FIG. 11). At this step S0, the overflow/underflow controller (OF/UF) 38 functions as a limiter and the shifter 39 does not perform shifting so as to allow the input data to pass therethrough unprocessed.

The above-mentioned operations are summarized with reference to the combined functional block diagram of FIG. 12. In FIG. 12, the operations of step S0 correspond to the route along which coefficient data read out from a coefficient table TB1(S0) in accordance with the parameter NRES is added, by an arithmetic unit ALU3(S0), to the low-pass noise signal LPF output from an arithmetic unit ALU3(S5). The operation result of the arithmetic unit ALU3(S0) is fed to a limiter 38(S0) to undergo a predetermined limit process which corresponds to the limiting function of the overflow/underflow controller 38 of FIG. 6.

(2) Operations of Digital Signal Processor DSP3 at Step S1

At step S1, operations are performed, by means of the arithmetic unit ALU3 of FIG. 6, to obtain a lower-limit value of the allowable variation range of a correlative noise signal in order to control the noise formant bandwidth.

As shown in items (a) and (b) of FIG. 11, data based on parameter NBW designating a noise bandwidth is set to be fed to the A input of the arithmetic unit ALU3, and a correlative noise signal BWR is set to be fed to the B input of the arithmetic unit ALU3.

More specifically, in the example of FIG. 6, the selector 30 selects the data based on parameter NBW, which is then fed via the delay circuit 33 to the A input of the arithmetic unit ALU3. A correlative noise signal BWR is read out from a storage area, of the current channel, of the memory RAM3 and sent as data #RAM3 to the selector 31 to be selected thereby. At this time, data to add positive sign "–" is given to the gate circuit 34, so that the correlative noise signal with the negative sign added thereto is passed via the delay circuit 35 to the B input of the arithmetic unit ALU3.

Consequently, the arithmetic unit ALU3 subtracts, from the data based on parameter NBW, the correlative noise signal BWR obtained at the preceding cycle. Thus, there is obtained a difference between the correlative noise signal BWR obtained at the preceding cycle and the noise bandwidth designating value NBW, to provide a lower-limit value of the allowable variation range of the correlative noise signal BWR with the negative sign added thereto. Although the lower-limit value of the allowable variation range is of positive sign in actual implementation, this step S1 is program to temporarily obtain the difference in a negative sign and then convert it into a positive sign.

In this way, step S1 performs operations to obtain a lower-limit value of the allowable variation range of the correlative noise signal. The operation result is delayed through the delay circuits 33, 35, 37, overflow/underflow controller 38 and shifter 39 by a total delay time corresponding to two clock pulses and then written into the register REG3 at subsequent step S3 which will be later described. The operation result delayed through the delay circuits 33, 35, 37, overflow/underflow controller 38 and shifter 39 is also further delayed through the delay circuit 40 by a time corresponding to one clock pulse and then temporarily stored into the storage area TmpM, of the current channel, of the memory RAM3 at subsequent step S4 which will be later described. At this step S1 as well, the overflow/underflow controller (OF/UF) 38 functions as a limiter and the shifter 39 does not perform shifting so as to allow the input data to pass therethrough unprocessed.

In the combined functional block diagram of FIG. 12, the operations of step S1 correspond to the route along which coefficient data read out from a coefficient table TB2(S1) in accordance with the parameter NRW is added, by an arithmetic unit ALU3(S1), to the correlative noise signal BWR obtained in the preceding cycle and having the sign inverted by inverter INV1(S1). The operation result of the arithmetic unit ALU3(S1) is fed to a limiter 38(S1) to undergo a predetermined limit process. The inverter INV1(S1) corresponds to the function of adding the negative sign by use of the sign adding data. A memory RAM3(S20) functioning as a shift register (S/R) on the input side of the inverter INV1(S1) corresponds to the function of supplying the preceding-cycle correlative noise signal BWR as data #RAM3 from the memory RAM3.

(3) Operations of Digital Signal Processor DSP3 at Step S2

At step S2, operations are performed, by means of the arithmetic unit ALU3 of FIG. 6, to obtain an upper-limit value of the allowable variation range of a correlative noise signal in order to control the noise formant bandwidth.

As shown in items (a) and (b) of FIG. 11, data based on parameter NBW designating a noise bandwidth is set to be fed to the A input of the arithmetic unit ALU3, and a correlative noise signal BWR is set to be fed to the B input of the arithmetic unit ALU3, similarly to step S1. The operations of step S2 are different from those of step S1 in that an operation is performed for adding a positive sign "+" to the output data of the selector 31. Consequently, the arithmetic unit ALU3 adds the data based on parameter NBW to the correlative noise signal BWR obtained at the preceding cycle, to thereby provide an upper-limit value of the allowable variation range of correlative noise signal BWR with the positive sign added thereto.

In the combined functional block diagram of FIG. 12, the operations of step S2 correspond to the route along which coefficient data read out from the coefficient table TB2(S1) in accordance with the parameter NRW is added, by an arithmetic unit ALU3(S2), to the preceding-cycle correlative noise signal BWR. The operation result of the arithmetic unit ALU3(S2) is fed to a limiter 38(S2) to undergo a predetermined limiting process.

(4) Operations of Digital Signal Processor DSP3 at Step S3

At step S3, operations are performed, in combination with subsequent step S5, to a obtain low-pass noise signal LPF by subjecting a white noise signal WN to a low-pass filtering process.

As shown in items (a) and (b) of FIG. 11, a white noise signal WN is set to be fed to the A input of the arithmetic unit ALU3, and a low-pass noise signal LPF is set to be fed to the B input of the arithmetic unit ALU3.

More specifically, in the example of FIG. 6, the selector 30 selects a white noise signal WN output from the white noise generator 32, which is then fed via the delay circuit 33 to the A input of the arithmetic unit ALU3. A low-pass noise signal LPF is read out from a storage area, for low-pass noise signal LPF of the current channel, of the memory RAM3 and sent as data #RAM3 to the selector 31 to be selected thereby. At that time, data to add negative sign "–" is given to the gate circuit 34, so that the low-pass noise signal LPF with the negative sign added thereto is passed via the delay circuit 35 to the B input of the arithmetic unit ALU3.

Consequently, the arithmetic unit ALU3 subtracts, from the white signal WN, the low-pass noise signal LPF obtained at the preceding cycle. The subtraction result of the arithmetic unit ALU3 is delayed through the delay circuits 33, 35, 37, overflow/underflow controller 38 and shifter 39 by a total delay time corresponding to two clock pulses and then output as data #3 at step S5. At step S3, the overflow/underflow controller 38 functions as a limiter and the shifter 39 performs down-shifting on the basis of parameter NSKT designating a flaring shape of the skirt portion of a noise spectrum. The parameter NSKT corresponds to a low-pass coefficient, and the down-shifting corresponds to coefficient multiplication process.

In the combined functional block diagram of FIG. 12, the operations of step S3 correspond to the route along which white noise signal WN from white a noise generator 32(S3) is added, by an arithmetic unit ALU3(S3), to the low-pass noise signal LPF obtained in the preceding cycle and having the sign inverted by an inverter INV2(S3). The operation result of an arithmetic unit ALU3(S5) is subjected to a predetermined limiting process in a limiter 38(S3). RAM3 (S5) functioning as a shift register (S/R) on the input side of an inverter INV1(S3) corresponds to the function of supplying the preceding-cycle low-pass noise signal LPF as data #RAM3 from the memory RAM3.

(5) Operations of Digital Signal Processor DSP3 at Step S4

At step S4, operations are performed, by means of the arithmetic unit ALU3 of FIG. 6, to obtain an allowable variation range of a correlative noise signal in order to control the noise formant bandwidth.

As shown in items (a) and (b) of FIG. 11, data #3 is set to be fed to the A input of the arithmetic unit ALU3, and data #REG3 is set to be fed to the B input of the arithmetic unit ALU3.

More specifically, in the example of FIG. 6, the operation result data of step S2 (the upper-limit value of the allowable variation range of correlative noise signal BWR) is fed as data #3 to the selector 30 to be selected thereby, and the selected data is then fed via the delay circuit 33 to the A input of the arithmetic unit ALU3. Meantime, the operation result data of step S1 (the lower-limit value of the allowable variation range of correlative noise signal BWR with the negative sign added thereto) is fed to the selector 31 to be selected thereby, and the selected data is then fed via the delay circuit 35 to the B input of the arithmetic unit ALU3.

Consequently, the arithmetic unit ALU3 subtracts the lower-limit value of the allowable variation range from the upper-limit value of the range, so as to provide the allowable variation range between the upper- and lower-limit values.

In this way, step S4 performs operations to obtain the allowable variation range of correlative noise signal BWR. The operation result is delayed through the delay circuits 33, 35, 37 by a total delay time corresponding to two clock pulses, down-shifted by the shifter 39 by one bit and written into the register REG3 at subsequent step S6 which will be later described in detail (see item (d) of FIG. 9).

In the combined functional block diagram of FIG. 12, the operations of step S4 correspond to an arithmetic unit ALU3(S4).

(6) Operations of Digital Signal Processor DSP3 at Step S5

As shown in items (a) and (b) of FIG. 11, at step S5, data "3 is set to be fed to the A input of the arithmetic unit ALU3, and low-pass noise signal LPF is set to be fed to the B input of the arithmetic unit ALU3.

More specifically, in the example of FIG. 6, the selector 30 is supplied with the operation result data of step S3 (i.e., value obtained by subtracting the preceding-cycle low-pass signal LPF from the input white noise signal WN and subjecting the subtraction result to the coefficient operation process based on the parameter NSKT) and selects this data. The thus selected data is fed via the delay circuit 33 to the A input of the arithmetic unit ALU3. Meantime, low-pass noise signal LPF is read out from a storage area, low-pass noise signal LPF of the current channel, of the memory RAM3 and sent as data #RAM3 to the selector 31 to be selected thereby, and the selected data is imparted the positive sign and then passed via the delay circuit 35 to the B input of the arithmetic unit ALU3.

Consequently, the arithmetic unit ALU3 adds the coefficient-operated data to the low-pass noise signal LPF obtained in the preceding cycle. The addition result of the arithmetic unit ALU3 is delayed through the delay circuits 33, 35, 37, overflow/underflow controller 38 and shifter 39 by a total delay time corresponding to two clock pulses, further delayed through the delay circuit 40 by a one-clock-pulse time and then stored into the storage area, for signal LPF of the current channel, of the memory RAM3 at subsequent step S8 which will be later described. In this way, by the combined operations of steps S3 and S5, the white noise signal WN is subjected to a low-pass filter operation process, and the resultant low-pass filter output, i.e., low-pass noise signal LPF is stored into the memory RAM3. In this case, the memory RAM3 functions to delay the low-pass noise signal LPF by one sample time, i.e., functions as the shift register RAM3(S5) of FIG. 12.

In the combined functional block diagram of FIG. 12, the operations of step S5 correspond to the function of the arithmetic unit ALU3(S5) and shift register RAM3(S5).

(7) Operations of Digital Signal Processor DSP3 at Steps S6 to S17

At steps S6 to S17, operations are performed for scaling the allowable variation width data of correlative noise signal BWR obtained at step S4 by use of the low-pass noise signal LPF (assumed to be 12-bit data in the following description) stored in the register AREG at step S2, by serially multiplying the allowable variation width data by the low-pass noise signal LPF.

The low-pass noise signal LPF processed at step S0 in the above-mentioned manner is stored into the register AREG at step S2 and converted into serial form by the parallel/serial converter 37 to be serially output as 12-bit serial low-pass noise signal SLPE, from its lowermost bit, within a 12-clock-pulse period from step S6 to step S17.

First, at step S6, as shown in items (a) and (b) of FIG. 11, no data is set to be fed to the A input of the arithmetic unit ALU3, and partial product data #REG3·SLPF is set to be fed to the B input of the unit ALU3.

More specifically, in the example of FIG. 6, the selector 31 is supplied with the operation result data of step S4 (i.e., data indicative of the allowable variation width of the correlative noise signal DWR, which will be hereinafter be referred to as "allowable variation data"), and the selector 31 selects this data. The selected data is given the positive sign and then transferred to the gate circuit 34. To the control input of the gate circuit 34 is given a signal, indicative of the first bit of serial low-pass noise signal SLPF from the parallel/serial converter 37. The gate circuit 34 outputs "0"s when the first bit of serial low-pass noise signal SLPF is "0" but outputs the value of #REG3 when the first bit of serial low-pass noise signal SLPF is "1", so that a multiplication is performed for obtaining a partial product between the above-mentioned allowable variation width data and the lowermost bit of the low-pass noise signal SLPF. The multiplication result is sent via the delay circuit 35 to the B input of the arithmetic unit ALU3.

The arithmetic unit ALU3 functions to adds the partial products obtained by the serial multiplication. At the first two steps S6 and S7, no data is fed to the A input of the arithmetic unit ALU3 so that the partial product data fed the B input of the arithmetic unit ALU3 is allowed to pass therethrough unprocessed. This is because the partial product is delayed through the delay circuits 35 and 37 by a total delay time corresponding to two clock pulses.

Therefore, at step S6, the partial product is output from the arithmetic unit ALU3 without being unprocessed thereby, and then it is, after being delayed through the delay circuits 35, 37 by a total delay time corresponding to two clock pulses, passed through the overflow/underflow controller 38, down-shifted by the shifter 39 by two bits and output as data #3 at subsequent step S8 which will be later described in detail (see item (c) of FIG. 11). At and after step 8, the data #3 is selected by the selector 30 and fed to the A input of the arithmetic unit ALU3. The reason why the partial product output from the unit ALU3 is down-shifted by the shifter 39 by two bits is to adjust the data weighing to match because the data #3 is added to the calculated partial product (i.e., data at the B input of the unit ALU3) two bits upper than the data #3.

At next step S7, a multiplication is performed, in the gate circuit 34, between the above-mentioned allowable variation width data #REG3 and the second lowermost bit data of the low-pass noise signal SLPF. The multiplication result is delayed by a time corresponding to two clock pulses, down-shifted by two bits and output as data #3 at subsequent step S9 which will be later described in detail (see item (c) of FIG. 11).

At next step S8, a multiplication is performed, in the gate circuit 34, between the above-mentioned allowable variation width data #REG3 and the third lowermost bit data of the low-pass noise signal SLPF. As shown in item (a) of FIG. 11, at each of steps S8 to S18, the data #3 output from the shifter 39 is selected by the selector 30 and fed to the A input of the unit ALU3. Thus, the partial product for the lowermost bit of the low-pass noise signal SLPF (data at the A input) and the partial product for the third lowermost bit of the low-pass noise signal SLPF (data at the B input) are added together by the arithmetic unit ALU3 so as to provide a sum of the partial products. The sum of the partial products output from the arithmetic unit ALU3 is, after being delayed through the delay circuits 33, 35, 37 by a total delay time corresponding to two clock pulses, passed through the overflow/underflow controller 38, down-shifted by the shifter 39 by two bits and output as data #3 at subsequent step S10 which will be later described in detail (see item (c) of FIG. 11).

At next step S9, a multiplication is performed, in the gate circuit 34, between the above-mentioned allowable variation width data #REG3 and the fourth lowermost bit data of the low-pass noise signal SLPF. At this step S9, the data #3 corresponding to the partial product for the second lowermost bit of the low-pass noise signal SLPF is selected by the selector 30 and fed to the A input of the unit ALU3. Thus, the partial product for the second lowermost bit of the low-pass noise signal SLPF (data at the A input) and the partial product for the fourth lowermost bit of the low-pass noise signal SLPF (data at the B input) are added together by the arithmetic unit ALU3 so as to provide a sum of the partial products. The sum of the partial products output from the arithmetic unit ALU3 is, after being delayed through the delay circuits 33, 35, 37 by a total delay time corresponding to two clock pulses, passed through the overflow/underflow controller 38, down-shifted by the shifter 39 by two bits and output as data #3 at subsequent step S11 which will be later described (see item (c) of FIG. 11).

Similarly, at subsequent steps S10, S12, S14 and S16, partial products for odd-numbered bits from the lowermost bit are sequentially obtained, and the sum of the partial products so far obtained are calculated. A total sum of such partial products for the odd-numbered bits calculated at step 16 is delayed by a total time corresponding to two clocks and then output as data #3 from the shifter 39 (item (c) of FIG. 11).

Likewise, at subsequent steps S11, S13, S15 and S17, partial products for even-numbered bits from the lowermost bit are sequentially obtained, and sum of the partial products so far obtained are calculated. A total sum of such partial products for the even-numbered bits calculated at step 17 is delayed by a total time corresponding to two clocks and then output as data #3 from the shifter 39 (item (c) of FIG. 11).

By the above-mentioned serial multiplications between the allowable variation width data and low-pass noise signal LPF, the allowable variation width data of the correlative noise signal BWR is scaled with the randomly varying low-pass noise signal LPF. However, since the operations up to step S17 obtain the total sum of the partial products for the odd-numbered bits and the total sum of the partial products for the even-numbered bits separately, it is necessary to further add together the two total sums in order to obtain an ultimate scaling result (ultimate multiplication result). The above-mentioned operations of steps S6 to S17 correspond to the function of multiplier ALU3(S6 to S17) in FIG. 12.

(8) Operations of Digital Signal Processor DSP3 at Steps S18 to S20

As shown in items (a) and (b) of FIG. 11, at step S18, data #3 is set to be fed to the A input of the arithmetic unit ALU3, and data stored in a temporary storage area of the memory RAM3 is set to be fed to the B input of the arithmetic unit ALU3.

More specifically, in the example of FIG. 6, the operation result of step S16 (i.e., the total sum of the partial products for the odd-numbered bits) is fed to the selector 30 to be selected thereby, and the selected data is then fed via the delay circuit 33 to the A input of the arithmetic unit ALU3. Meantime, data stored in a temporary storage area TmpM of the memory RAM3 (i.e., the lower-limit value of the correlative noise signal BWR with the negative sign calculated at step S1 and stored into the storage area TmpM at step S4) is output as data #RAM3 and fed to the selector 31 to be selected thereby. The data selected by the selector 31 (i.e., the lower-limit value of the correlative noise signal BWR having the negative sign added thereto) is then sign-converted (i.e., the negative sign is inverted into the positive sign) and fed via the gate circuit 34 and delay circuit 35 to the B input of the arithmetic unit ALU3.

Consequently, the arithmetic unit ALU3 adds together the lower-limit value of the correlative noise signal BWR with the positive sign fed to the B input and a part of the values obtained by scaling the allowable variation width data of the correlative noise signal BWR with the low-pass noise signal LPF (total sum of the partial products for the odd-numbered bits) fed to the B input. The addition result is delayed by a total time corresponding to two clock pulses and then output from the shifter 39 at the timing of step S20 to be fed as data #3 to the selector 30.

At next step S19, the total sum of the partial products for the even-numbered bits is delayed by a total time corresponding to two clock pulses and then output from the shifter 39 at the timing of step S20 to be written into the register REG3 (see item (c) of FIG. 11).

As shown in items (a) and (b) of FIG. 11, at next step S20, data #3 is set to be fed to the A input of the arithmetic unit ALU3, and data #REG3 is set to be fed to the B input of the arithmetic unit ALU3. More specifically, in the example of FIG. 6, the selector 30 selects the data #3, so that the operation result of step S18 is fed to the A input of the arithmetic unit ALU3. Meantime, the selector 31 selects the data #REG3 from the register REG3, so that the total sum of the partial products for the even-numbered bits calculated at step S17 is fed to the B input of the arithmetic unit ALU3.

Consequently, in the arithmetic unit ALU3, the remainder of the "values obtained by scaling the allowable variation width data of the correlative noise signal BWR with the low-pass noise signal LPF" (total sum of the partial products for the even-numbered bits) (data fed to the B input) is added to the value obtained by adding the part of the "values obtained by scaling the allowable variation width data of the correlative noise signal BWR with the low-pass noise signal LPF" (total sum of the partial products for the odd-numbered bits) to the lower-limit value of the noise signal BWR with the positive sign (data fed to the B input). In this manner, the "values obtained by scaling the allowable variation width data of the correlative noise signal BWR with the low-pass noise signal LPF" are added to the "lower-limit value of the correlative noise signal BWR", to provide a new correlative noise signal BWR. The "correlative noise signal BWR" output from the arithmetic unit ALU3 is, after being delayed through the delay circuits 33, 35, 37, 40 by a total delay time corresponding to three clock pulses, written into the storage area, for correlative noise signal BWR of the current channel, of the memory RAM3 at the timing of step S2 for the next channel.

The correlative noise signal BWR prepared in the above-mentioned manner and written in the memory RAM3 is read out at steps S1 and S2 of the third digital signal processor DSP3 in the next cycle for the current channel and utilized for renewal. The correlative noise signal BWR written in the memory RAM3 is also read out at predetermined timing, passed through the delay circuit 41, converted by the linear/log converter 42 into logarithmic form, then sent via the delay circuit 43 to the data bus DBUS as data #RAM3L, and finally fed to the fourth digital signal processor DSP4 for use in noise formant sound synthesis.

In the combined functional block diagram of FIG. 12, the operations of steps S18 to S20 correspond to the route along which the output of an arithmetic unit ALU3(S4), i.e., the lower-limit value of the correlative noise signal BWR with the negative sign is inverted to the positive sign, added to the output of a multiplier MULT(S6 to S17) by an arithmetic unit ALU3(S18, S20) and stored into a memory RAM3(S20) functioning as a shift register(S/R). The correlative noise signal BWR read out in the next sampling time from the memory RAM3(S20) functioning as the shift register(S/R) is converted by the linear/log converter 42 into a logarithmic value to be output to the data bus DBUS and is also used for renewal of data within the third digital signal processor DSP3.

The method already proposed by the same assignee such as in Japanese Patent Laid-open Publication No. HEI 4-346502 may be employed as the above-mentioned noise formant sound synthesis method which controls the skirt portion and bandwidth of noise formant independently of each other by use of noise formant controlling parameters NRES, NSKT, NBW, and therefore reference may be made to the publication, if necessary, for further details of the method.

Exemplary Operations of Digital Signal Processor DSP4 Related to Formant Sound Synthesis Exemplary operations at various microprogram steps performed by the fourth digital signal processor DSP4 of FIG. 7 will be described with reference to FIG. 13. Similarly to the example of FIG. 9 relating to the first digital signal processor DSP1, one cycle of the microprogram comprises 21 steps, i.e., steps S0 to S20, and one step corresponds to one cycle of the system clock. One cycle of the microprogram corresponds to one channel timing of FIG. 8, and the program is executed for 18 channels time-divisionally as shown in FIG. 8. In FIG. 13, item (a) indicates data set to be fed to the A input of the arithmetic unit ALU4 of FIG. 7, item (b) indicates data set to be fed to the B input of the arithmetic unit ALU4, item (c) indicates the contents of data #1 to be output from the overflow/underflow controller 56 of FIG. 7, item (d) indicates the contents of data to be written into the register REG3 of FIG. 6, and item (e) indicates the contents of data to written into the register REG4 of FIG. 7. FIG. 14 is a combined functional block diagram illustrating a manner in which the fourth digital signal processor DSP4 of hardware structure as shown in FIG. 7 performs a waveform synthesis process (however, a digital mixer ALU1&RAM1 (S11, S12, S19, S20) concerns operations in the first digital signal processor DSP1). Similarly to FIGS. 10 and 12, FIG. 14 does not show the actual hardware circuit structure.

(1) Operations of Digital signal processor DSP4 at Step S0

Step S0 performs part of operations for preparing a periodic functional waveform to create a first-group formant sound waveform.

As shown in items (a) and (b) of FIG. 13, at this step, first-group center frequency phase data PGf1 is set to be fed to the A input of the arithmetic unit ALU4, while no data is set to be fed to the B input of the unit ALU4.

More specifically, first-group center frequency phase data PGf1 of the current channel is read out from the memory RAM1 at predetermined timing. The read-out phase data PGf1 is sent, as data #RAM1, from the first digital signal processor DSP1 of FIG. 5 to the data bus DBUS, by way of which it is then input to the fourth digital signal processor DSP4 of FIG. 7 to be fed to the rhythm sound generator 52. In accordance with rhythm sound generation on/off parameter RHY, the rhythm sound generator 52 outputs the phase data PGf1 after disturbing its phase when in the mode to generate rhythm sound (i.e., percussion sound), but when not in such a mode, the rhythm sound generator 52 outputs the phase data PGf1 without disturbing its phase. The phase data PGf1 output from the rhythm sound generator 52 is fed to the selector 50 which is, at step S0, caused to select the output data from the generator 52. On the other hand, no data is selected by the selector 51.

Thus, the first-group center frequency phase data PGf1 with its phase disturbed or undisturbed in accordance with the rhythm sound generation on/off parameter RHY is sent via the delay circuit 53 to the arithmetic unit ALU4 to pass therethrough unprocessed, and then fed to the β input of the selector 64 by way of the delay circuit 55, overflow/underflow controller 56, delay circuit 61, log/sine table 62 and delay circuit 63.

Consequently, the selector 64 selects the data fed to the β input in response to the above-mentioned operation at step S0. In this way, the first-group center frequency phase data PGf1 processed at step S0 in the above-mentioned manner is selectively output from the selector 64.

In accordance with fundamental waveform designating parameter WF1, the waveform shifter 60 performs a phase manipulation process to shift the phase value of the center frequency phase data PGf1 or to set the phase value to "0" for a specific portion. This process will completely change a time-varying characteristic of phase value of the phase data PGf1, so as to optionally change the fundamental waveform of waveform data, from a simple sine waveform to a complex waveform, which is read out from the log/sine table 62 on the basis of the changed phase data as will be later described. More specifically, if the phase data time-varies in a simple linear manner, a simple sine wave will be read out; however, if the phase data time-varies intermittently or in any other complex manner, a complex waveform will be read out. The log/sine table 62 receives the phase data processed by the waveform shifter 60 and reads out sine waveform amplitude value data in a logarithmic value corresponding to the value of the received phase data. Thus, there is output periodic functional waveform data in a logarithmic value which corresponds to the phase data of formant center frequency.

The logarithmic waveform data output from the selector 64 is passed through the shifter and log/linear converter 65 without being processed thereby, and is then, after being delayed through the delay circuits 53, 55, 61, 63 by a total delay time corresponding to four clock pulses, written into the register REG4 at the timing of step S4 which will be described later (see item (d) of FIG. 13).

Figure 7:
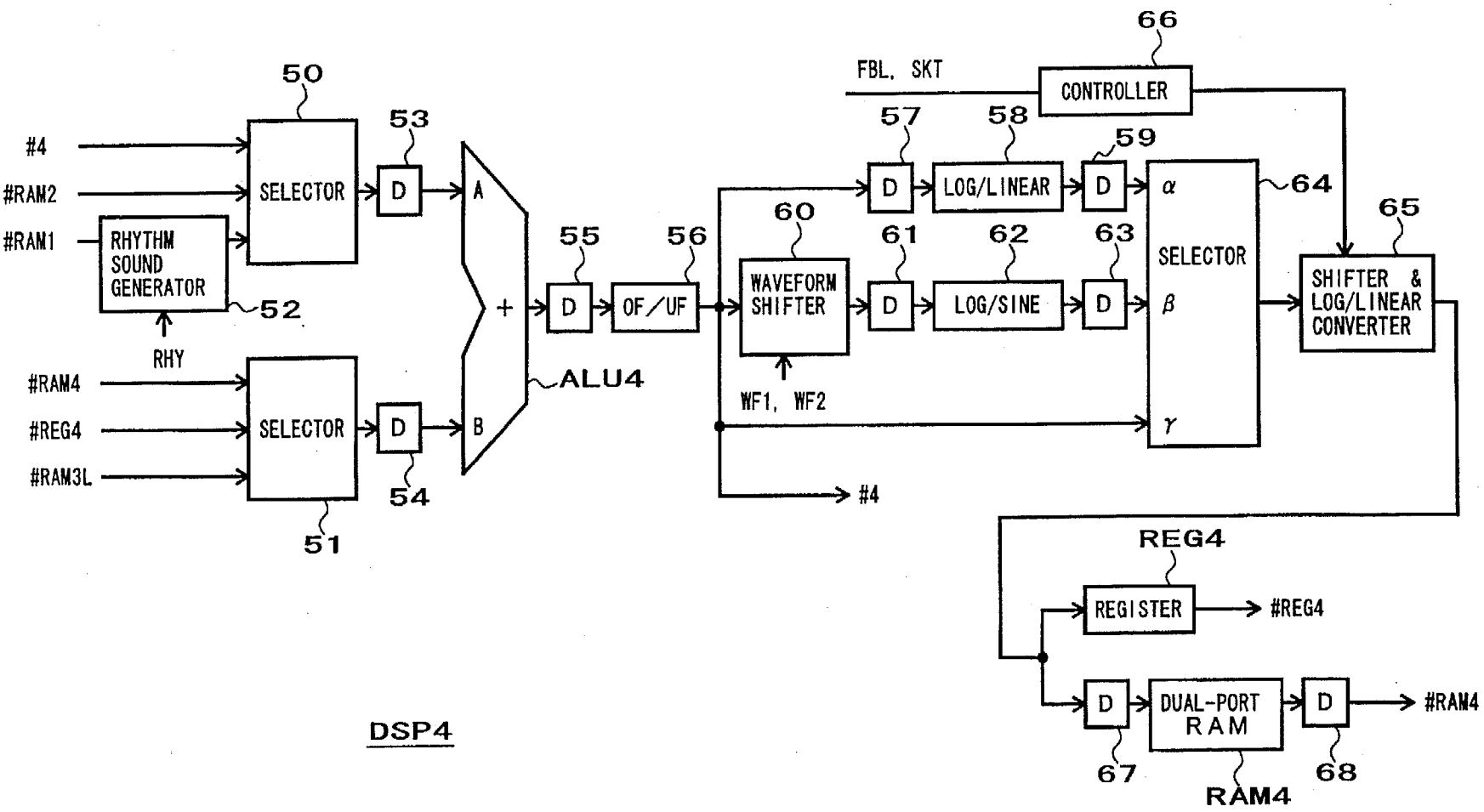
FIG. 7 is a block diagram illustrating the general hardware structure of the fourth digital signal processor (DSP4) shown in FIG. 1.

In the combined functional block diagram of FIG. 14, the operations of step S0 correspond to the route beginning at a noise imparted 52(S0, S10), where the noise imparted 52(S0, S10) corresponds to the noise generator 52 of FIG. 7, an arithmetic unit ALU4(S0, S10) corresponds to the arithmetic unit ALU4 of FIG. 7, and a shifter and log/linear converter 60&62(S0, S10) corresponds to the waveform shifter 60 and log/sine table 62 of FIG. 7. The center frequency phase data PGf1 received from the first digital signal processor DSP1 is controlled, by the noise imparted 52(S0, S10), to have its phase disturbed or undisturbed in accordance with rhythm sound generation on/off parameter RHY, passed through the arithmetic unit ALU4(S0, S10) without being processed thereby, and fed to the shifter and log/linear converter 60&62(S0, S10). In the shifter and log/linear converter 60&62(S0, S10), the above-mentioned process based on the parameter WF1 is applied to the phase data PGf1, so that sine waveform data in logarithmic form is ultimately read out in response to the controlled phase data PGf1.

(2) Operations of Digital Signal Processor DSP4 at Step S2

Step S1 will be described after step S2 since step S1 concerns operations continued from a preceding channel.

Step S2 performs operations for preparing a window function waveform to create a first-group formant sound waveform.

As shown in items (a) and (b) of FIG. 13, at this step S2, first-group window function waveform phase data PGw1 is set to be fed to the A input of the arithmetic unit ALU4, while no data is set to be fed to the B input of the unit ALU4.

More specifically, first-group window function waveform phase data PGw1 of the current channel is read out from the memory RAM1 at predetermined timing. The read-out phase data PGw1 is sent, as data #RAM1, from the first digital signal processor DSP1 of FIG. 5 to the data bus DBUS, by way of which it is then input to the fourth digital signal processor DSP4 of FIG. 7 to be fed to the rhythm sound generator 52. In this case, the rhythm sound generation on/off parameter RHY indicates "OFF", so that the window function waveform phase data PGw1 is passed to the selector 50 without being changed by the rhythm sound generator 52. The selector 50 is caused to select the data #RAM1, i.e., window function waveform phase data PGw1.

Thus, the first-group window function waveform phase data PGw1 is sent via the delay circuit 53 to the arithmetic unit ALU4 to pass therethrough unprocessed, and then fed to the β input of the selector 64 by way of the delay circuit 55, overflow/underflow controller 56, waveform shifter 60, delay circuit 61, log/sine table 62 and delay circuit 63.

Consequently, the selector 64 selects the data fed to the β input in response to the above-mentioned operation at step S2. Thus, the phase data PGw1 processed at step S0 in the above-mentioned manner is selectively output from the selector 64 by way of the delay circuit 55, overflow/underflow controller 56, delay circuit 61, log/sine table 62 and delay circuit 63. At step S2, the waveform shifter 60 down-shifts the phase value of the window function waveform phase data PGw1 by one bit, in order to cause the log/sine table 62 to output, as a window function waveform, a first half of a sine wave from the log/sine table 62 in response to one cycle of the phase data PGw1. Thus, the log/sine table 62 reads out the logarithmic value of a sine waveform amplitude value corresponding to the down-shifted phase value of the window function waveform phase data PGw1. In this manner, the first-group window function waveform is provided in a logarithmic value.

Meantime, formant sound skirt characteristic designating parameter SKT is up-shifted by one bit via the controller 66 and then fed to the shifter and log/linear converter 65. As previously mentioned, the logarithmic value of the first-group window function waveform "log sine(PGw1)" output from the selector 64 is fed to the shifter and log/linear converter 65, where it is up-shifted by 2×SKT bits in accordance with the skirt characteristic designating parameter SKT up-shifted by one bit (i.e., 2×SKT). Namely, "(2×SKT).log sine (PGw1)" is executed, which signifies that the logarithmic value is converted into a waveform of sine(PGw1) in antilogarithmic representation. This means that the window function waveform sine(PGw1) is subjected to a waveform conversion of $2^n$ to become a window function waveform having a flaring skirt portion. The logarithmic data of the thus-obtained window function half-waveform of sine wave is, after being delayed through the delay circuits 53, 55, 61, 63 by a total delay time corresponding to four clock pulses, written into the register REG4 at the timing of subsequent step S6 which will be described in detail later (see item (d) of FIG. 13). At this step S2, the shifter and log/linear converter 65 functions as a shifter as mentioned earlier, and not as a log/linear converter.

In the combined functional block diagram of FIG. 14, the operations of step S2 correspond to the route beginning at an arithmetic unit ALU4(S2, S12), where the arithmetic unit ALU4(S2, S12) corresponds to the arithmetic unit ALU4 of FIG. 7, a shifter and linea/log converter 60&62(S2, S12) corresponds to the waveform shifter 60 and log/sine table 62, and a shifter 65(S2, S12) corresponds to the shifter and log/linear converter 65 of FIG. 7. The center frequency phase data PGf1 received from the first digital signal processor DSP1 is passed through the arithmetic unit ALU4(S2, S12) without being processed thereby, fed to the shifter and linear/log converter and shifter 60&62(S2, S12) to be down-shifted by one bit and converted in a logarithmic value of a sin wave, and up-shifted by predetermined bit via the shifter 65(S2, S12) in accordance with the parameter SKT.

(3) Operations of Digital Signal Processor DSP4 at Step S5

Step S5 performs operations for controlling the tone volume level of frequency function waveform data corresponding to the first-group formant frequency.

As shown in items (a) and (b) of FIG. 13, at this step, tone volume level data LVL1 is set to be fed to the A input of the arithmetic unit ALU4, while data #REG4 is set to be fed to the B input of the unit ALU4.

More specifically, tone volume level data LVL1 in logarithmic form of the current channel is read out from the memory RAM2 of the second digital signal processor DSP2 at predetermined timing. As mentioned earlier, this tone volume level data LVL1 has been imparted an envelope waveform. The tone volume level data LVLL is sent to the data bus DBUS, by way of which it is input to the fourth digital signal processor DSP4 of FIG. 7 to be fed as data #RAM4 to the selector 50. At step S5, the selector 51 is caused to select the data #RAM2, i.e., tone volume level data LVL1.

Meantime, the logarithmic value data of the periodic function waveform obtained at step S0 on the basis of the first-group center frequency phase data PGf1 is stored into the register REG4 at step S4, four clock pulses after step S0, and output as data #REG4 from the register REG4 at step S5. The selector 51 is caused to select this data #REG4.

Thus, the arithmetic unit ALU4 adds together the logarithmic value of the periodic function waveform of the formant center frequency and the tone volume level data LVL1. From the antilogarithmic viewpoint, this is equivalent to multiplying the periodic function waveform by the tone volume level data LVL1 to thereby impart a tone volume envelope to the waveform.

The operation result of the arithmetic unit ALU4 is, after being delayed through the delay circuits 53, 54, 55 by a total delay time corresponding to two clock pulses, passed through the overflow/underflow controller 56, and output as data #4 at the timing of subsequent step S6 which will be described later (see item (c) of FIG. 13).

In the combined functional block diagram of FIG. 14, the operations of step S5 correspond to the route along which the logarithmic value of a periodic function waveform from the shifter and linear/log converter 60&62(S0, S10) and tone volume level data LVL1 in logarithmic form from the second digital signal processor DSP2 are added together by an arithmetic unit ALU4(S5, S15).

(4) Operations of Digital Signal Processor DSP4 at Step S7

Step S7 performs operations for multiplying the periodic function waveform having the controlled tone volume envelope corresponding to the formant center frequency by the window function waveform corresponding to the pitch of tone, in order to generate the first-group formant sound waveform.

As shown in items (a) and (b) of FIG. 13, at this step, data #4 is set to be fed to the A input of the arithmetic unit ALU4, while data #REG4 is set to be fed to the B input of the unit ALU4.

More specifically, the logarithmic value data of the periodic function waveform having the controlled tone volume envelope corresponding to the formant center frequency which has been processed at step 5 is output as data #4 at step S7, two clock pulses after step S5, and the selector 50 is caused to select this data #4.

Meantime, the logarithmic value data of the window function waveform obtained at step S2 on the basis of the first-group window function waveform phase data PGw1 is stored into the register REG4 at step S6, four clock pulses after step S2, and the selector 51 is caused to select this data #REG4.

Thus, the arithmetic unit ALU4 adds together the logarithmic values of the periodic function waveform and window function waveform. From the antilogarithmic viewpoint, this is equivalent to multiplying the periodic function waveform corresponding to the formant center frequency function by the pitch-corresponding window function waveform to thereby perform an amplitude modulation operation for synthesizing a first-group formant waveform signal.

Consequently, the selector 64 selects the data fed to the $\alpha$ input in response to the above-mentioned operation at step S7. Thus, the amplitude modulation result (logarithmic value) of the arithmetic unit ALU4 is sent, via the delay circuit 55, overflow/underflow controller 56 and delay circuit 57, to the log/linear converter 58 where it is converted into an antilogarithmic value. The resultant converted antilogarithmic value is output from the selector 64 by way of the delay circuit 59.

The antilogarithmic value data output from the selector 64, i.e., the result of the above-mentioned amplitude modulation operation is passed through the shifter and log/linear converter 65 without being processed thereby, and sent to the memory RAM4 by way of the delay circuit 67. Consequently, the amplitude modulation result in antilogarithmic form, i.e., waveform data of a synthesized first-group formant sound is, after being delayed through the delay circuits 53, 54, 55, 57, 59, 67 by a total delay time corresponding to five clock pulses, written into the storage area, for first-group formant sound waveform data TR1 of the current channel, of the memory RAM4 at the timing of subsequent step S12 which will be described later in detail (see item (e) of FIG. 13).

Figure 18:
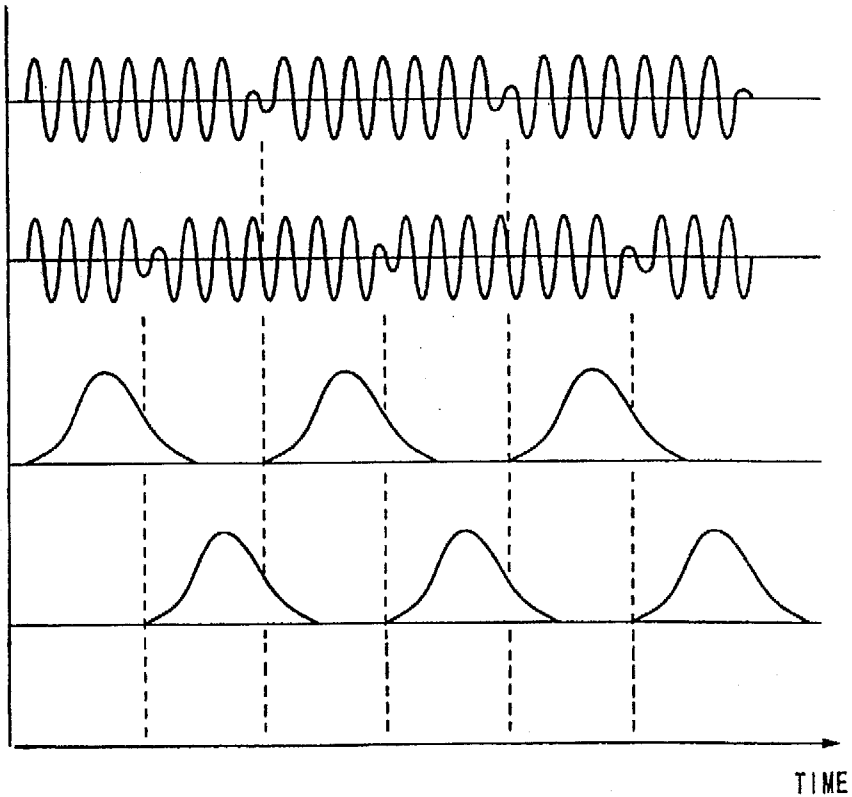
FIG. 18 is a waveform diagram illustrating various tone waveforms generated by the fourth digital signal processor in the formant sound synthesis.

An example of the first-group periodic function waveform based on the first-group formant center frequency phase data PGf1 is shown in item (a) of FIG. 18, and an example of the first-group window function waveform based on the first-group window function waveform phase data PGw1 is shown in item (c) of FIG. 18. Item (e) of FIG. 18 shows an example of the first-group formant sound waveform generated by multiplying these waveforms. The pitch of the first-group formant sound waveform is a half (½) of the normal pitch (f0) based on the pitch frequency number data; i.e., the period of the first-group formant sound waveform is twice as great as the normal period. In the window function waveforms of items (c) and (d) of FIG. 18, level "0" portions correspond to the flat maximum phase value portions of the phase data PGw1 and PGw2 of items (e) and (f) of FIG. 17.

In the combined functional block diagram of FIG. 14, the operations of step S7 correspond to the route beginning at an arithmetic unit ALU4(S7, S17), where the arithmetic unit ALU4(S7, S17) corresponds to the arithmetic unit ALU4 of FIG. 7, a limiter 56(S7, S17) corresponds to the overflow/underflow controller 56, a log/linear converter 58(S7, S17) corresponds to the log/linear converter 58 of FIG. 7, and a register RAM4(S7) corresponds to the RAM4 of FIG. 7. Gate G1 indicates that the above-mentioned route is enabled only in the formant sound synthesis mode. The arithmetic unit ALU4(S7, S17) adds together the logarithmic value of the periodic function waveform supplied from the arithmetic unit ALU4(S5, S15) and the logarithmic value of the window function waveform supplied from the shifter 65(S2, S12) via the gate G1. The addition result is sent via the limiter 56(S7, S17) to the log/linear converter 58(S7, S17) to be converted into an antilogarithmic value and then stored in a register RAM4(S7).

(5) Operations of Digital Signal Processor DSP4 at Step S10

Similarly to step S0, step S10 performs part of operations for preparing a periodic function waveform to create a second-group formant sound waveform.

The operations of step 10 are different from the operations of step S0 in that second-group center frequency phase data PGf2 of the current channel is read out from the memory RAM1 of the first digital signal processor DSP1 of FIG. 5 and then sent via the rhythm sound generator 52 to the selector 50 to be selected thereby.

Like the first-group center frequency phase data PGf1, the second-group center frequency phase data PGf2 is processed and delayed through the delay circuit 53, arithmetic unit ALU4, delay circuit 55, overflow/underflow controller 56, delay circuit 61, log/sine table 62, delay circuit 63, selector 64 and shifter and log/linear converter 65 by a total delay tome corresponding to four clock pulses. However, at this step, the waveform shifter 60 performs a phase manipulation process based on second-group fundamental waveform designating parameter WF2. Then, the processed data is written into the register REG4 at the timing of subsequent step S14 which will be described later in detail (see item (d) of FIG. 13).

In the combined functional block diagram of FIG. 14, the operations of step S10 correspond to the route beginning at the above-mentioned noise imparted 52(S0, S10).

(6) Operations of Digital Signal Processor DSP4 at Step S12

Similarly to step S2, step S12 performs operations for preparing a window functional waveform to create a second-group formant sound waveform.

The operations of step 12 are different from those of step S2 in that second-group window function waveform phase data PGw2 of the current channel is read out from the memory RAM1 of the first digital signal processor DSP1 of FIG. 5 and then sent via the rhythm sound generator 52 to the selector 50 to be selected thereby.

Like the first-group window function waveform phase data PGw1, the second-group window function waveform phase data PGw2 is processed and delayed through the delay circuit 53, arithmetic unit ALU4, delay circuit 55, overflow/underflow controller 56, delay circuit 61, log/sine table 62, delay circuit 63, selector 64 and shifter and log/linear converter 65 by a total delay time corresponding to four clock pulses. The processed and delayed data is written into the register REG4 at the timing of subsequent step S16 which will be described later in detail (see item (d) of FIG. 13).

In the combined functional block diagram of FIG. 14, the operations of step S10 correspond to the route beginning at the above-mentioned noise imparted 52(S2, S12).

(7) Operations of Digital Signal Processor DSP4 at Step S13

Step S13 performs operations for preparing a periodic function waveform corresponding to an unvoiced formant sound center frequency.

As shown in items (a) and (b) of FIG. 13, at this step S13, center frequency phase data PGu of an unvoiced formant sound is set to be fed to the A input of the arithmetic unit ALU4, while no data is set to be fed to the B input of the unit ALU4.

More specifically, center frequency phase data PGu of the current channel is read out from the memory RAM1 of the first digital signal processor DSP1 at predetermined timing and is sent, as data #RAM1 to the data bus DBUS, by way of which it is input to the fourth digital signal processor DSP4 of FIG. 7 to be fed to the selector 50 without being processed by the rhythm sound generator 52. The selector 50 is caused to selects the data #RAM1, i.e., center frequency phase data PGu.

Thus, the center frequency phase data PGu of the unvoiced formant sound is sent via the delay circuit 53 to the arithmetic unit ALU4 to pass therethrough unprocessed, and then fed to the β input of the selector 64 by way of the delay circuit 55, overflow/underflow controller 56, waveform shifter 60, delay circuit 61, log/sine table 62 and delay circuit 63.

Consequently, the selector 64 selects the data fed to the β input in response to the above-mentioned operation at step S13. Thus, the phase data PGf1 processed in the above-mentioned manner is processed in the route extending through the waveform shifter 60, delay circuit 61, log/sine table 62 and delay circuit 63 to the β input of the selector 64 and selected by the selector 64, so that the logarithmic value data of a periodic function waveform corresponding to the center frequency phase data PGu is read out from the log/sine table 62 to output.

The logarithmic value data selected by the selector 64 is passed through the shifter and log/linear converter 65 without being processed thereby, and then, after being delayed through the delay circuits 53, 55, 61, 63, written into the register REG4 at the timing of subsequent step S17 which will be described later in detail (see item (d) of FIG. 13).

In the combined functional block diagram of FIG. 14, the operations of step S13 correspond to the route of a log/sine table 62(S13), where logarithmic value data of a sine waveform is read out from the log/sine table 62(S13) in response to the value of the phase data PGu supplied from the first digital signal processor DSP1.

If formant following control flag URVF contained in parameters supplied from the microcomputer section COM of FIG. 1 is at "1", there is designated a mode where formant frequency FORM, rather than unvoiced formant frequency UFORM, is used as a center frequency for noise formant sound synthesis. In this case, the control signal generating section 6 reads out center frequency phase data PGf1 or PGf2 of formant sound, rather than the center frequency phase data of unvoiced formant sound, as center frequency phase data to be read out from the memory RAM1 of the first digital signal processor DSP1 for the operations of step S13. Thus, if the formant following control flag URVF is at "1", step S13 performs operations for preparing a periodic function waveform corresponding to an unvoiced formant sound center frequency in accordance with the center frequency phase data PGf1 or PGf2 of formant sound.

(8) Operations of Digital Signal Processor DSP4 at Step S15

Similarly to step S5, step S15 performs operations for controlling the tone volume level of frequency function waveform data corresponding to the second-group formant frequency.

As shown in items (a) and (b) of FIG. 13, at this step S15, tone volume level data LVL2 is set to be fed to the A input of the arithmetic unit ALU4, while data #REG4 is set to be fed to the B input of the unit ALU4.

More specifically, tone volume level data LVL2 in logarithmic form of the current channel is read out from the memory RAM2 of the second digital signal processor DSP2 at predetermined timing. As mentioned earlier, this tone volume level data LVL2 has been imparted an envelope waveform. The tone volume level data LVL2 is sent to the data bus DBUS, by way of which it is input to the fourth digital signal processor DSP4 of FIG. 7 to be fed as data #RAM2 to the selector 50. At step S15, the selector 50 is caused to select the data #RAM2, i.e., tone volume level data LVL2.

Meantime, the logarithmic value data of the periodic function waveform obtained at step S10 on the basis of the second-group center frequency phase data PGf2 is stored into the register REG4 at step S14, four clock pulses after step S10 and output as data #REG4 from the register REG4 at step S15. The selector 51 is caused to select this data #REG4.

Thus, the arithmetic unit ALU4 adds together the logarithmic value of the periodic function waveform of the second-group formant center frequency and the tone volume level data LVL2. From the antilogarithmic viewpoint, this is equivalent to multiplying the periodic function waveform by the tone volume level data LVL2 to thereby impart a tone volume envelope to the waveform.

The operation result of the arithmetic unit ALU4 is, after being delayed through the delay circuits 53, 54, 55 by a total delay time corresponding to two clock pulses, passed through the overflow/underflow controller 56, and output as data #4 at the timing of subsequent step S17 which will be described later (see item (c) of FIG. 13).

In the combined functional block diagram of FIG. 14, the operations of step S15 correspond to the route passing through the arithmetic unit ALU4(S5, S15), similarly to step S5.

(9) Operations of Digital Signal Processor DSP4 at Step S16

Step S16 performs operations for controlling the tone volume level of correlative noise signal BWR.

As shown in items (a) and (b) of FIG. 13, at this step S16, tone volume level data for noise LVLu is set to be fed to the A input of the arithmetic unit ALU4, while correlative noise signal BWR is set to be fed to the B input of the unit ALU4.

More specifically, tone volume level data LVLu in logarithmic form of the current channel is read out from the memory RAM2 of the second digital signal processor DSP2 at predetermined timing. This tone volume level data LVLu is sent to the data bus DBUS, by way of which it is input to the fourth digital signal processor DSP4 of FIG. 7 to be fed as data #RAM2 to the selector 50 thereof. At step S16, the selector 50 is caused to select the data #RAM2, i.e., tone volume level data for noise LVLu.

Meantime, correlative noise signal BWR of the current channel is read out from the memory RAM3 of the third digital signal processor DSP3 at predetermined timing. The read-out signal BWR is converted into logarithmic form, delayed through the delay circuit 43 of FIG. 6 by a predetermined time and then sent as data #RAM3L to the data bus DBUS, by way of which it is input to the fourth digital signal processor DSP4 of FIG. 7 to be fed to the selector 51 thereof. At step S16, the selector 51 is caused to select the data #RAM3L, i.e., correlative noise signal BWR of the current channel.

Thus, the correlative noise signal BWR in logarithmic form is added to the tone volume level data LVLu by the arithmetic unit ALU4. From the antilogarithmic viewpoint, this addition is equivalent to multiplying the correlative noise signal BWR by the tone volume level data LVLu to thereby impart a tone volume envelope to the signal BWR.

The operation result of the arithmetic unit ALU4 is, after being delayed through the delay circuit 55 by a one-clock-pulse time, passed via the overflow/underflow controller 56 to the selector 50 as data #4 at the timing of subsequent step S18 which will be described later (see item (c) of FIG. 13).

In the combined functional block diagram of FIG. 14, the operations of step S16 correspond to the route along which the correlative noise signal BWR from the third digital signal processor DSP3 and the tone volume level data LVLu from the second digital signal processor DSP2 are added together by an arithmetic unit ALU(S16).

(10) Operations of Digital signal processor DSP4 at Step S17

Similarly to step S7, step S17 performs operations for multiplying the periodic function waveform having the controlled tone volume envelope corresponding to the formant center frequency by the pitch corresponding window function waveform, in order to generate a second-group formant sound waveform.

As shown in items (a) and (b) of FIG. 13, at this step, data #4 is set to be fed to the A input of the arithmetic unit ALU4, while data #REG4 is set to be fed to the B input of the unit ALU4.

More specifically, the logarithmic value data of the periodic function waveform having the controlled tone volume envelope corresponding to the formant center frequency which has been processed at step 15 is output as data #4 at step S17, two clock pulses after step S15, and the selector 50 selects this data #4. Meantime, the logarithmic value data of the window function waveform obtained at step S12 on the basis of the second-group window function waveform phase data PGw2 is stored at step S16, four clock pulses after step S12, and the selector 51 selects this data #REG4.

Thus, the arithmetic unit ALU4 adds together the logarithmic values of the periodic function waveform and window function waveform. From the antilogarithmic viewpoint, this is equivalent to multiplying the periodic function waveform corresponding to the formant center frequency function by the pitch-corresponding window function waveform to thereby perform an amplitude modulation operation for synthesizing a second-group formant waveform signal.

Consequently, the selector 64 selects the data fed to the α input in response to the above-mentioned operation at step S17. Thus, the amplitude modulation result (logarithmic value) of the arithmetic unit ALU4 is sent, via the delay circuit 55, overflow/underflow controller 56 and delay circuit 57, to the log/linear converter 58 where it is converted into an antilogarithmic value. The resultant converted antilogarithmic value is output from the selector 64 by way of the delay circuit 59. The antilogarithmic value data output from the selector 64, i.e., the result of the above-mentioned amplitude modulation operation is passed through the shifter and log/linear converter 65 without being processed thereby, and is, after being delayed by a total delay time corresponding to four clock pulses, written into the register REG4 at the timing of step S0 of the next channel (see item (d) of FIG. 13).

An example of the second-group periodic function waveform based on the second-group formant center frequency phase data PGf2 is shown in item (b) of FIG. 18, and an example of the second-group window function waveform based on the second-group window function waveform phase data PGw2 is shown in item (d) of FIG. 18. Item (f) of FIG. 18 shows an example of the second-group formant sound waveform generated by multiplying these waveforms. The pitch of the second-group formant sound waveform is also a half of the normal pitch based on the pitch frequency number data (1/f0); the period of the second-group formant sound waveform is twice as great as the normal period.

In the combined functional block diagram of FIG. 14, the operations of step S17 correspond to the route beginning at an arithmetic unit ALU4(S7, S17).

(11) Operations of Digital Signal Processor DSP4 at Step S18

Step S18 performs operations for multiplying a periodic function waveform corresponding to a center frequency by the correlative noise signal BWR having a controlled tone volume envelope, in order to generate a noise formant sound waveform.

As shown in items (a) and (b) of FIG. 13, at this step, data #4 is set to be fed to the A input of the arithmetic unit ALU4, while data #REG4 is set to be fed to the B input of the unit ALU4.

More specifically, the logarithmic value data of the correlative noise signal BWR processed at step S16 is output as data #4 at step S18, two clock pulses after step S16, and the selector 50 is caused to select this data #4. Meantime, the logarithmic value data of the periodic function waveform corresponding to the noise-synthesizing center frequency obtained at step S13 is stored into the register REG4 at step S17, four clock pulses after step S13, and output as data #REG4 from the register REG4 at step S18. The selector 51 is caused to select this data #REG4.

Thus, the arithmetic unit ALU4 adds together the logarithmic value of the periodic function waveform corresponding to the noise synthesizing center frequency and the logarithmic value data of the correlative noise signal BWR. From the antilogarithmic viewpoint, this addition is equivalent to multiplying the periodic function waveform by the correlative noise signal BWR to thereby perform a process for generating a signal obtained by amplitude-modulating the periodic function waveform with the correlative noise signal BWR. In this manner, a noise formant sound is synthesized.

Consequently, the selector 64 selects the data fed to the α input in response to the above-mentioned operation at step S18. Thus, the amplitude modulation result (logarithmic value) of the arithmetic unit ALU4 is sent, via the delay circuit 55, overflow/underflow controller 56 functioning as a limiter and delay circuit 57, to the log/linear converter 58 where it is converted into an antilogarithmic value. The resultant converted antilogarithmic value is output from the selector 64 by way of the delay circuit 59. The antilogarithmic value data output from the selector 64, i.e., the result of the above-mentioned amplitude modulation operation is passed through the shifter and log/linear converter 65 without being processed thereby, and sent to the memory RAM4 by way of the delay circuit 67. Then, the amplitude modulation result in antilogarithmic form is, after being delayed by a total delay time corresponding to five clock pulses, written into the storage area, for noise formant sound waveform data TRu of the current channel, of the memory RAM4 at the timing of step S2 of the next channel (see item (e) of FIG. 13).

In the combined functional block diagram of FIG. 14, the operations of step S18 correspond to the route passing through an arithmetic unit ALU4(S18), where the arithmetic unit ALU4(S18) corresponds to the arithmetic unit ALU4 of FIG. 7, a limiter 56(S18) corresponds to the overflow/underflow controller 56 of FIG. 7, a log/linear converter 58(S18) corresponds to the log/linear converter 58 of FIG. 7, and a register RAM4(S18) corresponds to the RAM4 of FIG. 7. A selector SEL1 corresponds to the function to select a periodic function waveform corresponding to the center frequency based on the formant following control flag URVF. That is, if the formant following control flag URVF is at "0", the elector SEL1 selects the periodic function waveform data corresponding to the unvoiced formant frequency phase data PGu from the route of the log/sine table 62(S13) and gives the selected data to the arithmetic unit ALU4(S18). However, if the formant following control flag URVF is at "1", the elector SEL1 selects the periodic function waveform data corresponding to the formant frequency phase data PGf1 or PGf2 passed from the route of the shifter and linear/log converter 60&62(S0, S10) and gives the selected data to the arithmetic unit ALU4(S18).

(12) Operations of Digital Signal Processor DSP4 at Step S20

In combination with step S1 of the next channel, step S20 performs operations for generating final formant sound waveform data by adding together first and second formant sound waveforms.

As shown in items (a) and (b) of FIG. 13, at this step S20, no data is set to be fed to the A input of the arithmetic unit ALU4, while first-group waveform data TR1 is set to be fed to the B input of the unit ALU4.

More specifically, waveform data TR1 of the current channel (i.e., first-group formant sound waveform data) is read out from the memory RAM4 at predetermined timing and then sent via the delay circuit 68 to the selector 51 to be selected thereby. No data is selected by the selector 50.

Thus, the first-group waveform data TR1 is passed through the delay circuit 54 and arithmetic unit ALU4 without being processed by the unit ALU4. Then, the waveform data TR1 is, after being delayed through the delay circuits 54, 55 by a total delay time corresponding to two clock pulses, passed through the overflow/underflow controller 56, and output as data #4 at the timing of step S1 of the next channel (see item (c) of FIG. 13).

(13) Operations of Digital Signal Processor DSP4 at Step S1 of Next Channel

As shown in items (a) and (b) of FIG. 13, at this step S1, data #4 is set to be fed to the A input of the arithmetic unit ALU4, while data #REG4 is set to be fed to the B input of the unit ALU4.

More specifically, the waveform data TR1 (first-group formant sound waveform data) read out at step S20 of the preceding channel is output as data #4 at step S1, two clock pulses after step S20, and the selector 50 is caused to select this data #4. Meantime, the second-group formant sound waveform data obtained at step S17 of the preceding channel is stored into the register REG4 at step S0, four clock pulses after step S17, and output as data #REG4 from the register REG4 at step S1 of the current channel. The selector 51 is caused to select this data #REG4.

Thus, the arithmetic unit ALU4 adds together the first- and second-group formant sound waveform data to provide a final formant sound waveform.

In response to the above-mentioned operation at step S1, the selector 64 selects the data fed to the 7 input. In addition, the overflow/underflow controller 56 functions as a limiter, and the shifter and log/linear converter 65 is caused to allow the fed data to pass therethrough without being processed thereby. Consequently, the final synthesized formant sound waveform data output from the arithmetic unit ALU4 is sent, via the delay circuit 55, overflow/underflow controller 56 and selector 64, to the shifter and log/linear converter 65 to pass therethrough without being processed thereby, and then stored into the storage area, for waveform data TR2 of the current channel, of the memory RAM4 at the timing of step S4, three clock pulses after step S1 (see item (e) of FIG. 13).

An example of the synthesized formant sound waveform finally obtained by adding the two-group formant waveforms is shown in item (g) of FIG. 18. As shown, the synthesized formant sound waveform having a pitch corresponding to the normal pitch (1/f0) based on the pitch frequency number data is obtained by adding the first- and second-group formant sound waveforms (items (e) and (f) of FIG. 18) which have been combined via modulation based on window function waveforms phase shifted from each other by 180° and each of which has a frequency of ½f0. The resultant synthesized formant sound waveform is stored into the storage area, for waveform data TR2 of the current channel, of the memory RAM4.

As a modification of the operations of steps S20 and S1, only the second-group formant sound waveform data may be stored into the storage area, for waveform data TR2, of the memory RAM4, without being added with the first-group formant sound waveform data. In such a case, the first-group formant sound waveform data will be stored into the storage area, for waveform data TR1, of the memory RAM4, while the second-group formant sound waveform data will be stored into the storage area for waveform data TR2.

In the combined functional block diagram of FIG. 14, the operations of steps S20 and S1 correspond to the route of a register ALU4&RAM4(S17, S20, S1), where the first- and second-group formant sound waveform data from the log/linear converter 58(S7, S17) are added and retained in the register ALU4&RAM4(S17, S20, S1). The route of register ALU4&RAM4(S17, S20, S1) corresponds to the operations of the arithmetic unit ALU4 and memory RAM4.

Example of Formant Sound Mixing Operations of Digital Signal Processor DSP1

Referring back to FIGS. 5 and 9, an example of the "mixing operations" of the first digital signal processor DSP1 will be described.

(1) Operations of Digital Signal Processor DSP1 at Step S11

At step S11, operations are performed for mixing synthesized formant sound waveform data of the individual channels into the left speaker of the sound system SS.

As shown in items (a) and (b) of FIG. 13, at this step S11, waveform data TR2 is set to be fed to the A input of the arithmetic unit ALU4 of FIG. 5, while data MIXL is set to be fed to the B input of the unit ALU4.

More specifically, waveform data TR2 of the current channel (final formant sound waveform data obtained by adding the first- and second-group formant sound waveform data) is read out from the memory RAM4 of the fourth digital signal processor DSP4 (FIG. 7) at predetermined timing. The read-out data TR2 is sent to the data bus DBUS and then fed as data #RAM4 to the selector 10 of FIG. 5. Also, left level control data read out from the pan table 21 in accordance with parameter PAN that designates panning of a formant sound is sent via the selector 22 to the controller 23. The above-mentioned waveform data TR2 selected by the selector 10 is shifted by the log/linear converter and shifter 14 under the control of the controller 23 responsive to the left level control data (i.e., the data TR2 is controlled in level in accordance with the left level control data), and then fed to the A input of the arithmetic unit ALU1 by way of the delay circuit 15.

Meantime, left tone mix data MIXL is read out from the memory RAM1 of the first digital signal processor DSP1 and then fed as data #RAM1 to the selector 11 of FIG. 5 to be selected thereby. The selected data MIXL is passed through the log/linear converter and shifter 16 without being processed thereby and then fed to the B input of the arithmetic unit ALU1 by way of the delay circuit 17.

Thus, the arithmetic unit ALU1 adds together the synthesized formant sound waveform data of the current channel having been controlled in the left level by the left level control data and the left tone mix data MIXL. The addition result of the arithmetic unit ALU1 is, after being delayed through the delay circuits 15, 17, 18, 19, 24 by a total delay time corresponding to four clock pulses, passed via the output controller 20 to the memory RAM1 to be stored into a storage area for left tone mix data MIXL thereof at the timing of step S15 of FIG. 9 (see item (e) of FIG. 9). Thus, with the operations of step S11 of FIG. 9 performed for each of the channels, sample values of the synthesized formant sound waveform data of the channels, having the left level controlled for the purpose of panning, are sequentially summed to be stored into the storage area, for left tone mix data MIXL, of the memory RAM1.

(2) Operations of Digital Signal Processor DSP1 at Step S12

At step S12, operations are performed for mixing synthesized formant sound waveform data of the individual channels into the right speaker of the sound system SS, in a similar manner to step S11.

The operations of step S12 are different from those of step S11 in that right level control data is read out from the pan table 21 in accordance with parameter PAN designating panning of a formant sound is sent via the selector 22 to the controller 23 and in that right tone mix data MIXR is read out from the memory RAM1 and selected by the selector 11.

Thus, the arithmetic unit ALU1 adds together the synthesized formant sound waveform data of the current channel having been controlled in the right level by the right level control data and the right tone mix data MIXR. The addition result of the arithmetic unit ALU1 is, after being delayed through the delay circuits 15, 17, 18, 19, 24 by a total delay time corresponding to four clock pulses, passed via the output controller 20 to the memory RAM1 to be stored into a storage area for right tone mix data MIXR thereof at the timing of step S16 of FIG. 9 (see item (e) of FIG. 9). Thus, with the operations of step S12 of FIG. 9 performed for each of the channels, sample values of the synthesized formant sound waveform data of the channels, having the right level controlled for the purpose of panning, are sequentially summed to be stored into the storage area, for right tone mix data MIXR, of the memory RAM1.

(3) Operations of Digital Signal Processor DSP1 at Step S19

At step S19, left level control is performed on noise formant sound waveform data of the individual channels and the thus-controlled waveform data are mixed into the left speaker of the sound system SS in a similar manner to step S11.

The operations of step S19 are different from those of step S11 in that noise waveform data (noise formant sound waveform data) TRu of the current channel is read out from the memory RAM4 of the fourth digital signal processor DSP4 transferred to the first digital signal processor DSP1 via the data bus DBUS to be selected by the selector 10 and in that left level control data for noise is read out from the pan table 21 in accordance with parameter uPAN designating panning of an unvoiced formant sound is sent via the selector 22 to the controller 23. Further, the left tone mix data MIXL written in the memory RAM1 at step S15 is read out and fed as data #RAM1 to the selector 11.

Thus, the arithmetic unit ALU1 adds together the noise waveform data TRu having been controlled in the left level by the left level control data and the left tone mix data MIXL. The addition result of the arithmetic unit ALU1 is, after being delayed through the delay circuits 15, 17, 18, 19, 24 by a total delay time corresponding to four clock pulses, passed via the output controller 20 to the memory RAM1 to be stored into a storage area for left tone mix data MIXL thereof at the timing of step S3 of the next channel (see item (e) of FIG. 9).

(4) Operations of Digital Signal Processor DSP1 at Step S20

At step S20, right level control is performed on noise formant sound waveform data of the individual channels and the thus-controlled waveform data are mixed into the right speaker of the sound system SS in a similar manner to step S12.

The operations of step S20 are different from those of step S19 in that the right tone mix data MIXR is read out from the memory RAM1 and selected by the selector 11.

Thus, the arithmetic unit ALU1 adds together the waveform data TRu having been controlled in the right level in accordance with the parameter uPAN and the right tone mix data MIXR. The addition result of the arithmetic unit ALU1 is, after being delayed through the delay circuits 15, 17, 18, 19, 24 by a total delay time corresponding to four clock pulses, passed via the output controller 20 to the memory RAM1 to be stored into a storage area for right tone mix data MIXR thereof at the timing of step S4 of the next channel (see item (e) of FIG. 9).

The respective values of the left and right tone mix data MIXL and MIXR are updated each time one-sample data values of the formant sound waveform data and noise waveform data for all the channels are summed.

Although the synthesized formant sound waveform data obtained by adding together the first- and second-group formant sound waveform data has been described above as being stored into the storage area, for waveform data TR2, of the memory RAM4, the data may be summed after the three waveform TR1, TR2 and TRu have been separately level-controlled for panning, in the case where only the second-group formant sound waveform data is stored in the storage area for waveform data TR2 as in the above-mentioned modification.

In the combined functional block diagram of FIG. 14, the operations of steps S11, S12, S19 and S20 of FIG. 9 correspond to the route of a digital mixer 14&ALU1&RAM1(S11, S12, S19, S20), where a selector SEL2 corresponds to the function of selectively reading out the waveform data TR2 from a register RAM4(S17, S20, S1), i.e., the memory RAM4 of the fourth digital signal processor DSP4 and sending the read-out data to the first digital signal processor DSP1 for the mixing operations.

As has been so far described, tone waveform data (left and right tone mix data MIXL and MIXR) is prepared in accordance with the formant sound synthesis method through the cooperation of the digital signal processors DSP1 to DSP4 and then stored into the memory RAM1 of the first digital signal processor DSP1. The thus-prepared tone waveform data (MIXL and MIXR) is then read out from the memory RAM1 of the first digital signal processor DSP1 at predetermined timing and sent to the digital-to-analog converter DAC by way of the data bus DBUS and interface DIF.

Exemplary Operations of Digital Signal Processor DSP1 Related to FM Synthesis Now, a description will be made about exemplary operations performed when tone waveform synthesis is conducted in accordance with the FM synthesis method through the cooperation of the digital signal processors DSP1 to DSP4. However, such operations of the second and third digital signal processors DSP2 and DSP3 will not be described here because they run the same microprograms in this method as in the above-mentioned formant sound synthesis method. In the following description as well, it is assumed that two operation elements are used as FM (frequency modulation) waveform operation elements, which will be called first and second FM operators OP1 and OP2.

For example, in one FM operation algorithm, the first FM operator OP1 generates a modulating wave signal, while the second FM operator OP2 performs a frequency modulation operation of a carrier wave signal with the modulating signal and an operation to generate a modulated waveform signal based on the modulation result. For convenience of description, the waveform generated by the first FM operator OP1 will be referred to as a modulating wave, and the waveform generated by the second FM operator OP2 will be referred to as a carrier wave, although the meaning of these words should not be taken so strictly; namely, in another FM operation algorithm, the output from one FM operator may sometimes not modulate the output from the other FM operator, or the output waveform data of one FM operator may sometimes modulate phase of the same FM operator. In some case, the waveform generated by the first operator FM OP1 may be phase-modulated with the output waveform of the second FM operator OP2.

As a rule, the first digital signal processor DSP1 executes operations to generate phase data by means the first and second FM operators OP1 and OP2, and the fourth digital signal processor DSP4 executes operations to generate a modulating wave waveform and modulate carrier-wave phase the basis of the phase data generated by the FM operators OP1 and OP2 and to generate a waveform on the basis of modulated phase data.

An FM operation algorithm to be executed is designated by the above-mentioned tone synthesizing algorithm parameter. If, for example, the parameter ALG is of value other than "0", it indicates that tone synthesis operations are to be performed in accordance with the FM synthesis method, so that a predetermined FM operation algorithm is selected depending on the current value ("1" or "2") of the parameter ALG. In the following examples, all FM operation algorithms may be implemented by use of common microprograms for FM synthesis in such a manner that the individual FM operation algorithms can be realized by only changing data to be used in operations at predetermined steps.

FIG. 15 illustrates exemplary operations performed at various microprogram steps in the first digital signal processor DSP1. The signal processor DSP1 performs the "phase operations" and "mixing operations" as in the example of FIG. 9, and such operations will not be described in detail here to avoid unnecessary duplication, because the operations of FIG. 15 will be clearly understood by reference to the foregoing description of the formant sound synthesis method of FIG. 9. Further, the functions performed by the first digital signal processor DSP1 on the basis of the program of FIG. 15 generally correspond to those shown in FIG. 10. But, it should be appreciated that step numbers noted in parentheses at the end of the corresponding circuit elements correspond to the program of FIG. 9, and do not necessarily correspond to the program of FIG. 15.

In FIG. 15, steps S0, S3 and S6 are directed to control to change pitch frequency number FNUM, so as to prepare a frequency number, i.e., modulating wave frequency number for the first FM operator OP1. Step S9 is directed to accumulating the frequency numbers obtained for the first FM operator OP1 at steps S0 to S6, so as to prepare progressive phase data (i.e., modulating wave phase data) PGf1 for the operator OP1.

Further, steps S2, S5 and S8 are directed to changing a frequency number based on pitch frequency number FNUM, so as to prepare a frequency number, i.e., carrier wave frequency number for the second FM operator OP2. Step S16 is directed to accumulating the frequency numbers obtained for the second FM operator OP2 at steps S2 to S8, so as to prepare progressive phase data (i.e., carrier wave phase data) PGf2 for the FM operator OP2. For convenience of description, the phase data PGf1 and PGf2 for the first and second FM operators OP1 and OP2 are denoted by the same reference characters as the center frequency phase data PGf1 and PGf2, although they are different in contents.

Except for the above-mentioned steps, step procedures in the "phase operations" of FIG. 15 are generally the same as those of FIG. 9 (Although there are several steps for preparing data unnecessary for the FM synthesis, the results are not used in the FM synthesis and hence no substantial problems amy be involved). Step procedures in the "mixing operations" are also generally the same as those of FIG. 9.

Therefore, particular descriptions will be made hereinbelow about operations at steps S0, S3 and S6; operations at step S9 based on the results of steps S0, S3 and S6; operations at steps S2, S5 and S8, and operations at step S16 based on the results of steps S2, S5 and S8.

(1) Operations of Digital Signal Processor DSP1 at Steps S0, S3 and S6

In FIG. 15, steps S0, S3 and S6 execute control to change pitch frequency number FNUM in accordance with completely the same procedures as steps S0, S3 and S6 of FIG. 9. It is a matter of course that these steps produce data completely different from those prepared by the corresponding steps of the formant sound synthesis because they use entirely different data. Namely, although steps S0, S3 and S6 of FIG. 15 follow completely the same procedures as steps S0, S3 and S6 of FIG. 9 to change a frequency number based on the pitch frequency number FNUM, they generate a frequency number for the first FM operator OP1, i.e., modulating wave frequency number based on pitch frequency number FNUM.

First, at step S0, control is performed for, in accordance with attack glide data AG, changing pitch frequency number FNUM designating a pitch of tone to be generated. As in the foregoing case, "channel synchronization operation" is performed depending on the value of the channel synchronization flag RBP (that is, FNUMn or FNUMn−1 is used as the pitch frequency number FNUM).

As in FIG. 9, next step S3 performs operations to convert the changed pitch frequency number FNUM into an antilogarithmic value by means of the log/linear converter and shifter 14 of FIG. 5. The converted result is output via the output controller 20 of FIG. 5 at step S6 to be stored into the register REG1 and then immediately fed as data #REG1 to the selectors 10 and 11.

In this way, at step S6, the pitch frequency number FNUM converted into an antilogarithmic value at step S3 is fed as data #REG1 to the selectors 10 and 11 to be selected thereby, and the selected data are applied to the A input and B input, respectively, of the arithmetic unit ALU1. Also, at this step S6, frequency multiplication parameter MULT1 is applied to the controller 23 via the selector 22. Thus, under the control of the controller 23 based on the parameter MULT1, the log/linear converter and shifters 14 and 16 perform shifting by a predetermined number of places, and positive/negative sign inversion. As previously mentioned, this is for the purpose of performing an arithmetic operation of an optional multiplication factor, except for two, such as three, five, six or seven.

In this manner, frequency number data of a frequency determined by increasing the tone pitch frequency by a factor designated by the parameter MULT1 is generated as a modulating wave frequency number. The modulating wave frequency number data increased to a value corresponding to the desired multiplication factor is delayed through the delay circuits 15, 17, 18 and 19 by a total delay time corresponding to three clock pulses and then written via the output controller 20 into the register REG1 at the timing of subsequent step S9 which will be described later in detail.

The operations of steps S0, S3 and S6 correspond to the route leading from a vibrato data generator 12*a*(S0) to the arithmetic unit ALU1(S6) in the combined functional block diagram of FIG. 10.

(2) Operations of Digital signal processor DSP1 at Step S9

As shown in items (a) and (b) of FIG. 15, at step S9, data #REG1 is set to be fed to the A input of the arithmetic unit ALU1, and the current value (i.e., latest accumulated value) of modulating wave phase data PGf1 is set to be fed to the B input of the arithmetic unit ALU1.

More specifically, in the example of FIG. 5, the pitch frequency number data obtained at step S6 is stored into the register REG1 at this step S9, three clock pulses after step S6 (see item (d) of FIG. 15), and is then immediately output from the register REG1 as data #REG1. The selector 10 selects the data #REG1, which is then passed through the log/linear converter and shifter 14 without being processed thereby, and then sent via the delay circuit 15 to the A input of the arithmetic unit ALU1. Meanwhile, at this step S9, the current value (i.e., latest accumulated value) of modulating wave phase data PGf1 of the current channel is read out from the memory RAM1 and then sent as data #RAM1 to the selector 11. The selector 11 is caused to select the readout data #RAM1. The modulating wave phase data PGf1 selected by the selector 11 is then passed through the log/linear converter and shifter 16 without being process thereby and fed to the B input of the arithmetic unit ALU1 by way of the delay circuit 17.

Thus, the modulating wave frequency number is added to the current value of modulating wave phase data PGf1 by the arithmetic unit ALU1, so that the value of modulating wave phase data PGf1 is incremented by a value corresponding to the modulating wave frequency number. The addition result of the unit ALU1 is, after being delayed through the delay circuits 15, 17, 18, 19 and 24 by a total delay time corresponding to four clock pulses, stored via the output controller 20 into the storage area, for modulating wave phase phase data PGf1 of the current channel, of the memory RAM1 at the timing of subsequent step S13 which will be described later.

In the combined functional block diagram of FIG. 10, the functional blocks of this step S9 correspond to a portion for generating the phase data PGf1 in the route leading from the arithmetic unit ALU1(S6) through the selector SEL1 to a phase generator ALU1&RAM1(S13, S16). The selector SEL1 has the selecting function to select and cause the output of the arithmetic unit ALU1(S6) to be accumulated in the phase generator ALU1&RAM1(S13, S16).

(3) Operations of Digital Signal Processor DSP1 at Steps S2, S5 and S8

In FIG. 15, steps S2, S5 and S8 execute control to change pitch frequency number FNUM in accordance with completely the same procedures as steps S0, S3 and S6 described above. These steps produce data completely different from those prepared by steps S0, S3 and S6 because they use entirely different data. Namely, although steps S2, S2 and S8 of FIG. 15 follow completely the same procedures as steps S0, S3 and S6 to change a frequency number based on the pitch frequency number FNUM, they generate a frequency number for the second FM operator OP2, i.e., carrier wave frequency number as a changed pitch frequency number FNUM.

First, similarly to steps S0 and S3, at steps S2 and S5, control is performed for, in accordance with attack glide data AG, changing pitch frequency number FNUM designating a pitch of tone to be generated.

At step S8, the pitch frequency number FNUM converted into an antilogarithmic value at step S5 is fed as data #REG1 to the selectors 10 and 11 to be selected thereby, and the selected data are applied to the A input and B input, respectively, of the arithmetic unit ALU1, in a similar manner to step S6. Also, at this step S8, frequency multiplication parameter MULT2 is applied to the controller 23 via the selector 22. Thus, under the control of the controller 23 based on the applied parameter MULT2, the log/linear converter and shifters 14 and 16 perform shifting by a predetermined number of places, and positive/negative sign inversion. As previously mentioned, this is for the purpose of performing an arithmetic operation of an optional multiplication factor, except for two, such as three, five, six or seven.

In this manner, frequency number data of a frequency determined by increasing the pitch frequency of tone by parameter MULT2 is generated as a carrier wave frequency number. The carrier wave frequency number data increased to a value corresponding to the desired multiple is delayed through the delay circuits 15, 17, 18 and 19 by a total delay time corresponding to three clock pulses and then written via the output controller 20 into the register REG1 at the timing of subsequent step S11 which will be described later (see item (d) of FIG. 15).

The operations of steps S2, S5 and S8 correspond to the route leading from the vibrato data generator 12*a*(S0) to the arithmetic unit ALU1(S6) in the combined functional block diagram of FIG. 10.

(4) Operations of Digital Signal Processor DSP1 at Step S16

As shown in items (a) and (b) of FIG. 15, at step S16, data #REG1 is set to be fed to the A input of the arithmetic unit ALU1, and the current value (i.e., latest accumulated value) of carrier wave phase data PGf2 is set to be fed to the B input of the arithmetic unit ALU1.

More specifically, in the example of FIG. 5, the carrier wave frequency number data stored into the register REG1 at step S11 and is output from the register REG1 as data #REG1 to be fed to the selector 10 which, at step 16, is caused to select the data #REG1. The data #REG1 selected by the selector 10 is passed through the log/linear converter and shifter 14 without being processed thereby, and then sent via the delay circuit 15 to the A input of the arithmetic unit ALU1. Meanwhile, at this step S16, the current value (i.e., latest accumulated value) of carrier wave phase data PGf2 of the current channel is read out from the memory RAM1 and then sent as data #RAM1 to the selector 11. The selector 11 is caused to select the read-out data #RAM1. The carrier wave phase data PGf2 selected by the selector 11 is then passed through the log/linear converter and shifter 16 without being process thereby and fed to the B input of the arithmetic unit ALU1 by way of the delay circuit 17.

Thus, the carrier wave frequency number is added to the current value of carrier wave phase data PGf2 by the arithmetic unit ALU1, so that the value of carrier wave phase data PGf2 is incremented by a value corresponding to the carrier wave frequency number. The addition result of the unit ALU1 is, after being delayed through the delay circuits 15, 17, 18, 19 and 24 by a total delay time corresponding to four clock pulses, stored via the output controller 20 into the storage area, for carrier wave phase data PGf2 of the current channel, of the memory RAM1 at the timing of subsequent step S20 which will be described later.

In the combined functional block diagram of FIG. 10, the functional blocks of this step S16 correspond to a portion for generating the phase data PGf2 in the route leading from the arithmetic unit ALU1(S6) through the selector SEL1 to the phase generator ALU1&RAM1(S13, S16).

(5) Operations of Digital Signal Processor DSP1 at Steps S4 and S7

Steps S4 and S7 of FIG. 15 are the same as the corresponding steps of FIG. 9, where operations are performed for preparing phase data PGu corresponding to a center frequency for noise formant. In the FM synthesis mode as well, it is possible to synthesize a noise formant sound, i.e., noise waveform data TRu. The phase data PGu for noise is stored into the storage area, for phase data PGu, of the memory RAM1 at step S11 and then used for noise formant sound synthesis in digital signal processor DSP4, in a manner similar to the above-mentioned.

In the combined functional block diagram of FIG. 10, the operations of steps S4 and S7 correspond to the route leading from a modulation data generator 12*g*(S4) to a phase generator ALU1&RAM1(S7).

(6) Operations of Digital Signal Processor DSP1 at Steps S11, S12, S19 and S20

Steps S11, S12, S19 and S20 of FIG. 15 are essentially the same as the corresponding steps of FIG. 9, where the waveform data TR1, TR2, TRu of the individual channels stored in the memory RAM1 are multiplied by the left and right level control data based on the panning parameters PAN, uPAN, and the resultant level-controlled waveform data of all the channels are summed to provide left and right mix data MIXL and MIXR.

As in the foregoing example, the "mixing operations" at these steps S11, S12, S19 and S20 correspond to the route of the digital mixer ALU1&RAM1(S11, S12, S19, S20) in the combined functional block diagram of FIG. 14.

(7) Operations of Digital Signal Processor DSP1 at Other Steps

The operations performed by the arithmetic unit ALU1 at steps S11, S12, S19 and S20 of FIG. 15 are essentially the same as those of the corresponding steps of FIG. 9 which generally concern arithmetic operations of phase data PGp1, PGp2, PGw1, PGw2. However, such operations are meaningless in the FM synthesis since no such phase are not used in the FM synthesis. For programming simplification, the program for the FM synthesis partly overlap the program for the formant sound synthesis in the present embodiment, and thus FM synthesis program completely devoid of these step operations may be used.

The operations of step S17 of FIG. 15 are different from those of step S17 of FIG. 9 in that the result of step S13 is stored into the storage area, for phase data PGp1, of the memory RAM1 for the following reasons. Namely, because the arithmetic operations, at step S13, of the arithmetic unit ALU1 are meaningless in the FM synthesis as mentioned above, the correct modulating wave phase data PGf1 written in the storage area for phase data PGf1 at step S13 will be undesirably spoiled if the operation result of the unit ALU1 is written into the storage area for data PGf1 as at step S17 of FIG. 9. Thus, at step S17 of FIG. 15, the result of step S13 is stored into the storage area, for phase data PGp1, of the memory RAM1 which is not actually used in the FM synthesis, in order to avoid such an inconvenience. That is, although part of the program for the formant sound synthesizing process remains undeleted for specific steps where it does not have substantial adverse effects on the FM synthesizing process, some portion of the part which may sometimes adversely influence the FM synthesizing process is rewritten at this step into another meaningless operation.

Exemplary Operations of Digital signal processor DSP4 Related to FM Synthesis FIG. 16 illustrates exemplary operations performed at various microprogram steps in the fourth digital signal processor DSP4. This digital signal processor DSP4 performs the "waveform generation operations" as in the example of FIG. 13, and such operations will not be described in detail here to avoid unnecessary duplication, because the operations of FIG. 16 will be clearly understood by reference to the foregoing description of the formant sound synthesis method of FIG. 13. Further, the functions performed by the digital signal processor DSP4 on the basis of the program of FIG. 16 generally correspond to those shown in FIG. 14. But, it should be appreciated that step numbers noted in parentheses at the end of the corresponding circuit elements correspond to the program of FIG. 13, and do not necessarily correspond to the program of FIG. 13. In FIG. 14, each functional block corresponding only to the FM synthesis step of FIG. 16 is denoted by a step number with notation "FM".

In FIG. 16, steps S0, S4, S5, S9, S11 and S14 mainly perform waveform generation operations including a self-feedback FM operation in the first FM operator OP1, and steps S10, S14, S15, S19, S19, S20, S1 and S4 mainly perform FM-synthesized waveform generation operations including FM operations in the second FM operator OP2. Further, steps S13, S16, S18 and S2 perform operations to prepare noise formant sound waveform data, as in the example of FIG. 13. As well-known in the art, the self-feedback FM operation is an operation for feeding waveform data, generated in response to specific input phase data, back to the phase input so as to modulate the input phase data. This embodiment is designed to execute such a self-feedback FM operation in the FM operator OP1.

(1) Operations of Digital Signal Processor DSP4 at Steps S0 and S4

At step S0, operations are performed for generating waveform data in the first FM operator OP1.

As shown in items (a) and (b) of FIG. 16, at this step S0, modulating wave frequency phase data PGf1 (modulating wave data) of the first FM operator OP1 is set to be fed to the A input of the arithmetic unit ALU4, while feedback waveform data FR is set to be fed to the B input of the unit ALU4.

More specifically, phase data PGf1 of the first FM operator OP1 for the current channel is read out from the memory RAM1 of FIG. 5 at predetermined timing. The read-out phase data PGf1 is sent, as data #RAM1, to the data bus DBUS, by way of which it is input to the fourth digital signal processor DSP4 of FIG. 7. Then, the data #RAM1 is sent via the rhythm sound generator 52 to the selector 50 to be selected thereby. Meantime, feedback waveform data FR of the current channel is read out from the memory RAM4 of FIG. 7 and fed as data #RAM4 to the selector 51 to be selected thereby. The memory RAM4 has a storage area for storing waveform data generated in the first FM operator OP1 as the feedback waveform data FR for use in the self feedback FM operation. Normally, in the FM synthesis mode, the rhythm sound generator 52 is not used, so that the data #RAM1 is passed to the selector 50 without being processed by the generator 52.

Thus, the arithmetic unit ALU4 adds the feedback waveform data FR to the phase data PGf1 of the first FM operator OP1. In this manner, the phase data PGf1 for waveform generation of the FM operator OP1 is modulated with a waveform generated in the same FM operator OP1 in a self-feedback fashion.

The selector 64 selects the data fed to the β input in response to the above-mentioned operation at step S0. In this way, the operation result of the arithmetic unit ALU4 is output from the selector 64 by way of the delay circuit 55, overflow/underflow controller 56, waveform shifter 61, log/sine table 62 and delay circuit 63. As previously described, the waveform shifter 60 performs a phase value changing process for a specific phase portion on the basis of parameter WF1. The parameter WF1 supplied at this step S0 is one prepared for the first FM operator OP1. Further, the log/sine table 62 reads out sine waveform data in a logarithmic value, in accordance with the phase data PGf1 for the FM operator OP1 which has been modulated in the self-feedback fashion and undergone necessary phase value conversion as mentioned above.

In the above-mentioned manner, step S0 performs the self-feedback FM operation and waveform data generation process in the first FM operator OP1.

The logarithmic waveform data (i.e., modulating wave waveform data) of the first FM operator OP1 selected at the β input of the selector 64 is passed through the shifter and log/linear converter 65 without being processed thereby, and is, after being delayed through the delay circuits 53, 55, 61, 63 by a total delay time corresponding to four clock pulses, written into the register REG4 at the timing of step S4 (see item (d) of FIG. 16).

Of course, no self-feedback FM operation is executed in some of the FM operation algorithms. In such a case, control is performed at step S0 not to read out feedback waveform data FR from the memory RAM4, or to cause no data to be selected by the selector 51. Consequently, the arithmetic unit ALU4 outputs the phase data PGf1 of the first FM operator OP1 without processing the data PGf1, so that waveform data not having undergone self-feedback FM operation is read out from the log/sine table 62.

(2) Operations of Digital Signal Processor DSP4 at Step S5

At step S5, arithmetic operations are performed for controlling the amplitude level of the waveform data from the FM operator OP1.

As shown in items (a) and (b) of FIG. 16, at this step S5, amplitude level data LVL1 is set to be fed to the A input of the arithmetic unit ALU4, while data #REG4 is set to be fed to the B input of the unit ALU4.

More specifically, amplitude level data LVL1 setting an amplitude level of the first FM operator OP1 is read out from the memory RAM2 of the second digital signal processor DSP2. The read-out level data LVL1 is sent, as data #RAM2, to the data bus DBUS, by way of which it is input to the fourth digital signal processor DSP4 of FIG. 7 and then sent to the selector 50. The selector 50 selects this data #RAM2, i.e., amplitude level data LVL1. Meantime, the logarithmic value of the waveform data from the FM operator OP1 stored in the register REG4 at step S4 is read out therefrom as data #RAM4 to be selected by the selector 51.

Thus, the arithmetic unit ALU4 adds together the logarithmic value of the waveform data from the FM operator OP1 and the amplitude level data LVL1. From the antilogarithmic viewpoint, this is equivalent to multiplying the waveform data from the first FM operator OP1 by the amplitude level data LVL1. The amplitude level data LVL1 comprises time varying envelope data, and where the waveform data from the first FM is modulating wave waveform data, the level data LVL1 functions as an amplitude controlling coefficient for the modulating wave signal, i.e., as a modulation index.

The selector 64 of FIG. 7 selects the data fed to the α input in response to the above-mentioned operation of step S5. In this way, the operation result of the arithmetic unit ALU4 is applied via the delay circuit 57 to the log/linear converter 58 to be converted into an antilogarithmic value and then output from the selector 64 by way of the delay circuit 59.

The antilogarithmic waveform data of the first operator OP1 having undergone amplitude level control and output from the selector 64 is, after being delayed through the delay circuits 53, 55, 57, 59 by a total delay time corresponding to four clock pulses, passed through the shifter and log/linear converter 65 without being processed thereby and then written into the register REG4 at the timing of step S9 (see item (d) of FIG. 16). The antilogarithmic waveform data is then further delayed through the delay circuit 67 by a one-clock-pulse time and written into the storage area, for waveform data TR1 of the current channel, of the memory RAM4 at the timing of step S10 (see item (e) of FIG. 16). The waveform data TR1 thus stored in the predetermined storage area of the memory RAM4 at the timing of step S10 corresponds to the waveform data generated in the operator OP1 of the current channel.

(3) Operations of Digital Signal Processor DSP4 at Steps S9, S11 and S14

At these steps S9, S11 and S14, operations are performed for controlling the self-feedback level of the first FM operator OP1 and also for preventing hunting (or oscillation) from being caused by the self feedback.

First, at step S9, the waveform data TR1 stored in the predetermined storage area of the memory RAM4 (corresponding to the waveform data generated in the preceding sampling cycle) is read out therefrom and fed as data #RAM4 to the selector 51 to be selected thereby. No data is selected by the selector 50. As a result, the waveform data TR1 generated in the preceding sampling cycle is sent via the delay circuit 54 to the arithmetic unit ALU4 to pass therethrough unprocessed. Then, the data TR1 is passed through the delay circuit 55 and overflow/underflow controller 56 and output as data #4 at the timing of step S11, two clock pulses after step S9 (see item (c) of FIG. 16).

At step S11, the waveform data TR1 of the first FM operator OP1 generated in the preceding sampling cycle and output as data #4 is fed to the selector 50 to be selected thereby. Also, the waveform data TR1 of the first FM operator OP1 generated in the current sampling cycle and stored in the register REG4 through the operation of step S9 is fed as data #REG4 to the selector 51 to be selected thereby. Consequently, the waveform data TR1 of the first FM operator OP1 generated in the current and preceding sampling cycles are added together by the arithmetic unit ALU4. The reason why the waveform data TR1 of the first FM operator OP1 generated in the current and preceding sampling cycles are added together is to prevent hunting (or oscillation) from being caused by the self feedback.

In response to the above-mentioned operation of step S11, the selector 64 of FIG. 7 selects the data fed to the γ input, and a feedback level controlling coefficient is generated from the controller 66 in accordance with feedback level designating parameter FBL. Thus, the shifter and log/linear converter 65 down-shifts, by one bit, the fed data by an amount corresponding to the generated feedback level controlling coefficient and then down-shifts the fed data by another bit in order to execute an averaging calculation (½ calculation) because of the hunting preventing addition. In this manner, the calculation result of the arithmetic unit ALU4 is directly output from the selector 64 by way of the delay circuit 55 and overflow/underflow controller 56, and the averaging calculation and feedback level controlling operation are performed by the down-shifting operations in the shifter and log/linear converter 65.

Resultant output data from the shifter and log/linear converter 65 is sent via the delay circuit 67 to the memory RAM4 to be stored therein and is then, after being delayed through the delay circuits 53, 54, 55, 67 by a total delay time corresponding to three clock pulses, stored into the storage area, for feedback waveform data FR of the current channel, of the memory RAM4 at the timing of step S14 (see item (e) of FIG. 6).

In the combined functional block diagram of FIG. 14, the above-described operations of steps S0, S4, S5, S9, S11 and S14 to generate the waveform data TR1 and feedback waveform data FR in the first FM operator OP1 correspond to the route along which the phase data PGf1 is sent to a noise imparted 52(S0, S10) and then stored into a register RAM4(S7) as waveform data TR1, and the route along which the waveform data TR1 is controlled in feedback level by means of a feedback level controller and register 65RAM4(S9FM, S11FM). In this case, a selector SEL2 corresponds to the function of reading out the feedback waveform data FR from the feedback level controller and register 65&RAM4(S9FM, S11FM), i.e., memory RAM4 and supplying the read-out data to the adder ALU4(S0, S10).

(4) Operations of Digital Signal Processor DSP4 at Step S10

At step S10, operations are performed for generating waveform data in the second FM operator OP2.

As shown in items (a) and (b) of FIG. 16, at this step S10, phase data PGf2 (carrier wave phase data) of the first operator OP1 is set to be fed to the A input of the arithmetic unit ALU4, while waveform data TR1 (modulating wave waveform data) is set to be fed to the B input of the unit ALU4.

More specifically, phase data PGf2 of the second operator OP2 for the current channel is read out from the memory RAM1 of FIG. 5 at predetermined timing. The read-out phase data PGf2 is sent, as data #RAM1, to the data bus DBUS, by way of which it is input to the fourth digital signal processor DSP4 of FIG. 7. Then, the data #RAM1 is sent via the rhythm sound generator 52 to the selector 50 to be selected thereby. Meantime, waveform data TR1 of the operator OP1 for the current channel is read out from the memory RAM4 of FIG. 7 and fed as data #RAM4 to the selector 51 to be selected thereby. Thus, the arithmetic unit ALU4 adds the waveform data TR1 (modulating wave waveform data) of the first FM operator OP1 to the phase data PGf2 of the second FM operator OP2 to thereby execute a frequency modulation operation.

The selector 64 selects the data fed to the β input in response to the above-mentioned operation of step S10. In this way, the operation result of the arithmetic unit ALU4 is output from the selector 64 by way of the delay circuit 55, overflow/underflow controller 56, waveform shifter 61, log/sine table 62 and delay circuit 63. As previously described, the waveform shifter 60 performs a phase value changing process for a specific phase portion on the basis of parameter WF2. The parameter WF2 supplied at this step S10 is one prepared for the second FM operator OP2. Further, the log/sine table 62 reads out sine waveform data in a logarithmic value, in accordance with the phase data PGf2 for the operator OP2 which has been frequency-modulated and undergone necessary phase value conversion as mentioned above.

In the above-mentioned manner, step S10 performs FM operation and waveform data generation process in the second FM operator OP2.

The logarithmic waveform data (i.e., FM-synthesized waveform data) of the second FM operator OP2 selected at the β input of the selector 64 is passed through the shifter and log/linear converter 65 without being processed thereby, and is, after being delayed through the delay circuits 53, 55, 61, 63 by a total delay time corresponding to four clock pulses, written into the register REG4 at the timing of step S14 (see item (d) of FIG. 16).

Of course, no FM operation is executed in some of the FM operation algorithms. In such a case, control is performed at step S10 not to read out waveform data TR1 from the memory RAM4, or to cause no data to be selected by the selector 51. Consequently, the arithmetic unit ALU4 outputs the phase data PGf2 of the second FM operator OP2 without processing the data PGf2, so that waveform data not having undergone FM operation is read out from the log/sine table 62.

(5) Operations of Digital Signal Processor DSP4 at Step S15

At step S15, arithmetic operations are performed for controlling the amplitude level of the waveform data generated in the second FM operator OP2, in a similar manner to step S5.

The procedures taken at step s15 are generally the same as those of step, except that at step S15, amplitude level data LVL2 setting an amplitude level of the second FM operator OP2 is read out from the memory RAM2 of the second digital signal processor DSP2 and selected by the selector 50 as data #RAM2 to be fed to the A input of the arithmetic unit ALU4, while the logarithmic value of the waveform data generated from the second FM operator OP2 stored in the register REG4 at step S14 is selected by the selector 51 as data #REG4 to be fed to the B input of the arithmetic unit ALU4.

Thus, the arithmetic unit ALU4 adds together the logarithmic value of the waveform data generated from the second FM operator OP2 (FM-synthesized waveform data) and the amplitude level data LVL2. From the antilogarithmic viewpoint, this is equivalent to multiplying the generated waveform data of the second FM operator OP2 by the amplitude level data LVL2. The amplitude level data LVL2 comprises time varying envelope data, and functions as a tone volume level setting data to set an output tone volume of the waveform data generated from the second FM operator OP2.

The selector 64 of FIG. 7 selects the data fed to the a input in response to the above-mentioned operation of step S15. In this way, the operation result of the arithmetic unit ALU4 is applied to the log/linear converter 58 to be converted into an antilogarithmic value, which is then output from the selector 64.

The antilogarithmic waveform data of the second FM operator OP2 having undergone amplitude level control and output from the selector 64 is, after being delayed through the delay circuits 53, 55, 57, 59 by a total delay time corresponding to four clock pulses, passed through the shifter and log/linear converter 65 without being processed thereby and then written into the register REG4 at the timing of step S19 (see item (d) of FIG. 16). The antilogarithmic generated waveform data of the second FM operator (FM synthesized waveform data) having a controlled amplitude level that has been stored in the register REG4 is subjected to arithmetic operations at step S1 for the next channel as will be later described, three clock pulses after step S15, and is stored into the storage area, for waveform data TR2 of the current channel, of the memory RAM4 at step S4, another three clock pulses after step S0 (see items (c) and (e) of FIG. 16).

(6) Operations of Digital Signal Processor DSP4 at Steps S20, S1 and S4

First, at step S20, on condition that a specific FM operation algorithm is selected, the waveform data TR1 of the first FM operator OP1 is read out from the predetermined storage area, for data TR1 of the current channel, of the memory RAM4 and fed as data #RAM4 to the selector 51 to be selected thereby. No data is fed to the A input of the arithmetic unit ALU1. Thus, the waveform data TR1 of the operator OP1 is sent via the delay circuit 54 to the arithmetic unit ALU4 to pass therethrough unprocessed. Then, the data TR1 is passed through the delay circuit 55 and overflow/underflow controller 56 and output as data #4 at the timing of step S1 of the next channel, two clock pulses after step S20 (see item (c) of FIG. 16).

At step S1 of the next channel, the data #4 (i.e., waveform data TR1 of the first FM operator OP1) is selected to be fed to the A input of the arithmetic unit ALU4, and the data #REG4 (i.e., antilogarithmic generated waveform data of the second FM operator OP2 having a controlled amplitude level and stored in the register REG4 at the timing of S19) is selected to be fed to the B input of the arithmetic unit ALU4, as shown in items (a) and (b) of FIG. 16. Consequently, the waveform data TR1 of the first FM operator OP1 and waveform data of the second FM operator OP2 are added by the arithmetic unit ALU4.

In response to the above-mentioned operation of step S1, the selector 64 of FIG. 7 selects the data fed to the γ input. Thus, the operation result of the arithmetic unit ALU4 is output from the selector 64 by way of the delay circuit 55 and overflow/underflow controller 56, passed through the shifter and log/linear converter 65 without being processed thereby, and then fed to the arithmetic unit ALU4 via the delay circuit 67. Thus, the operation result of the arithmetic unit ALU4 obtained from the operations of step S1 is, after being delayed through the delay circuits 53, 54, 55, 67 by a total delay time corresponding to three clock pulses, stored into the storage area, for waveform data TR2 of the current channel, of the memory RAM4 at the timing of step S4 (see item (e) of FIG. 6).

If, on the other hand, no specific FM operation algorithm is selected, control is performed not to read out the waveform data TR1 of the first FM operator OP1 from the memory RAM4 or to cause no data to be selected in the selector 51. Thus, at step S1, the arithmetic unit ALU4 optputs the generated waveform data of the second FM operator OP2 without changing the waveform data, which is then stored into the storage area, for waveform data TR2 of the current channel, of the memory RAM4 at the timing of step S4.

As the result, the waveform data TR2 thus stored in the predetermined storage area of the memory RAM4 will be utilized as waveform data of an FM-synthesized tone signal.

In the combined functional block diagram of FIG. 14, the above-described operations of steps S10, S14, S15, S19, S20, S1 and S4 to generate FM-synthesized waveform data in the second FM operator OP2 correspond to the route along which the phase data PGf2 is sent to the noise imparted 52(S0, S10) and then stored into a register ALU4&RAM4(S17, S20, S1) as waveform data TR2. In this case, the selector SEL2 corresponds to the function of reading out the waveform data TR1 from the register RAM4 (S7), i.e., memory RAM4 and supplying the read-out data to the adder ALU4(S0, S10).

(7) Operations of Digital Signal Processor DSP4 at Other Steps

Steps S13, S16, S18 and S2 of FIG. 16, which are similar the same number steps of FIG. 13, perform operations for preparing noise formant sound waveform data to store noise waveform data TRu of the current channel into a predetermined storage area of the memory RAM4. However, although steps 2 and S12 of FIG. 16 concern operations of window phase data PGw1 and PGw2 as at the corresponding steps of FIG. 13, these operations are meaningless in the FM synthesis since no such phase data are not used in the FM synthesis. Because the program for the FM synthesis partly overlap the program for the formant sound synthesis in the present embodiment just for programming simplification, and FM synthesis program completely devoid of these step operations may be used.

The waveform data TR2 and TRu (and also TR1 when necessary) of all the channels having been prepared in the above-mentioned FM synthesis operations in the fourth digital signal processor DSP4 and stored in the memory RAM4 thereof are read out from the memory RAM4 and transferred to the first digital signal processor DSP1 via the data bus DBUS. Thereafter, through the above-described operations of steps S11, S12, S19 and S20 of FIG. 15 performed in the digital signal processor DSP1, the tone waveform data of all the channels are summed up after having been subjected to left/right level control based on the panning parameters PAN and uPAN, and then output as left and right tone mix data MIXL and MIXR. The left and right tone mix data MIXL and MIXR are then processed by the digital-to-analog converter DAC to be ultimately supplied to the sound system.

Figure 20:
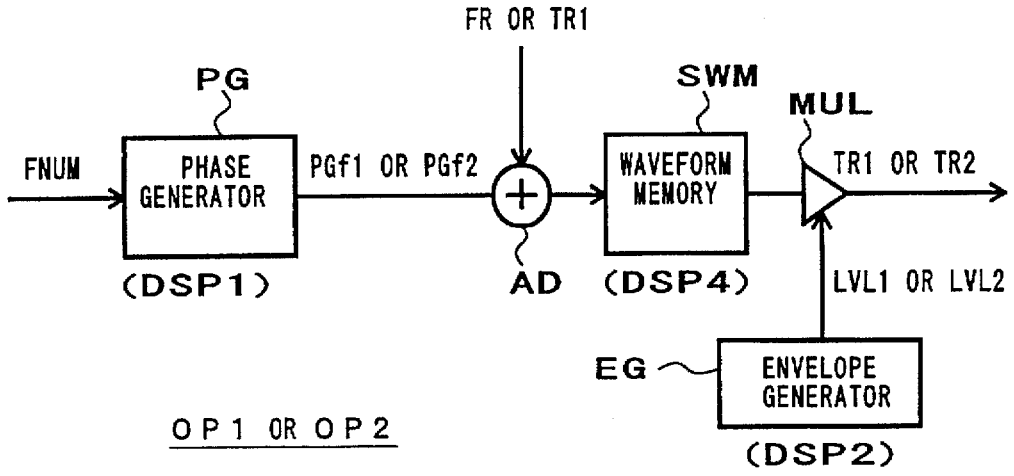
FIG. 20 is a functional block diagram schematically showing arithmetic operations performed in one FM synthesis operator implemented by predetermined ones of the digital signal processors.
Figure 21A:
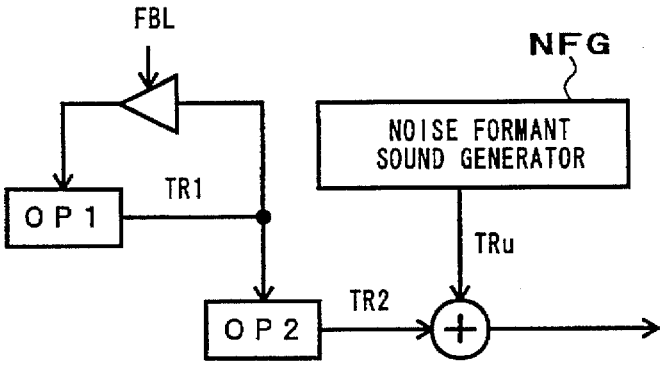
FIGS. 21A and 21B are functional block diagrams illustrating an FM synthesizing operation algorithm implemented by a combination of the FM synthesis operators.
Figure 21B:
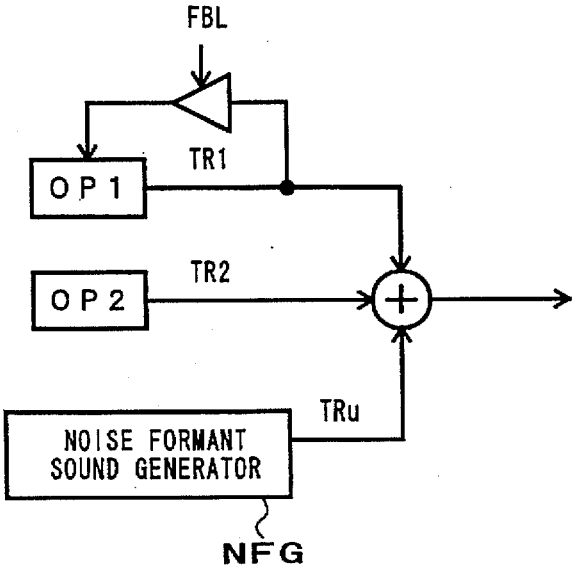

For reference, the functions of the first and second FM operators OP1 and OP2 performed through the above-described cooperations of the digital signal processors DSP1 to DSP4 are shown in FIG. 20, and FIGS. 21A and 21B show in functional block diagram exemplary FM operation algorithms.

In FIG. 20, the function of the phase generator PG for generating the phase data PGf1 or PGf2 of a modulating or carrier wave in response to the pitch frequency number FNUM is implemented by the first digital signal processor DSP1 as mentioned earlier. The functions of the portion including the adder AD for modulating the phase data PGf1 or PGf2 with the feedback waveform data FR or modulating wave waveform data TR1 and the multiplier MUL for multiplying the read-out waveform data by the amplitude level data LVL1 or LVL2 are implemented by the fourth digital signal processor DSP4 as mentioned earlier. Further, the function of the envelope generator EG for generating the amplitude level data LVL1 or LVL2 is implemented by the second digital signal processor DSP2.

FIG. 21A shows an FM operation algorithm that is designated when the tone synthesizing algorithm parameter ALG is of value "1". According to this FM operation algorithm, the first FM operator OP1 performs self-feedback FM operations and phase data PGf2 of the second FM operator OP2 is phase-modulated using, as modulating wave waveform data, waveform data TR1 generated from the operations, so that FM-synthesized waveform data is output as generated waveform data TR2 of the FM operator OP2. To this end, at step S0 of FIG. 16, feedback waveform data FR is fed to the B input of the arithmetic unit ALU4 so as to cause the first FM operator OP1 to carry out a self-feedback FM operation; at step S10, waveform data TR1 is fed to the B input of the arithmetic unit ALU4 so as to cause the second FM operator OP2 to add the waveform data TR1 to phase data PGf2; and at step 20, waveform data TR1 is not fed to the B input of the arithmetic unit ALU4 so that addition of the waveform data TR1 and TR2 is not actually executed at subsequent step S1.

In contrast, FIG. 21B shows an FM operation algorithm that is designated when the tone synthesizing algorithm parameter ALG is of value "2". According to this FM operation algorithm, the first FM operator OP1 performs self-feedback FM operations, while the second FM operator OP2 adds together the two generated waveform data TR1 and TR2 to output the sum of the data without performing FM operation. To this end, at step S0 of FIG. 16, feedback waveform data FR is fed to the B input of the arithmetic unit ALU4 so as to cause the first FM operator OP1 to carry out a self-feedback FM operation; at step S10, waveform data TR1 is not fed to the B input of the arithmetic unit ALU4 so that the second FM operator OP2 does not perform modulation of phase data PGf2; and at step 20, waveform data TR1 is fed to the B input of the arithmetic unit ALU4 so that addition of the waveform data TR1 and TR2 is actually executed at subsequent step S1.

In FIGS. 2A and 2B, a noise formant sound generating section NFG corresponds to the function of generating noise waveform data TRu in the digital signal processors DSP3 and DSP4. Further, the operation of adding the noise waveform data TRu to FM-synthesized tone waveform data corresponding to the "mixing operations" of the first digital signal processor DSP1. Of course, whether or not to add the noise waveform data TRu may be determined optionally.

It should be obvious that any other FM operation algorithm other than the above-mentioned may be implemented in any desired manner without departing from the spirit of the present invention.

[Modifications]

As has been described thus far in connection with the illustrated embodiment, the digital signal processing device performs tone waveform synthesizing operations through the cooperations of a plurality of digital signal processors DSP1 to DSP4.

While, in the above-described embodiment, various operations and processes for synthesizing digital tone waveform are allocated to four digital signal processors, they may be allocated to and performed by any plural number of digital signal processors other than four. Further, although, in the above-described embodiment, the various operations and processes for synthesizing digital tone waveform are classified into five major groups: "phase operations"; "envelope operations"; "noise operations"; "waveform generation operations"; and "mixing operations", they may be classified into other suitable groups. That is, although, in the above-described embodiment, the various operations and processes are classified into the above-mentioned five major groups and allocated to four digital signal processors DSP1 to DSP4, the manner of classifying the operations and processes and the number of digital signal processors to be employed may be determined optionally depending on the type of tonal processing to be achieved, the number of tone generation channels, the capability of the digital signal processors, etc. For example, if the number of tone generation channels is increased, a plurality of additional digital signal processors performing the same operations may be provided in correspondence to different channel groups.

Further, the signal processing device may be arranged in such a manner that the number of digital signal processors to be incorporated in one system of the present invention can be increased or decreased as desired by the user. For instance, the parameter bus PBUS and data bus DBUS of FIG. 1 may be extended so that any necessary number of digital signal processors can be added. In such a case, additional control processor (CPU) and memory of the microcomputer COM for performing parameter supply control, additional input/output interface, etc. may also be provided, in order to meet the addition of arithmetic operation functions and tone generation channels.

Furthermore, while the above-described embodiment can employ both the formant sound synthesis method and the FM synthesis method for synthesizing a tone and is designed to store the respective microprograms in the digital signal processors, the digital signal processing device may be modified in various manners; for example, there may be stored microprograms for one or more tone synthesis methods other than the above-mentioned.

Moreover, the present invention is not limited to the application where various operations and processes for synthesizing digital tone waveform are allocated to and performed by a plurality of digital signal processors. Functions for imparting various tonal effects such as reverberation, chorus and pitch change may be allocated to the digital signal processors so that impartment of various tonal effects and acoustic effects is effected through the cooperations of the processors. In such a case, digital tone signal or sound signal to be processed is introduced into the digital signal processing section, and it is of course possible to perform the digital tone waveform synthesizing process in combination with the effect imparting process. Moreover, the principle of the present invention is also applicable to devices which synthesize or process human voice or the like, as well as devices which synthesize or process effect sound such as imitation sound for use in video game, video/audio software or the like. In effect, the present invention may be applied to all types of sound signal synthesis and/or processing.

Furthermore, the microprograms may be stored in the respective microprogram supply sections 5 (FIG. 5) of the individual digital signal processors DSP1 to DSP4 in any desired fashion. For example, all necessary microprograms may be fixedly prestored in the form of gate arrays so that desired one of the prestored microprograms is selectively read out in response to a designated tone synthesizing algorithm, or the contents of microprograms to be stored may be rewritten or modified optionally under the control of the microcomputer section COM. In the case where the contents of microprograms to be stored are rewritten optionally, the microprograms do not have to be rewritten for all the steps, but only necessary program portions may be rewritten in such a manner that program portions common to the formant sound synthesis method and FM sound synthesis method or ignorable program portions as mentioned above are left unchanged. This can effectively reduce a time necessary for the program rewriting and also can also effectively save storage space because microprogram data to be prepared, for the rewriting, in the microcomputer section COM need not be data of all the steps.

In addition, although the microprogram supply section 5 is provided in each of digital signal processors DSP1 to DSP4, the microprograms corresponding to the processors DSP1 to DSP4 may be stored in common memory (or gate arrays) so that the stored microprograms are sequentially read out in response to the operation steps by use of a common program counter (or timing signal generator analogous to the program counter) and supplied to the corresponding signal processors.

In the above-described embodiment, when data prepared by one digital signal processor (e.g., DSP1) and stored in the memory RAM thereof is utilized in another digital signal processor (e.g., DSP4), necessary data read and write operations are effected in accordance with the respective microprograms of the signal processors so that the signal processors eventually cooperate with each other. However, the present invention is not limited to such an embodiment where necessary data read and write operations are effected in accordance with the respective microprograms of the signal processors; for example, when data prepared by one digital signal processor (e.g., DSP1) and stored in the memory RAM thereof is to be utilized in another digital signal processor, a data request may be given from the one processor to the other processor so that the the latter operates to read out necessary data from its memory RAM in response to the request signal and send the read-out data to the former.

[Additional Description about Channel Synchronization]

An additional description will be made hereinbelow about an example of synchronized tone generation control responsive to values of the channel synchronization flags RBP of the individual channels.

Figure 22:
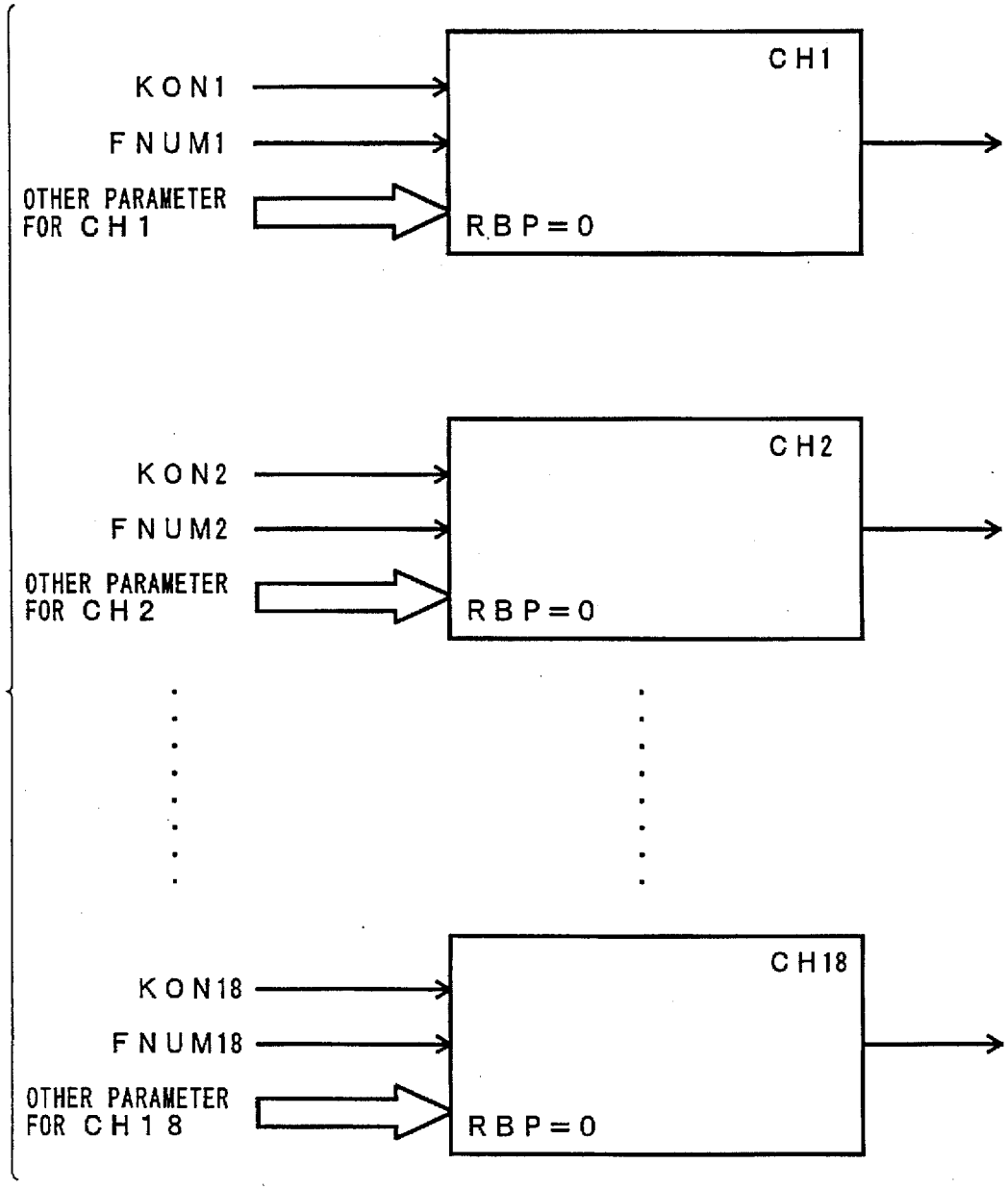
FIG. 22 is a functional block diagram illustrating an example of a channel synchronization process in connection with a case where channel synchronization flags RBP for all the channels are at a value of "0", with the channels shown as placed in parallel.
Figure 23:
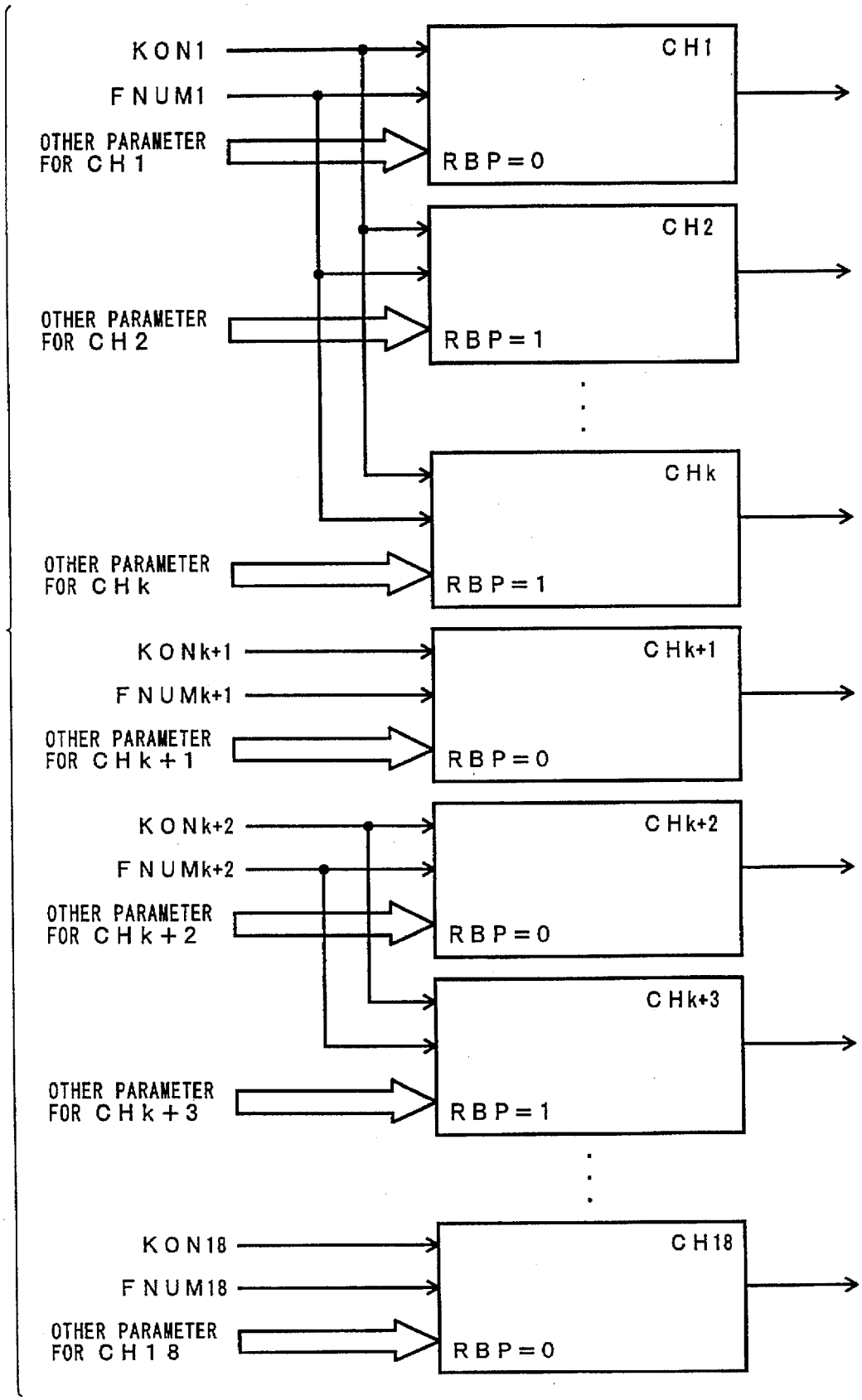
FIG. 23 is a functional block diagram illustrating another example of the channel synchronization process in connection with a case where one of the channel synchronization flags RBP is at a value of "1", with the channels shown as placed in parallel.

FIGS. 22 and 23 are conceptual functional block diagrams illustrating the tone generation channels CH1 to CH18 in parallel form which are time-divisionally realized or activated through the above-described cooperation of the digital signal processor DSP1 to DSP4.

More specifically, FIG. 22 shows a condition where the channel synchronization flags RBP for all the channels are at a value of "0", i.e., where each tone generation channel is not in a state to perform synchronized tone generation control with any other channels. "KON1" to "KON18" represent key-on signals to the tone generation channels, and "FNUM1" to "FNUM18" represent pitch frequency numbers to the tone generation channels. In this condition, the key-on signals KON1 to KON18 and pitch frequency numbers FNUM1 to FNUM18 sent via the microcomputer section COM and interface CIF are separately supplied to the corresponding channels CH1 to CH18. Other parameters corresponding to the channels CH1 to CH18 (parameters other than FNUM and KON shown in FIG. 19) are also supplied via the microcomputer section COM and interface CIF to the channels. Thus, each of the channels, on the basis of the supplied parameters, generates a tone signal, having a sound color characteristic according to a designated tone synthesizing algorithm, at an individual pitch and tone generation timing.

FIG. 23 shows a condition where the channel synchronization flags RBP for all the channels are at a value of "1", i.e., where each tone generation channel is in a state to perform synchronized tone generation control with other channels. In the illustrated example, the flag RBP for channel CH1 indicates value "0", the flag RBP for channels CH2 to CHK indicate value "1", the flag RBP for channels CHK+1 and CHk+2 indicate value "0", the flag RBP for channel CHk+3 indicates value "1", and the flag RBP for channel CH18 indicates value "0". Here, "k" represents an optional channel number.

As mentioned earlier, if the channel synchronization flag RBP is "1" for a specific channel, then the specific channel is controlled to synchronize with adjoining channel(s) of smaller channel number. Thus, in the example of FIG. 23, channel CH2 is controlled to generate a tone in synchronism with channel CH1 because the flag RBP for channel CH2 is at "1". Because the channel synchronization flag RBP is also "1" for channels CH3 to CHK, these channels CH3 to CHK are all controlled to synchronize with a smaller channel-number for which the flag RBP is of value "0" (i.e., channel CH1). Those channels CH2 to CHK, which are controlled to synchronize with channel Ch1, are all supplied with a same key-on signal KON1 and pitch frequency number FNUM1 of channel CH1 and generate tones at a same pitch and timing as channel CH1. Because other parameters (parameters other than FNUM and KON shown in FIG. 19) are supplied to channels CH1 to CHK independently of each other, the tone signals generated in the channels will be different in sound color and other tonal characteristics although the pitch and generation timing of the signals are the same. Therefore, if the formant sound synthesis method is employed in channels CH1 to CHk, a plurality of tone signals having different formant center frequencies can be generated in channels CH1 to CHk by using different formant frequency numbers FORM, although their pitch and generation timing are the same. This is equivalent to synthesizing a single tone signal of multi-formant structure. It should be obvious that the tone synthesis method employed in the channels to be synchronized may be other than the formant sound synthesis method, such as the FM synthesis method. Alternatively, the two methods may be employed in combination in such a manner that the formant sound synthesis method is employed in some of the channels and the FM synthesis method is employed in the other channels. In such a case as well, it is possible to easily synthesize a tone signal having a combination of two or more harmonic components.

Further, because, in the example of FIG. 23, the flag RBP is of value "0" for channels CHk+1 and CHk+2, these channels CHk+1 and CHk+2. are controlled to generate tones independently of each other on the basis of their own key-on signals KONk+1 and KONk+2 and pitch frequency numbers FNUMk+1 and FNUMk+2, etc. Because the flag RBP is at value "1" for channel CHk+3, channel CHk+3 is controlled to generate a tone in synchronism with smaller-number adjoining channel CHk+2. Likewise, each of the other channels is controlled to synchronize or to not synchronize with an adjoining channel depending on the value of the corresponding flag RBP.

In the above-described embodiment, the synchronizing process for changing or setting key-on signal KONk and pitch frequency number FNUMk of a channel CHk, having been instructed to synchronously generate a tone (i.e., designated for synchronized tone generation), to those of a predetermined adjoining channel CHk−1 may be performed in any optional section of the electronic musical instrument shown FIG. 1. As one example, parameters to be supplied from the microcomputer section COM to the individual channels may be temporarily stored in the computer interface CIF, and respective values of the flags RBP may be checked in the interface CIF so that key-on signals KON and pitch frequency numbers FNUM are supplied to the individual channels in a manner to meet the synchronous tone generation conditions in accordance with the checked values of the flags RBP. Alternatively, respective values of the flags RBP may be checked within the signal processors DSP1 and DSP2 so that key-on signals KON and pitch frequency numbers FNUM may be supplied to the individual channels in a manner to meet the synchronous tone generation conditions in accordance with the checked respective values of the flags RBP.

As apparent from the foregoing, because the value of the channel synchronization flag RBP for each channel can be changed as desired in the present invention, the invention can synthesize tone signals having a variety of formant structures or harmonic component combinations by only variably setting respective values of the channel synchronization flags RBP to thereby cause a variable combination of the tone generation channels to generate tones in synchronism with each other, easily by use of the limited structure of the channels.

Although a plurality of the tone generation channels designated for synchronized tone generation have been described above as generating tones at same timing and pitch, the pitch may be differentiated between the channels, for example, by an amount of an integer multiple. Further, some of the sound color setting or tone volume setting parameters, in addition to tone generation timing and pitch, may be made the same between the designated tone generation channels, or tone generation start timing may be differentiated slightly or by an appropriate amount between the designated tone generation channels.

Moreover, although, in the above-described embodiment, a specific channel designated for synchronous tone generation is controlled to synchronize with smaller-number adjoining channel(s), it may be controlled to synchronize with with greater number adjoining channel(s). The specific channel may be controlled to synchronize with only one adjoining channel.

Furthermore, although the embodiment has been described above as using the stored values of the flag RBP as synchronized tone generation designating data because the flag values are easy to control, any other appropriate data may be used as such synchronized tone generation designating data. For example, in addition to the channel synchronization flags RBP, channel data designating a channel to synchronize may be used so that not only adjoining channels but also other desired channels are synchronized with each other. Another modification may be made such that, in the synchronized tone generation mode, predetermined one of the channels is set as a basic channel and a channel designated for synchronized tone generation is synchronized with the basic channel.

In addition, although the above-described embodiment uses the digital signal processing section DSPS as shown in FIG. 1, as a tone signal generating device having a plurality of tone generation channels, to implement the above-mentioned channel synchronization operation, any other type tone signal generating device may be used. For example, the above-mentioned channel synchronization operation may be performed in a plurality of tone signal generating devices implemented by a single digital signal processing circuit, rather than in a plurality of digital signal processors arranged in parallel as shown in FIG. 1. Alternatively, the above-mentioned channel synchronization operation may be performed in a tone signal generating device which is designed to execute an optional tone synthesizing algorithm via software processing using a microcomputer, or may be performed in an all-hardware tone signal generating circuit which operates on a channel-by-channel time-divisional basis. In another modification, the above-mentioned channel synchronization operation may be performed in a plurality of tone signal generating circuits arranged in parallel corresponding to a plurality of tone generation channels.

As has been described so far, the present invention is characterized in that a series of operations for processing digital sound signal is divided into a plurality of operation groups to be allocated to a plurality of digital signal processor sections and simultaneously performed therein in a parallel fashion. With this feature, the present invention can perform all the necessary operations at substantially increased speed even where a great number of processing steps are involved and multi-channel sound signals are to be processed.

Further, because it is sufficient for each of the digital signal processor sections to execute only the allocated operations, the operations to be executed in each of the processor sections can be substantially simplified. This allows each of the processor sections to be substantially simplified in circuit structure, and the processor sections can be made similar in circuit structure. As a result, each of the processor sections can be designed and fabricated with increased ease and at reduced cost, and in addition, the general-purpose utility of the processing device of the present invention can be greatly enhanced.

Moreover, the present invention is characterized in that a plurality of the digital signal processor sections are interconnected via first and second common buses. Thus, when the number of the digital signal processor sections is to be increased, it is sufficient that wires or connecting lines for carrying input parameters and output data be simply connected to the buses without a need for complicated, separate wiring, and hence the number of the digital signal processor sections can be increased or decreased as desired with extreme ease. This also can enhance the general-purpose utility of the processing device of the present invention and achieve an efficient use of the processing device.

Furthermore, the present invention is characterized in that, in the case where a tone synthesis system employs different kinds of tone synthesis methods, any operation group processable by an operational algorithm common to the different methods is performed by means of a same digital signal processor section. With this feature, an efficient system can be provided. Further, according to the present invention, where part of the operations for synthesizing or processing digital sound signal is to be changed, it is sufficient that only any of the digital signal processor section corresponding to that part be changed in circuit structure. This feature advantageously permits an efficient designing change at low cost. Therefore, the present invention can efficiently comply with a demand of modifying the contents of the sound waveform synthesis or process. Further, the present invention can efficiently provide a multifunctional digital signal processing system for sound synthesis or process which allows the sound synthesis method to be optionally switched from one to another and also allows different sound synthesis methods to be used in combination.

Moreover, the present invention is characterized in that each of the processor sections is allowed to execute the allocated operations at its own time-divisional processing timing independently of the other processor section. With this feature, the time-divisional processing timing of each of the processor sections can be adjusted to differ from that of the other processor section, for example, in the light of the respective roles of the operations allocated to the individual processor sections. As a result, by appropriately controlling the time-divisional processing timing of the individual processor sections to be or not to be different from each other, the operation result of one digital signal processor section can be transferred to another digital signal processor section properly at optimum timing, which allows the entire operations to be carried out rapidly in a smooth manner.

Further, according to the present invention, each of the digital signal processor sections includes an operation section for receiving parameters necessary for a predetermined operation and performing the predetermined operation on digital input data in accordance with the received parameters and predetermined program and a dual-port memory having write and read ports for storing an operation result output from the operation section, so that data write and data readout to and from the dual-port memory can be controlled at respective timing independently of each other. Consequently, when one of the digital signal processor sections (first digital signal processor section) receives and utilize data output from the dual-port memory of another digital signal processor section (second digital signal processor section), the data readout operation can be controlled at independent timing of the first digital signal processor section which is separate from the write timing of the second digital signal processor section. Such an arrangement allows each of the processor sections to operate independently from the other processor section, and hence the processor sections can execute respective operation algorithms without being excessively constrained by each other, while being functionally related to each other, which provides very efficient operations.

The present invention is further characterized in that synchronized tone generation designating data indicating whether or not to generate a tone in synchronism with other channel is given to each channel independently of the other channels so that a plurality of selected channels are synchronized in generating tones. With this feature, synchronized tone generation control is achieved in various combinations of the channels as desired, and hence a single complex tone signal can be synthesized, easily and with limited elements of the tone generation channels, by combining tone signals of different formant structure or different harmonic components in synchronized channels.

[Another Example of Synchronized Tone Generation Instructing Function]

Next, a description will be made about another embodiment of the sound synthesis device having a synchronized tone generation instructing function as mentioned above, with reference to FIGS. 24 to 29. In particular, FIGS. 24 to 29 show in greater detail the above-mentioned synchronized tone generation instructing function and sound synthesizing functions such as a voiced formant sound synthesizing function and unvoiced (noise) formant synthesizing function. While the above-described embodiment employs digital signal processors to implement these functions, the embodiment of FIGS. 24 to 29 is designed to employ any other means than digital signal processors, such as dedicated hardware circuitry or software sound source using a CPU. The term "voice and tone synthesis" is used in the following description, but the term "sound synthesis" is used, throughout this specification, as a general term referring to not only voice and tone synthesis but also any other form of sound synthesis. Therefore, the term "voice and tone synthesis" is replaceable with the more general term "sound synthesis".

Figure 24:
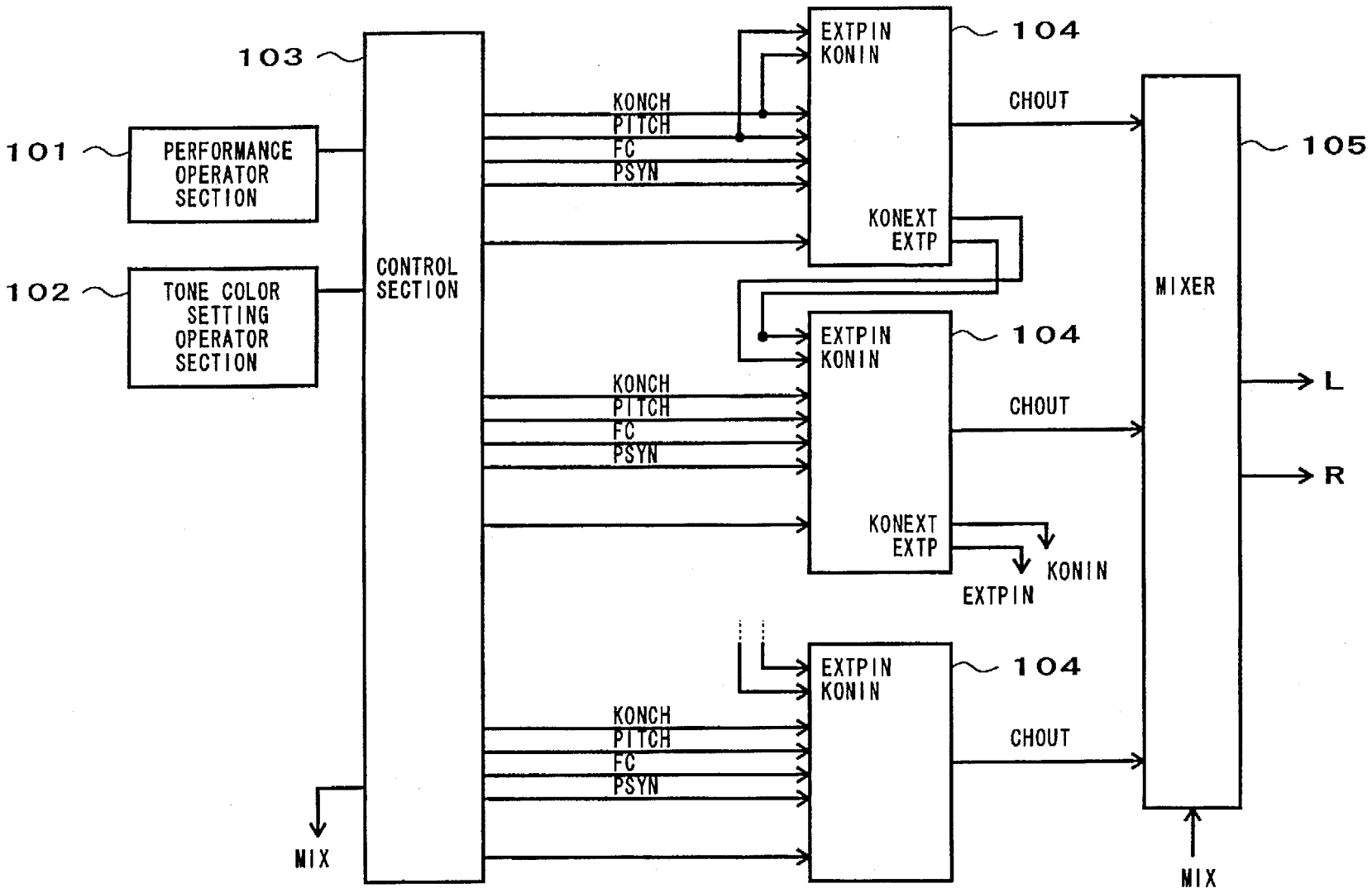
FIG. 24 is a block diagram illustrating a voice and tone synthesis device in accordance with another embodiment of the present invention.

FIG. 24 is a block diagram illustrating a voice and tone synthesizing device in accordance with an embodiment of the present invention. A performance operator section 101 is for example a keyboard provided with a plurality of keys, which is responsive to a key depression to outputs a key-on (tone generation start) signal and pitch information to a control section 103. A sound color setting operator section 102 outputs sound color information to the control section 103.

To the control section 103 are connected a plurality of tone generation channels 104. In the following description, the tone generation channels are uniquely identified by serial channel numbers where necessary to distinguish between the channels, and each tone generation channel of number smaller than that of a given tone generation channel by one is referred to as a preceding-stage tone generation channel while each tone generation channel of number greater than that of a given tone generation channel by one is referred to as a succeeding-stage tone generation channel.

Each of the tone generation channels has two key-on signal input terminals KONCH and KONIN for receiving a key-on signal, two formant pitch information input terminals PINCH and EXTPIN for receiving formant pitch information, and an input terminal FC for receiving formant center information.

Each of the tone generation channels also has a pitch synchronization control terminal PSYN for receiving a pitch synchronization control signal to select which of the signals received through the two key-on signal input terminals KONCH and KONIN and which of the two formant pitch information input terminals PINCH and EXTPIN should be made effective. The pitch synchronization control signal assumes two states, pitch synchronizing state and non-pitch-synchronizing state. When the pitch synchronization control signal is in the synchronizing state, the key-on signal input terminal KONIN and formant pitch information input terminals EXTPIN are activated, whereas when the pitch synchronization control signal is in the non-synchronizing state, the key-on signal input terminal KONCH and formant pitch information input terminals PITCH are activated.

Further, each of the tone generation channels a key-on signal output terminal KONEXT for outputting the key-on signal, a formant pitch information output terminal EXTP for outputting the formant pitch information. The key-on signal output terminal KONEXT outputs the key-on signal received at one of the input terminals KONCH and KONIN activated by the pitch synchronization control signal. Similarly, the pitch information output terminal EXTP outputs the pitch information received at one of the input terminals PITCH and EXTPIN activated by the pitch synchronization control signal.

Upon receipt of a key-on signal via via one of the key-on signal input terminals KONCH and KONIN activated by the pitch synchronization control, the tone generation channel 104 outputs, via an output terminal CHOUT, the formant pitch received at the activated pitch information input terminal PITCH or EXTPIN and a formant having the formant center frequency received at the center frequency input terminal FC.

To the input terminals KONCH, PITCH, FC and PSYN of each tone generation channel 104 are applied signal from the control signal 104.

The key-on signal input terminal KONIN of each tone generation channel 104 is connected to the key-on signal output terminal KONEXT of a preceding-stage tone generation channel, and the pitch information input terminal EXTPIN of each tone generation channel 104 is connected to the pitch information output terminal EXPT of a preceding-stage tone generation channel.

To the key-on signal input terminal KONIN and pitch information input terminal EXTPIN of the first tone generation channel 104 are applied signals from the control section 3 which correspond to the signals given to the key-on signal input terminal KONCH and pitch information output terminal EXTP, respectively, of the other tone generation channels. Further, the key-on signal output terminal KONEXT and pitch information output terminal EXPT of the last-stage tone generation channel are not connected with any external element.

Figure 25:
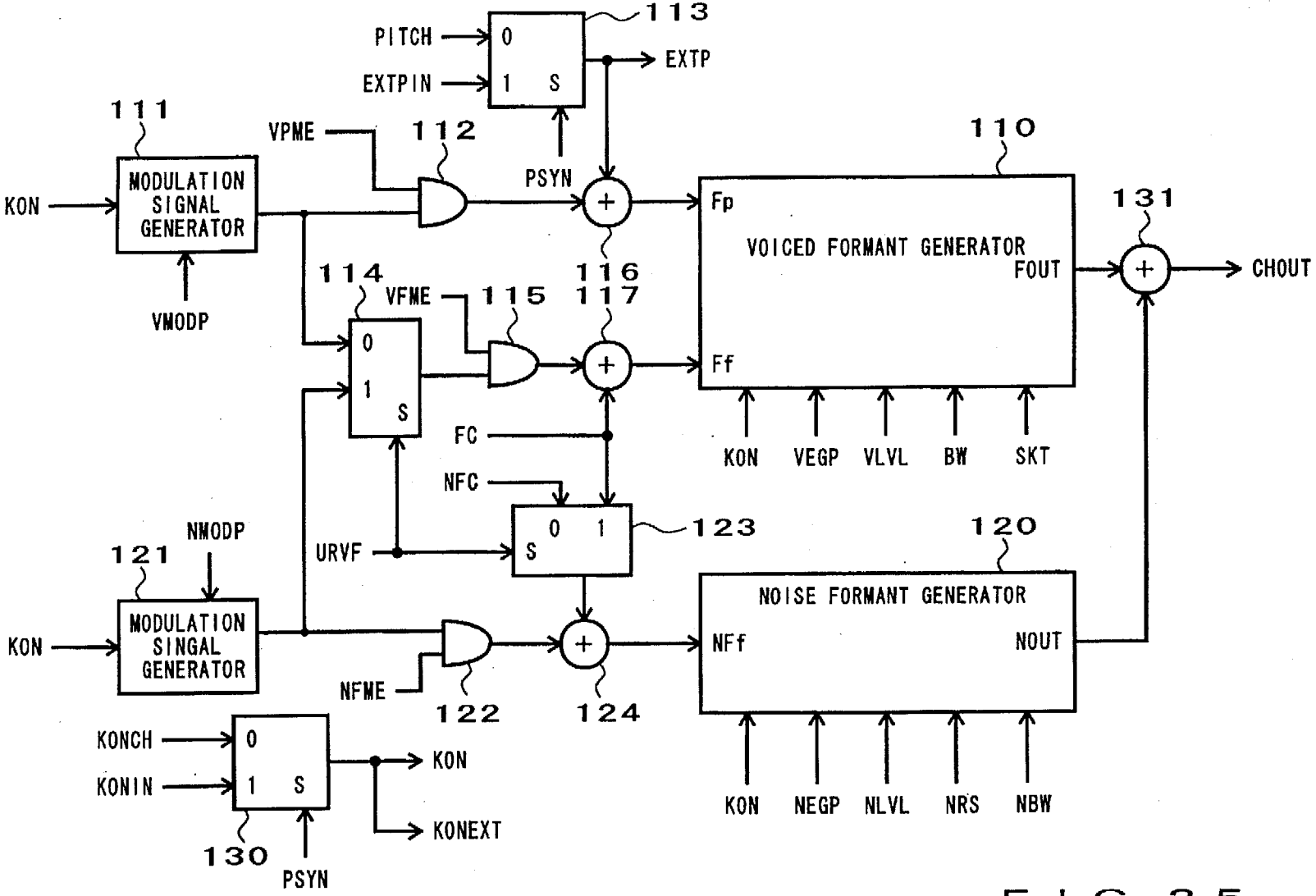
FIG. 25 is a block diagram illustrating an example of a sound generation channel of the voice and tone synthesis device of FIG. 24.

In addition, the control section 103 supplies each of the channels with other information to be used for forming a formant, as will be later described in greater detail with reference to FIG. 25. A formant output from the formant output terminal CHOUT of each tone generation channel 104 is fed to a mixer 105, which in turns combines the formants from the channels 104 to create a sound signal.

Next, a description will be made about a manner in which the above-mentioned voice and tone synthesizing device operates.

Upon receipt of a key-on signal and sound pitch information from the performance operator section 101, the control section 103 reads sound color information set via the sound color setting operator section 102, which sound color information includes information of not only normal sounds but also rather unusual sounds such as husky voice and whistle, as well as information of the Japanese syllabary.

In the control section 103, there are stored data of formants and formant frequencies corresponding sounds of various sound colors. The control section 103 selectively allocates a series of empty (available) tone generation channels for generating formants corresponding to the designated sound color. As will be described later, each empty tone generation channel is normally kept in the non-pitch-synchronizing state, the pitch synchronization control signal to be sent to the smallest-channel-number tone generating channel (hereinafter referred to as "leading tone generation channel") of those allocated for the formant formation may be maintained in the non-pitch-synchronizing state.

The pitch synchronization control signal is sent to the respective pitch synchronization control terminals PSYN of the allocated tone generation channels, in such a manner that the leading tone generation channel is set to the non-pitch-synchronizing state and the other allocated tone generation channels are set to the pitch-synchronizing state. Also, center frequency information of the formants to be formed is sent to the respective center frequency input terminals FC of the allocated tone generation channels.

Then, formant pitch information corresponding to sound pitch information input via the performance operator section 101 is sent to the pitch information input terminal PITCH of the leading tone generation channel. Now that the leading tone generation channel is in the non-pitch-synchronizing state, the formant pitch information received at the pitch information input terminal PITCH is output through the pitch information output terminal EXTP to be transferred to the pitch information input terminal EXTPIN of a first succeeding-stage tone generation channel.

Because the other allocated tone generation channels than the leading tone generation channel are now in the pitch-synchronizing state, the formant pitch information transferred to the input terminal EXTPIN of the first succeeding-stage tone generation channel will then be transferred to the input terminal EXTPIN of another succeeding-stage tone generation channel if any. In this way, once the control section 3 sends formant pitch information to the pitch information input terminal PITCH of the leading tone generation channel, the information is transferred to all the allocated tone generation channels.

The control section 103 also sends a key-on signal to the key-on signal input terminal KONCH of the leading tone generation channel. Similarly to the formant pitch information, the key-on signal is transferred to the key-on signal input terminal KONIN of all the allocated tone generation channels.

Predetermined signals are also sent to the key-on signal output terminal KONEXT and pitch information output terminal EXTP of the greatest-channel-number allocated tone generation channel. Consequently, if a tone generation channel succeeding the greatest-channel-number allocated tone generation channel is in the pitch-synchronizing state, the succeeding tone generation channel will undesirably execute a tone generation process on the basis of the key-on signal although it is not allocated for the formant formation. To prevent this inconvenience, it is preferred that all empty tone generation channels be initially maintained in the non-pitch-synchronizing state as mentioned earlier, except where sound colors are fixedly allocated to the channels.

Once a key-on signal is received by the leading tone generation channel, each allocated tone generation channel is caused to generate a formant on the basis of the formant center frequency information applied to its center frequency input terminal FC. Because the same formant pitch information has now been transferred to all the tone generation channels, formants generated by the allocated tone generation channels will have a same pitch, so that a resultant synthesized tone will have a constant sound pitch and color. Formant signals output from the respective formant output terminals CHOUT of the allocated tone generation channels are mixed by the mixer 105 to provide a desired sound signal.

The structure and operation of each of the tone generation channels 104 will be described below, with reference to FIG. 25 which is a block diagram illustrating an exemplary structure of one representative tone generation channel.

Key-on signals KONCH and KONIN are supplied to "0" input and "1" input, respectively, of a selector 130. In the figure and following description, the key-on signals are shown and referred to with the reference characters of the associated input terminals, and some of the other signals are also sometimes shown and referred to with the reference characters of the associated input terminals.

To select terminal S of the selector 130 is input the pitch synchronization control signal PSYN. The selector 130 selects the key-on signal KONCH supplied to the "0" input when the pitch synchronization control signal PSYN is in the non-pitch-synchronizing state, but selects the key-on signal KONIN supplied to the "1" input when the pitch synchronization control signal PSYN is in the pitch-synchronizing state. The selected result of the selector 130 is supplied as key-on signal KON to various elements of that tone generation channels and also output through the output terminal KONEXT to a succeeding-stage tone generation channel.

The formant pitch information is fed to one input terminal Fp of a voiced formant generator 110, and the formant center frequency information is fed to another input terminal Ff of the voiced formant generator 110. Upon receipt of the key-on signal KON, the voiced formant generator 110 generates a formant on the basis of the received formant pitch information and formant center frequency information and outputs the formant through output terminal FOUT.

Then, once noise formant center frequency information is received at input terminal NFf, a noise formant formant generator 120 generates a noise formant on the basis of the received noise formant center frequency information and outputs the formant through output terminal NOUT. Output signals FOUT and NOUT of the voiced formant generator 110 and noise formant formant generator 120 are added together by an adder 131, which then outputs output signal CHOUT.

Other signals than the above-mentioned are also fed to the voiced formant generator 110 and noise formant formant generator 120 for the purpose of generating the formants. The structure and operation of the voiced formant generator 110 and noise formant generator 120 will be later described in detail with reference to FIGS. 26 to 28.

Now, a description will be made about how formant pitch information Fp to be fed to the voiced formant generator 110 is formed.

The formant pitch information PITCH and EXTPIN are fed to "0" input and "1" input, respectively, of a selector 113, with the pitch synchronization control signal PSYN being fed to select terminal S of the selector 113. The selector 113 selects the formant pitch information PITCH fed to the "0" input when the pitch synchronization control signal PSYN is in the non-pitch-synchronizing state, but selects the formant pitch information EXTPIN supplied to the "1" input when the pitch synchronization control signal PSYN is in the pitch-synchronizing state.

The selected result of the selector 113 is supplied though its pitch information output terminal EXTP to a succeeding-stage tone generation channel. The selected result is also passed to one input terminal of an adder 116, which in turn adds the selected result of the selector 113 to information fed to the other input terminal so as to supply the addition result to the input terminal Fp of the voiced formant generator 110. If no information is fed to the other input terminal of the adder 116, then the formant pitch information PITCH or EXTPIN alone will be fed to the input terminal Fp of the voiced formant generator 110.

An output signal of a modulation signal generator 111 is fed via an AND gate 112 to the other input terminal of the adder 116, and a voiced formant modulation parameter MODP is fed to the modulation signal generator 111, which, in response to the key-on signal KON, outputs a signal modulated on the basis of the voiced formant modulation parameter MODP.

When a voiced formant pitch modulation enable signal VPME applied to one input terminal of the AND gate 112 is at a logical high level, the output signal of the modulation signal generator 111 is passed to the modulation signal generator 111. Then, the formant pitch information fed to the voiced formant generator 110 takes a value corresponding to the sum of the external formant pitch information and output signal of the modulation signal generator 111.

By thus adding the output signal of the modulation signal generator 111 to the external formant pitch information, a time-variant characteristic can be imparted to the formant pitch. The resultant time-variant formant pitch achieves an effect similar to vibrato obtained by shaking the vocal cords.

Next, a description will be made about how the formant center frequency information Ff to be fed to the voiced formant generator 110 is formed.

The external formant center frequency information FC is passed to one input terminal of an adder 117, which in turn adds the information FC to information fed to the other input terminal so as to supply the addition result to the formant center frequency information input terminal Ff of the voiced formant generator 110. Thus, if no information is fed to the other input terminal of the adder 117, then the external formant center frequency information alone will be fed to the input terminal Ff of the voiced formant generator 110.

The output signals of the modulation signal generators 111 or 121 is selected by a selector 114 and fed via an AND gate 115 to the other input terminal of the adder 117. A noise formant modulation parameter NMODP is fed to the modulation signal generator 121, which, in response to the key-on signal KON, outputs a signal modulated on the basis of the voiced formant modulation parameter NMODP.

When a voiced formant frequency modulation enable signal VFME applied to one input terminal of the AND gate 115 is at a logical high level, the modulation signal selected by the selector 114 is passed to the adder 117. Thus, a time-variant characteristic can be imparted to the formant center frequency, similarly to the formant pitch information.

Next, a description will be made about how the noise formant center frequency information NFC to be fed to the noise voiced formant generator 110 is formed.

Either the formant center frequency information FC or the noise formant center frequency information NFC is selected by a selector 123 and fed to one input terminal of an adder 124. The output signal of the modulation signal generator 121 is fed via an AND gate 122 to the other input terminal of the adder 124. When a noise formant frequency modulation enable signal NFME applied to one input terminal of the AND gate 122 is at a logical high level, the output signal of the modulation signal generator 121 is passed to the adder 124. Thus, a time-variant characteristic can be imparted to the noise formant center frequency, similarly to the voiced formant frequency information.

To both the select terminals S of the selector 114 and 123 is fed a formant synchronization control signal URVF, which takes two states, formant synchronizing state and non-formant-synchronizing state.

When the formant synchronization control signal URVF is in the non-formant-synchronizing state, the selector 114 selects the output signal of the modulation signal generator 111 fed to the "0" input and the selector 123 selects the noise formant center frequency information NFC fed to the "0" input. Namely, the formant center frequencies fed to the voiced formant generator 110 and noise formant generator 120 will differ from each other and also present time variations independent of each other.

On the other hand, when the formant synchronization control signal URVF is in the formant-synchronizing state, the selector 114 selects the output signal of the modulation signal generator 121 fed to the "1" input and the selector 123 selects the formant center frequency information FC fed to the "1" input. Namely, the formant center frequencies fed to the voiced formant generator 110 and noise formant generator 120 will be the same and also present synchronized time variations.

The noise formant having the same center frequency as the voiced formant will produce an effect of, for example, whispering voice. By keeping the voiced formant and noise formant identical in center frequency, it is possible to generate normal voice and whispering voice while optionally switching the two voices. When synthesizing consonant sound components having independent formants or synthesizing effect sound such as whistle and wind, time-variation of the noise formant center frequency can be controlled independently of that of the voiced formant center frequency.

Figure 26:
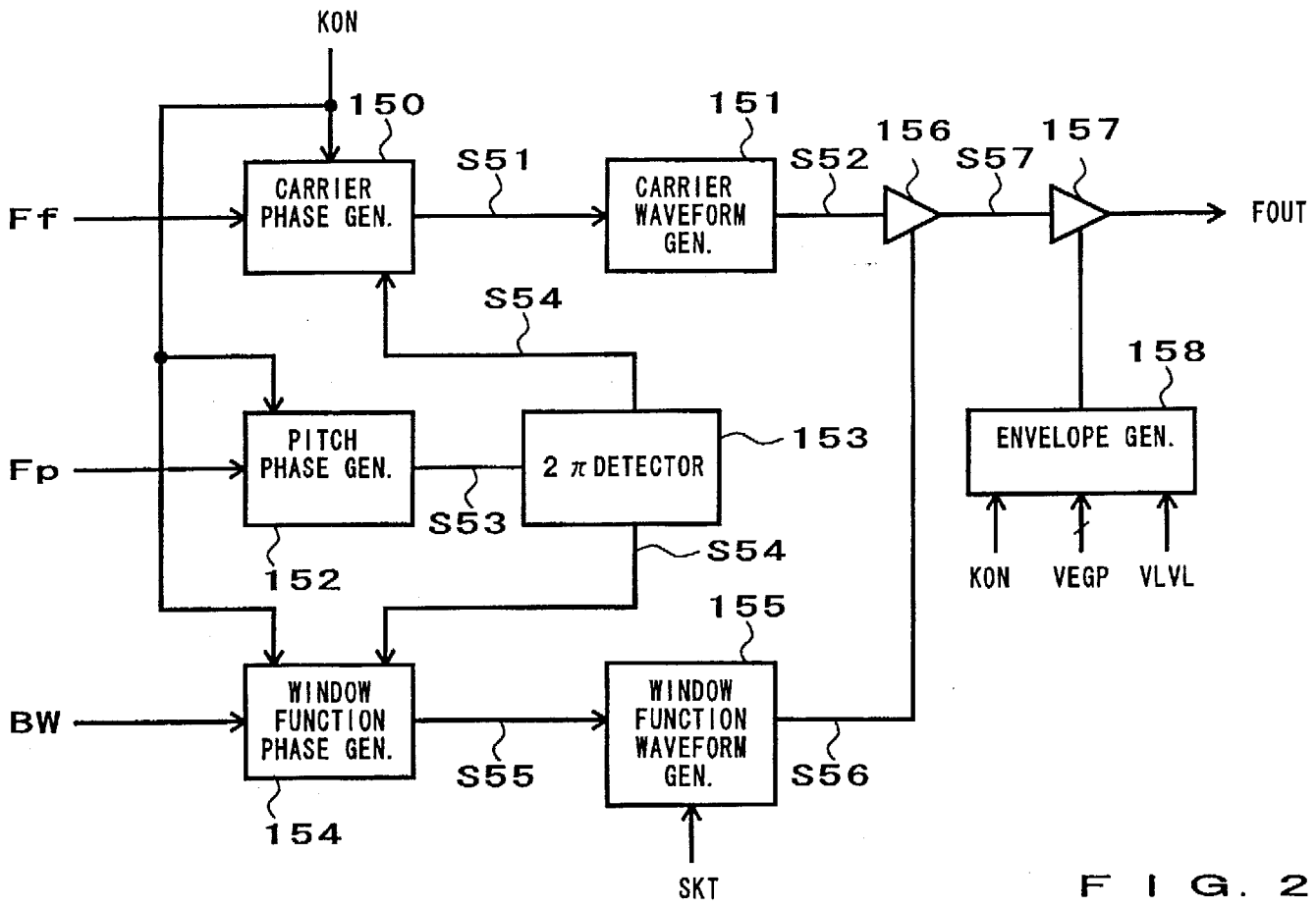
FIG. 26 is a block diagram illustrating an example of a voiced formant generator of FIG. 25.
Figure 27:
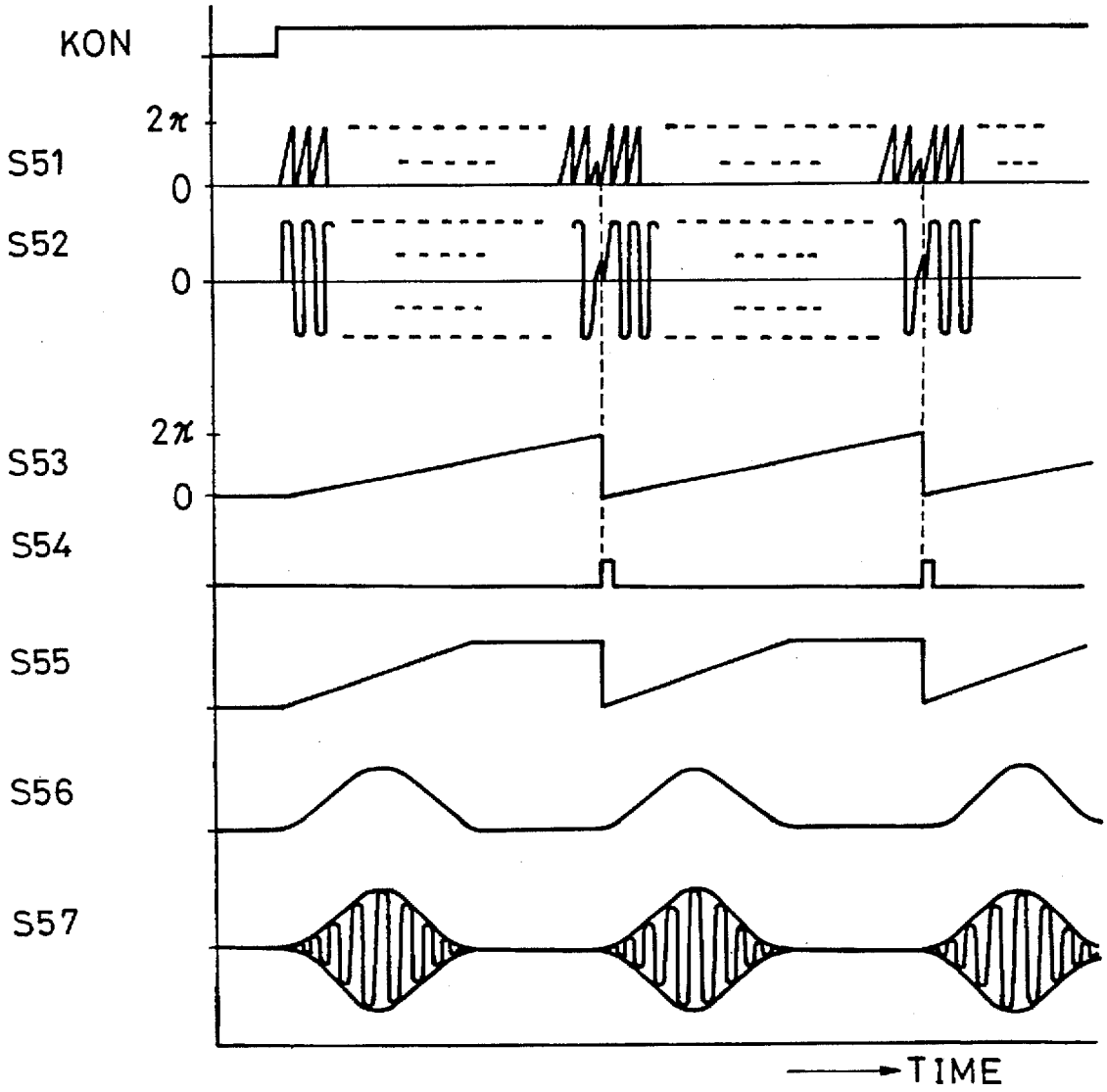
FIG. 27 is a graph illustrating exemplary waveforms obtained at various points of the voiced formant generator of FIG. 26.

Now, the general structure and operation of the voiced formant generator will be described with reference to FIGS. 26 and 27, of which FIG. 26 shows in block diagram the structure of the generator and FIG. 27 is a graph showing waveforms obtained at various points of the generator 26.

The formant center frequency information Ff is fed to a carrier phase generator 150, which, in response to the key-on signal, generates a sawtooth wave S51 whose amplitude level periodically varies from "0" to "2π". The output waveform of the carrier phase generator 150 is shown in item S51 of FIG. 27.

The formant pitch information Fp is fed to a pitch phase generator 152, which, in response to the key-on signal, generates a sawtooth wave S53 whose amplitude level periodically varies from "0" to "2π" at a given pitch. The output waveform of the pitch phase generator 152 is shown in item S53 of FIG. 27.

A 2π detector 153 detects when the amplitude level of the sawtooth wave S53, to thereby output a preset signal S54 as shown in item S54 of FIG. 27. In response to the preset signal S54, the carrier phase generator 150 compulsorily makes the amplitude level of the sawtooth wave S51 "0" in order to initiate generation of a new sawtooth wave S51.

A carrier waveform generator 151 generates a sine wave S52 on the basis of a phase as dictated by the sawtooth wave S51. The waveform of the sine wave S52 is shown in item S52 of FIG. 27.

To a window function phase generator 154 is fed window function time width information BW. In response to the key-on signal, the window function phase generator 154 a signal S55 whose amplitude level linearly increases from "0" to "2π" over a time designated by the window function time width information BW and then maintains a constant value of 2π. After that, every time the preset signal S54 is received from the 2π detector 153, the above action is repeated; namely, the signal S55 is reset to "0" and then again increases to and stays at 2π. The waveform of the signal S55 is shown in item S55 of FIG. 27.

Skirt information SKT is fed to a window function waveform generator 155, which, on the basis of the skirt information SKT, generates a signal S56 expressed as $\text{sine}^{2SKT}(x/2)$, where x represents an amplitude level of the signal S55. As shown in item S56 of FIG. 27, the signal 56 presents a smooth chevron-shaped waveform having a width determined by the the window function time width BW.

A multiplier 156 multiplies the signals S52 and 56 together to produce a signal S57 having a waveform as shown in item S57 of FIG. 27. The signal S52 is at phase "0" at the beginning of each chevron shape of the signal S56, so that the signal S57 repeatedly presents the same waveform at a pitch of the window function. In this manner, using the frequency of the signal S52 as the formant center frequency, the voiced formant S57 is formed which has a formant pitch corresponding to the pitch of the signal S56.

Further, voiced formant amplitude envelope information VEGP and voiced formant level information VLVL are fed to an envelope generator 158, which, in response to the key-on signal KON, generates an envelope waveform on the basis of the voiced formant amplitude envelope information VEGP and voiced formant level information VLVL. A multiplier 157 multiplies the formant signal S57 by the envelope waveform information generated by the envelope generator 158, so as to form and output formant signal FOUT.

Now, the general structure and operation of a noise formant generator circuit will be described with reference to FIG. 28, which shows in block diagram the structure of the noise formant generator 120.

The noise formant center frequency information NFf is fed to a phase generator 170, which, in response to the key-on signal, generates a sawtooth-wave-shaped phase signal. A carrier waveform generator 172 generates a sine waveform on the basis of the phase given from the phase generator 170. A white noise generator 173 generates white noise to be sent to one input of an adder 174. To the other input of the adder 174 is fed noise formant resonance peak characteristic information NRES, so that the adder 174 adds the noise formant resonance peak characteristic NRES to the white noise level and supplies the addition result to a noise spectrum control section 175.

Further, noise formant band characteristic information NBW is fed to the noise spectrum control section 175, which, on the basis of the noise formant band characteristic information NBW, outputs a signal obtained by cutting-off high frequency components of the noise signal sent from the adder 174. A multiplier 176 multiplies the sine waveform output from the carrier waveform generator 172 and the noise waveform output from the noise spectrum control section 175.

Further, noise formant amplitude envelope information NEGP and noise formant level information NLVL are fed to an envelope generator 178, which, in response to the key-on signal KON, generates an envelope waveform on the basis of the noise formant amplitude envelope information NEGP and noise formant level information NLVL. A multiplier 177 multiplies the noise formant signal output from the multiplier 176 by the envelope waveform information generated by the envelope generator 176, so as to form and output noise formant signal NOUT.

Figure 28:
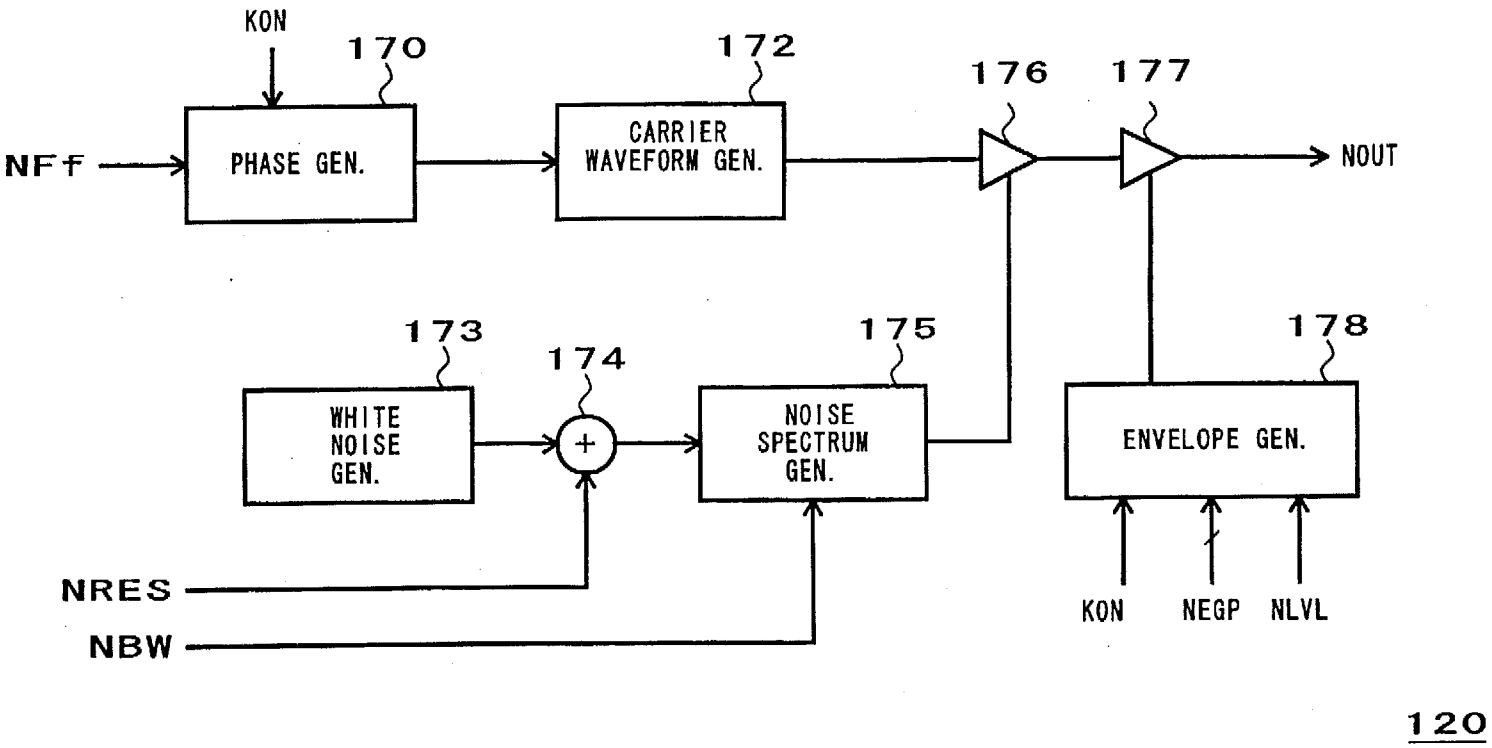
FIG. 28 is a block diagram illustrating an example of a noise formant generator of FIG. 24.

The voiced formant generator and noise formant generator shown in FIGS. 26 and 28 start generating tone in response to the same key-on signal KON in the above example, but may start generating tone in response to separate key-on signals KON. In addition, there may be a time lag from the receipt of the key-on signal to start of tone generation, and the waveform generation of the voiced and noise formant may be effected with an appropriate time difference therebetween. By thus setting a time difference, it is allowed to control a change from consonant sound to vowel sound.

Figure 29:
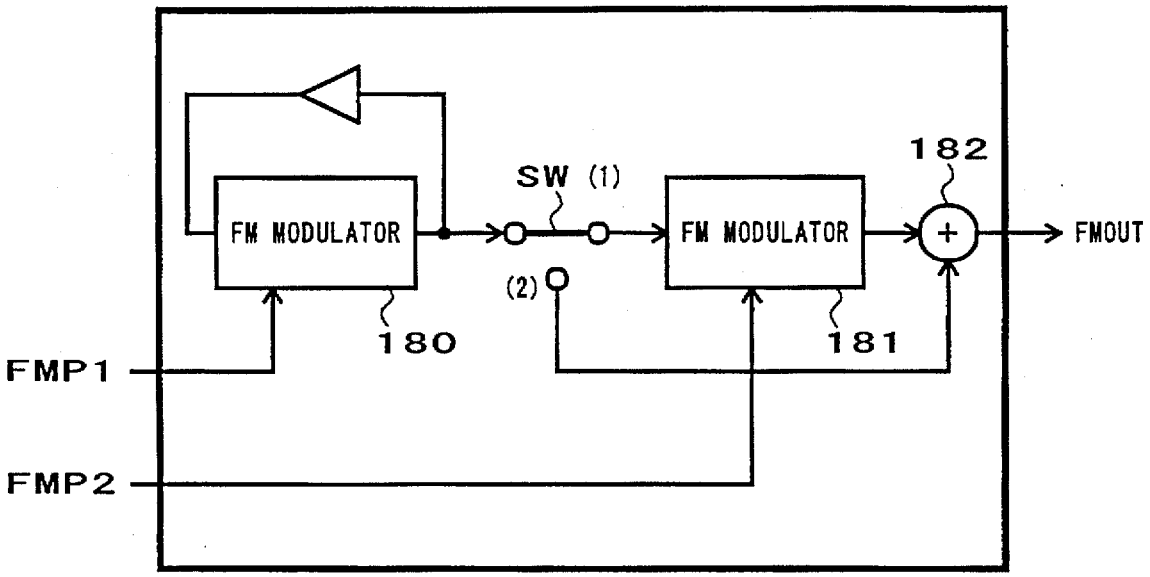
FIG. 29 is a block diagram illustrating an example of an FM sound source circuit.

While the above-described embodiment employed a voiced formant generator that generates a formant by multiplying a basic waveform by a window function, an FM sound source may be employed as shown in FIG. 29.

In FIG. 29, a modulated output signal from an FM modulator 180 is imparted a predetermined gain and then fed back to the input of the modulator 180. To the FM modulator 180 is also fed a modulating signal FMP1. When a switch SW is connected to contact (1), the modulated output signal is passed to a carrier signal input terminal of an FM modulator 181, to which modulator 181 is a modulating signal FMP2. Thus, the FM modulator 181 modulates the output signal from the FM modulator 180 with the modulating signal FMP2 and thereby forms and outputs a modulated output signal FMOUT by means of an adder 182. When, on the other hand, the switch SW is connected to contact (2), the modulated output signals of the FM modulators 180 and 181 are added together by the adder 182 to be provided as the signal FMOUT. In the FM sound source thus arranged, formant pitch information may be used as the modulating signal FMP1 and formant center frequency information may be used as the modulating signal FMMP2.

The output terminals KONEXT and EXTP of the last-stage tone generation channel may be connected with the input terminals KONIN and EXTPIN of the first-stage tone generation channel. Further, tone generation channels for generating instrument tones may be provided separately from tone generation channels for generating formant sounds.

The present invention should not be understood as limited to the above-described embodiments, and various modifications are possible without departing the spirit of the invention. For example, the present invention may be employed to simultaneously activate a plurality of tone generation channels in executing a duet or concert rather than in synthesizing a sound.

As has been described so far, the present invention can generate voices or tones via a plurality of tone generation channels by sending a key-on signal and pitch information to only one of the channels, and hence facilitates control of sound generation.

What is claimed is:

1. A digital signal processing device comprising:

a parameter supply section for supplying a plurality of parameters necessary for desired sound signal processing;

a plurality of independent digital signal processors, each of said digital signal processors including an operation processing section for receiving one or more parameters necessary for a predetermined operation so as to perform the desired operation on digital input data in accordance with the received parameters and a preset program, and a dual-port memory having separate write and read ports such that said dual-port memory can store operation result data output from said operation processing section via the write port and read out the stored operation result data via the read port independently of writing of the operation result data;

a first bus connected to each of said digital signal processors so as to distributively feed the plurality of parameters to predetermined one or more of said digital signal processors, and a second bus connected to each of said digital signal processors so as to transfer output data read out from the read port of the dual-port memory of each of said processors, wherein at least a predetermined one of said digital signal processors receives the output data from another said processors via said second bus and performs the predetermined operation using the received data as the input data, and each of said digital signal processors is capable of operating at timing independent of that of other of said digital signal processors by supplying, via said dual-port memory, the operation result data for use in said other digital signal processor.

2. A digital signal processing device as defined in claim 1 wherein each of said digital signal processors executes said program at a plurality of steps on a time-divisional basis to perform the predetermined operation, and the plurality of said processors perform said respective predetermined operations simultaneously in a parallel fashion.

3. A digital signal processing device as defined in claim 1, wherein each of said digital signal processors includes a program memory for storing a microprogram defining procedures of the predetermined operation, and a control section for, in accordance with the microprogram, controlling said operation processing section and dual-port memory to perform the predetermined operation.

4. A digital signal processing device as defined in claim 1 wherein all of said digital signal processors are implemented by a single integrated circuit.

5. A digital signal processing device as defined in claim 1 wherein at least one of said digital signal processors performs an operation to generate progressive phase data of a tone waveform corresponding to a desired pitch frequency.

6. A digital signal processing device as defined in claim 1 wherein at least one of said digital signal processors performs an operation to generate envelope signal data for controlling a tone over time.

7. A digital signal processing device as defined in claim 1 wherein at least one of said digital signal processors receives progressive phase data and envelope signal data from another of said digital signal processors via said second bus and performs an operation to generate tone waveform data on the basis of the received progressive phase data and envelope signal data.

8. A digital signal processing device as defined in claim 1 wherein said desired sound signal processing is at least either processing to synthesize a digital sound waveform signal or processing to impart an acoustic or musical effect to a digital sound waveform signal.

9. A sound signal synthesis device for synthesizing a sound signal in a plurality of channels, comprising:

a plurality of operation processing sections, each of said operation processing sections performing operations corresponding to each one of signal processing segments that are divided from sequential signal processing operations for sound-synthesizing, the plurality of said operation processing sections being provided in parallel relation to each other so as to simultaneously perform the operations, each of said operation processing sections performing the operations for a plurality of channels on a time-divisional basis at time-divisional channel processing timing unique to said processing section to thereby output an operation result of each said channel, at least one of said operation processing sections performing the operations by use of the operation results of another said operation processing section;

a plurality of dual-port memories, said dual-port memories being provided in corresponding relations to said operation processing sections, each said dual-port memory having separate write and read ports in such a manner that said dual-port memory can store operation result data output from the corresponding one of said operation processing sections via the write port and read out the stored operation result data via the read port independently of writing of the operation result data;

a bus connected to each of said operation processing sections and dual-port memories so as to transfer, via said bus, the operation result data of each said operation processing section, read out from the read port of the corresponding dual-port memory, to another said operation processing section or a sound signal output port, and a parameter supply circuit for supplying each said operation processing section with one or more parameters necessary for sound signal synthesis in each said channel.

10. A sound signal synthesis device as defined in claim 9 wherein the time-divisional channel processing timing of each said operation processing sections is displaced from that of other said operation processing sections depending on a form of use of the operation results of said operation processing means in said other operation processing section in said other operations processing sections.

11. A sound signal synthesis device as defined in claim 9 wherein one of said operation processing sections performs operations to generate envelope signal data for controlling a tone over time, and another said operation processing sections performs operations to generate a tone waveform signal controlled in correspondence with the envelope signal data generated by said one operation processing section.

12. A sound signal synthesis device as defined in claim 9 wherein one of said operation processing sections performs operations to generate progressive phase data of a tone waveform corresponding to a desired pitch frequency.

13. A sound signal synthesis device as defined in claim 9 wherein a first said operation processing section performs operations to synthesize a first waveform signal in accordance with a predetermined first sound-synthesizing algorithm, a second said operation processing section performs operations to synthesize a second waveform signal in accordance with a predetermined second sound-synthesizing algorithm, and a third said operation processing section performs operations to generate envelope signal data for controlling a sound over time, and wherein envelopes of the first and second waveform signals synthesized by said first and second operation processing sections are controlled by use of the envelope signal data generated by said third operation processing section.

14. A sound signal synthesis device as defined in claim 13 wherein at least said first operation processing section is capable of changing said first sound-synthesizing algorithm in accordance with a given parameter.

15. A sound signal synthesis device as defined in claim 9 wherein each said dual-port memory, in correspondence with the time-divisional channel processing timing of said operation processing section associated with said dual-port memory, is controlled write thereinto of the operation result data of said associated operation processing section, and also controlled read therefrom of said operation result data in correspondence with the time-divisional channel processing timing of another said operation processing section in which the operation result data of said associated operation processing section is to be used.

16. A sound signal synthesis device comprising:

a sound signal generation section for generating separate sound signals in a plurality of channels on the basis of parameters supplied individually to the channels;

a parameter supply section for supplying the parameters to each of the channels, said parameters to be supplied to each of the channels including tone generation instruction information and synchronized tone generation designating data specifying whether or not said channel should generate a sound in synchronism with another said channel, and a control section for, on the basis of the synchronized tone generation designating data supplied to each of the channels, controlling said sound signal generation section in such a manner that any of the channels designated for synchronized tone generation generates a sound signal in synchronism with predetermined one or more of other said channels, wherein said control section controls sound generation timing and pitch in said designated channel to synchronize with those of said predetermined other channels.

17. A sound signal synthesis device as defined in claim 16 wherein said predetermined other channel is a channel which adjoins said channel designated for synchronized tone generation and is not itself designated for synchronized tone generation.

18. A sound signal synthesis device as defined in claim 16 wherein said parameters include sound tone color setting and controlling parameters unique to each said channel, and said sound signal generation section, irrespective of the synchronized tone generation designation, generates the sound signal in the channels by use of the sound color setting and controlling parameters.

19. A voice and tone synthesis device comprising:

a plurality of waveform generation sections receiving a sound generation start signal instructing a start of sound generation and pitch information so as to form a sound waveform on the basis of the pitch information in response to the sound generation start signal;

a control section for supplying the sound generation start signal and pitch information to specific one of the plurality of said waveform generation sections, and a transfer section for transferring the sound generation start signal and pitch information from said specific waveform generation section to predetermined other one of said waveform generation sections, wherein said specific waveform generation section and the predetermined other one of said waveform generation sections generate tones of harmonized pitches at synchronized generating timings.

20. A voice and tone synthesis device as defined in claim 19 wherein said control section includes an input terminal for receiving a sound generation instruction from outside so that said control section selects a predetermined number of said waveform generation sections in response to the sound generation instruction and supplies the sound generation start signal and pitch information to specific one of said selected waveform generation sections, and wherein said transfer section transfers the sound generation start signal and pitch information from said specific waveform generation section to another said waveform generation section.

21. A voice and tone synthesis device comprising:

a plurality of sound generation channels each including first and second sound generation start signal input terminals for receiving a sound generation start signal, a center frequency information input terminal for receiving formant center frequency information, first and second pitch information input terminals for receiving formant pitch information, and a control input terminal for receiving a pitch synchronization control signal that takes either a pitch-synchronizing state or a non-pitch-synchronizing state, wherein each of said sound generation channels generates a formant sound on the basis of the sound generation start signal received via said first sound generation start signal input terminal, the formant center frequency information received via said center frequency information input terminal and formant pitch information received via said first pitch information input terminal when the pitch synchronization control signal is in the pitch-synchronizing state, and each of said sound generation channels generate a formant sound on the basis of the sound generation start signal received via said second sound generation start signal input terminal, the formant center frequency information received via said center frequency information input terminal and formant pitch information received via said second pitch information input terminal when the pitch synchronization control signal is in the non-pitch-synchronizing state, each of said sound generation channels further including a sound generation start signal output terminal for outputting the sound generation start signal received via said first sound generation start signal input terminal when the pitch synchronization control signal is in the pitch-synchronizing state but outputting the sound generation start signal received via said second sound generation start signal input terminal when the pitch synchronization control signal is in the non-pitch-synchronizing state, and a pitch information output terminal for outputting the formant pitch information received via said first pitch information input terminal when the pitch synchronization control signal is in the pitch-synchronizing state but outputting the formant pitch information received via said second pitch information input terminal when the pitch synchronization control signal is in the non-pitch-synchronizing state;

a plurality of connecting lines for interconnecting said first sound generation start signal input terminal and first pitch information input terminal of (n)th said sound generation channel and said sound generation start signal output terminal and pitch information output terminal of (n−1)th said sound generation channel, where n represents an optional channel number in a case where the plurality of said sound generation channels are identified by serial channel numbers, and a control section, responsive to a performance input signal, for selecting a predetermined number of said sound generation channels of consecutive channel numbers to supply predetermined formant center frequency information to said center frequency input terminal of each of said selected sound generation channels, setting to the non-pitch-synchronizing state the pitch synchronization control signal to be supplied to one of said selected sound generation channels of smallest channel number, setting to the pitch-synchronizing state the pitch synchronization control signal to be supplied to other said selected sound generation channels, and supplying a sound generation start signal and predetermined formant pitch information to the second sound generation start signal input terminal and pitch information input terminal, respectively, of one of said selected sound generation channels of smallest channel number.

* * * * *